US006169469B1

(12) United States Patent
Misumi et al.

(10) Patent No.: US 6,169,469 B1
(45) Date of Patent: Jan. 2, 2001

(54) RELAY

(75) Inventors: Shuichi Misumi; Mitsuhiro Kawai; Takaaki Yamada, all of Kyoto (JP)

(73) Assignee: Omron Corporation, Kyoto (JP)

( * ) Notice: Under 35 U.S.C. 154(b), the term of this patent shall be extended for 0 days.

(21) Appl. No.: 09/171,908

(22) PCT Filed: Apr. 24, 1997

(86) PCT No.: PCT/JP97/01425

§ 371 Date: Oct. 28, 1998

§ 102(e) Date: Oct. 28, 1998

(87) PCT Pub. No.: WO97/41585

PCT Pub. Date: Jun. 11, 1997

(30) Foreign Application Priority Data

May 1, 1996 (JP) ..... 8-110796
Aug. 27, 1996 (JP) ..... 8-224822

(51) Int. Cl.[7] ..... H01H 51/22

(52) U.S. Cl. ..... 335/78; 335/80; 335/202; 335/203; 335/261; 335/275; 335/299

(58) Field of Search ..... 335/78–86, 124, 335/127, 128, 202, 203, 275, 261, 299; 336/232

(56) References Cited

FOREIGN PATENT DOCUMENTS 2 532 780 * 9/1984 (FR) .
2 186 428 * 8/1987 (GB) .
46-3896 * 2/1971 (JP) .
1-292725 * 11 1989 (JP) .
6-076716 * 3/1994 (JP) .

* cited by examiner

*Primary Examiner*—Michael L. Gellner
*Assistant Examiner*—Raymond Barrera
(74) *Attorney, Agent, or Firm*—Morrison & Foerster, LLP

(57) ABSTRACT

A relay of the present invention comprises a coil plate 30 having at least one layer of spiral flat coil 36*a*–36*d* formed around each of a pair of holes 32, 33 and fixed contacts 23*a*, 24*a* and movable contacts which are opposed to each other contactably and separably via the holes 32, 33 in the coil plate 30. The fixed contacts 23*a*, 24*a* are provided on one side of each of a pair of flat core blocks 21, 22 juxtaposed and insulated from one another. The movable contacts are provided on one movable contactor 43 which is supported so as to be drivable along a direction of plate thickness via at least one hinge portion 42 extending from a support member 44 for a movable contact plate 40.

32 Claims, 45 Drawing Sheets

RELAY

TECHNICAL FIELD OF THE INVENTION

The present invention relates to relays and, more particularly, to a subminiature relay made up by stacking generally plate-shaped component parts.

BACKGROUND ART

As a subminiature relay made up by stacking generally plate-shaped component parts, there has conventionally been a relay described in Japanese Patent Laid-Open Publication HEI 1-292725.

This relay is characterized by comprising a substrate which has two fitting holes and at least two print coil portions formed by printing into a generally spiral form around these fitting holes, an iron core which has a generally U-shaped cross section and which has both end portions fitted to the fitting holes so as to be protruded, respectively, and a movable contactor whose one end portion is fixedly secured to the projecting one end portion of the iron core and whose intermediate portion is placed so as to be contactable with and separable from the projecting other end portion of the iron core and moreover in which a movable contact provided at a free end portion of the movable contactor is contactably and separably opposed to a fixed contact provided on the substrate.

However, in this relay, because the iron core and the movable contactor must be assembled to the substrate in different directions, respectively, not only the positioning and assembling processes are time-consuming but also variations in accuracy of the assembling are more likely to occur. As a result, the relay is low in productivity and prone to variations in operating characteristics.

Also, because electrical conduction part and magnetic conduction part are constituted independently of each other, the relay is difficult to miniaturize.

Further, because the relay has a single contact, there is a problem that the contact reliability is low.

In view of these and other problems, an object of the present invention is therefore to provide a miniature relay which is high in contact reliability and productivity and which is free from variations in operating characteristics.

SUMMARY OF THE INVENTION

In order to achieve the above object, a first feature of the present invention exists in a relay comprising: a coil plate having at least one layer of spiral flat coil formed around each of a pair of holes and electrically connected to each other; and fixed contacts and movable contacts which are opposed to each other contactably and separably via the respective holes in the coil plate, wherein the fixed contacts are provided on one side of each of a pair of flat core blocks juxtaposed and insulated from one another, while the movable contacts are provided on one movable contactor which is supported so as to be drivable along a direction of plate thickness via at least one hinge portion extending from a support member for a movable contact plate.

According to the first feature of the present invention, since the movable contactor makes contact with the two fixed contacts, the relay becomes the so-called double break contact type. Moreover, since these contacts operate on magnetic force caused by the flat coils formed around the respective contacts, each contact force is stable and the contact reliability is improved.

Also, since the relay has a layer structure that the flat core block, the coil plate and the movable contact plate are stacked one on another, the relay is easy to assemble and high in assembling accuracy. As a result, a thin, miniature relay which is high in productivity and free from variations in operating characteristics can be obtained.

In particular, since the magnetic conduction part is shared by the electrical conduction part, the number of component parts and the number of assembling man-hours are small so that even higher productivity results.

Further, since a pair of flat core blocks are juxtaposed in an insulated state, the so-called double break contact is constituted. As a result, the contact-to-contact distance becomes substantially long, so that a relay excellent in insulating characteristic can be obtained.

A second feature of the present invention is that the fixed contacts are placed at fore end portions of iron cores which are of protrusions, also insertable into the holes in the coil plate. Also, a third feature is that the movable contacts are placed at fore end portions of protrusions protrusively provided on one side of the movable contactor and which are also insertable into the holes in the coil plate.

According to the second and third features of the present invention, since both the movable contact and the fixed contact are placed at fore ends of the protruding portions, magnetic fluxes are concentrated so that a relay of high magnetic efficiency can be obtained.

A fourth feature is that the flat core block is electrically connected to a connecting end portion of a contact terminal exposed from a bottom face of a box-shaped base.

According to the fourth feature, since the flat core blocks are electrically connected to the connecting terminals of the contact terminals exposed from the bottom face of the box-shaped base, the assembling work is not time-consuming and the productivity is high.

A fifth feature is that in the movable contact plate, a slit of a roughly C-like planar shape is provided in a thin plate made of an electrically conductive magnetic material, whereby a hinge portion is formed and whereby the annular support member and the movable contactor are partitioned from each other.

According to the fifth feature, since the movable contact plate is formed of a thin plate comprising one electrically conductive magnetic material, a relay low in unit price of component parts and high in parts accuracy and assembling accuracy can be obtained.

A sixth feature is that the movable contact plate is fitted to an annular step portion formed at an opening edge portion of the box-shaped base.

According to the sixth feature, since the movable contact plate is fitted and assembled to the annular step portion formed at the opening edge portion of the base, the assembling work of the movable contact plate becomes easier.

A seventh feature is that the flat core block is fixed in close contact to an insulating film provided on a lower surface of the coil plate, while the support member for the movable contact plate is fixed in close contact to an insulating film provided on an upper surface of the coil plate.

According to the seventh feature, since the flat core block and the movable contact plate are make close contact with the coil plate, an even thinner type relay can be obtained.

An eighth feature is that a pair of flat core blocks electrically connected to connecting end portions of a pair of contact terminals cut out from a lead frame are integrally molded with the base. Also, a ninth feature is that both a pair of flat core blocks electrically connected to connecting end portions of a pair of contact terminals cut out from a lead frame, and a coil plate electrically connected to connecting end portions of a pair of coil terminals cut out from the lead frame are integrally molded with the base.

According to the eighth and ninth features, since the flat core block and the coil plate connected via the lead frame can be integrally molded with the base, continuous production of the relay is enabled, offering an advantage that the productivity is remarkably improved.

A tenth feature exists in a relay comprising: a coil plate having at least one layer of spiral flat coil formed around each of a pair of holes and electrically connected to each other; and fixed contacts and movable contacts which are opposed to each other contactably and separably via the respective holes in the coil plate, wherein the fixed contacts are provided on one side of one flat core block, while the movable contacts are provided on one movable contactor which is supported so as to be drivable along a direction of plate thickness via at least one hinge portion extending from a support member for a movable contact plate.

According to the tenth feature, since the movable contactor makes contact with the two fixed contacts, the relay becomes the so-called twin-contact type so that the contact reliability is improved.

Also, since the relay is made up into a layer structure that the movable contact plate, the coil plate and the iron core are assembled vertically one by one, the relay is easy to assemble and high in assembling accuracy. As a result, a thin type relay free from variations in operating characteristics can be obtained.

Further, since the iron core can be used to serve also as a fixed contact, the support member and the movable contactor are integral via the hinge portion, the number of component parts and the number of assembling man-hours are small so that high productivity results.

An eleventh feature is that in the movable contact plate, a slit of a roughly C-like planar shape is provided in a thin plate made of an electrically conductive magnetic material, whereby a hinge portion is formed and whereby the annular support member and the movable contactor are partitioned from each other.

According to the eleventh feature, since the movable contact plate is formed of a thin plate comprising one electrically conductive magnetic material, a relay low in unit price of component parts and high in parts accuracy and assembling accuracy can be obtained.

A twelfth feature is that a spacer is held between the support member for the movable contact plate and the coil plate.

According to the twelfth feature, since a space for the movable contact plate to pivot can be secured, there is no need of executing bending process with the movable contactor. Therefore, the parts accuracy become high so that the number of processing man-hours is reduced.

A thirteenth feature is that the support member for the movable contact plate is thicker than the movable contactor and the hinge portion.

According to the thirteenth feature, since there is no need of providing a separate spacer, a relay small in the number of component parts and the number of assembling man-hours can be obtained.

A fourteenth feature is that the hinge portion is made thin. A fifteenth feature is that a hole is provided in the hinge portion. A sixteenth feature is that both end portions of the slit extend within the movable contactor so as to form an elongated hinge portion.

According to the fourteenth, fifteenth and sixteenth features, the movable contactor can be pivoted with small external force, a relay of high sensitivity can be obtained.

A seventeenth feature is that the flat core block having an iron core is fixed in close contact to an insulating film provided on an upper surface of the coil plate, while the support member for the movable contact plate is fixed in close contact to an insulating film provided on a lower surface of the coil plate.

An eighteenth feature is that the flat core block having an iron core is fixed in close contact to an insulating film provided on an upper surface of the coil plate, while the support member for the movable contact plate is fixed in close contact via a spacer to an insulating film provided on a lower surface of the coil plate.

According to the seventeenth and eighteenth features, the insulation can be obtained securely without using any special insulating part. Moreover, since the positional relation between the iron core and the support member or the spacer is determined only by controlling the thickness of the coil plate, the operating characteristics are stabilized.

A nineteenth feature is that a lower-surface edge portion of the coil plate is integrally joined to a top-surface edge portion of the box-shaped base, and the movable contact plate is accommodated in a sealed space formed by sealing the holes of the coil plate with the flat core block having an iron core.

A twentieth feature is that an insulating film is provided on a portion of the lower surface of the flat core block that serves as a joint surface to the coil plate, and that the coil plate and the box-shaped base are formed from the same material as the insulating film.

According to the nineteenth and twentieth features, since a close structure can be formed, corrosive gas and foreign matters can be prevented from invasion and the insulating performance can be enhanced by evacuating the closed space to a high vacuum or by filling highly insulative gas or liquid in the closed space.

A twenty-first feature exists in a relay comprising: a box-shaped base in which a movable contact terminal is exposed from a bottom-face corner portion of the base and in which upper end portions of the coil terminal and the fixed contact terminal are exposed from a top-surface edge portion of the base; a movable contact plate accommodated in the box-shaped base and electrically connected to the movable contact terminal; a coil plate fixed in close contact to the top-surface edge portion of the box-shaped base and having a flat coil electrically connected to an upper end portion of the coil terminal; and a flat core block which is fixed in close contact to an upper surface of the coil plate and in which iron cores protrusively provided on a lower surface of the flat core block are protruded from the holes of the coil plate and moreover which is electrically connected to the upper end portion of the fixed contact terminal.

According to the twenty-first feature, since the component parts can be assembled in the same direction, the relay becomes easier to assemble, particularly automatically assemble.

Also, since the movable contactor is positioned at the bottom face of the box-shaped base and the coil plate is provided at the upper edge portion of the box-shaped base, the insulation distance between the flat coil and the movable contactor can be secured.

A twenty-second feature is that the upper end portions of the coil terminal and the fixed contact terminal protruding from the top-surface edge portion of the box-shaped base are fitted to and thereby electrically connected to their corresponding terminal holes or cutout portions provided in the coil plate and the flat core block, respectively.

According to the twenty-second feature, since the upper end portions of the coil terminal and the fixed contact terminal are protruded from the upper edge portion of the box-shaped base, these members can be fitted and positioned to the terminal holes or cutout portions provided in the coil plate and the flat core block so that the assembling work becomes even easier.

A twenty-third feature is that out of the upper end portions of the coil terminal and the fixed contact terminal exposed flush from the top-surface edge portion of the box-shaped base, the upper end portion of the coil terminal has coil plates stacked thereon and electrically connected, while the upper end portion of the fixed contact terminal is electrically connected to the flat core block via a relaying conductor provided to the coil plates.

According to the twenty-third feature, not only the base becomes easier to fabricate, but also the relaying conductor can be formed by the same process as the flat coil, thus suppressing increase in cost.

A twenty-fourth feature is that out of the upper end portions of the coil terminal and the fixed contact terminal exposed flush from the top-surface edge portion of the box-shaped base, the upper end portion of the coil terminal has coil plates stacked thereon and electrically connected, while a connecting step portion provided downwardly protruding from an edge portion of the flat core block is joined directly to the upper end portion of the fixed contact terminal and electrically connected.

According to the twenty-fourth feature, since no relaying conductor is needed, there is produced an advantage that the reliability of electrical connection is improved.

A twenty-fifth feature is that a thin-plate soft magnetic material is integrally joined to the movable contactor of the movable contact plate.

According to the twenty-fifth feature, since a thin-plate soft magnetic material is formed integrally with the movable contactor, magnetic saturation is unlikely to occur so that a desired attracting force can be secured.

Also, since the area of opposition to the flat core block is increased by forming the soft magnetic material larger than the movable contactor, less leakage of magnetic flux occurs so that the magnetic efficiency is improved and the power consumption can be reduced.

Further, since the slit for forming the hinge portion that supports the movable contactor can be formed wider, press working becomes easier to accomplish so that the productivity is improved.

Besides, since the movable contact plate and the soft magnetic material can be formed from different materials, the degree of freedom of design is increased.

A twenty-sixth feature is that the thin-plate soft magnetic material has a planar shape generally identical to a planar shape of the movable contact plate except for the peripheral edge portion.

According to the twenty-sixth feature, the thin-plate soft magnetic material becomes the largest possible area, offering an advantage that the magnetic efficiency is maximized.

A twenty-seventh feature is that a rib for forming a magnetic circuit is protrusively provided on at least one edge portion of the flat core block.

According to the twenty-seventh feature, the rib of the flat core block is positioned in proximity to the movable contact plate or the thin-plate soft magnetic material. Therefore, a desired attracting force can be obtained easily, and less leakage of magnetic flux occurs so that the magnetic efficiency is improved.

A twenty-eighth feature is that an end portion of the rib for forming a magnetic circuit is contactably opposed to a peripheral edge portion of the thin-plate soft magnetic material.

According to the twenty-eighth feature, the rib of the flat core block can be brought into contact with peripheral edge portion of the thin-plate soft magnetic material. In particular, when the thin-plate soft magnetic material is made to have the largest possible area, a relay having the largest magnetic efficiency while preventing magnetic saturation can be obtained as an advantage.

DETAILED DESCRIPTION OF THE INVENTION

Hereinbelow, embodiments of the relay according to the present invention are described with reference to the accompanying drawings, FIGS. 1 through 46.

Figure 1:
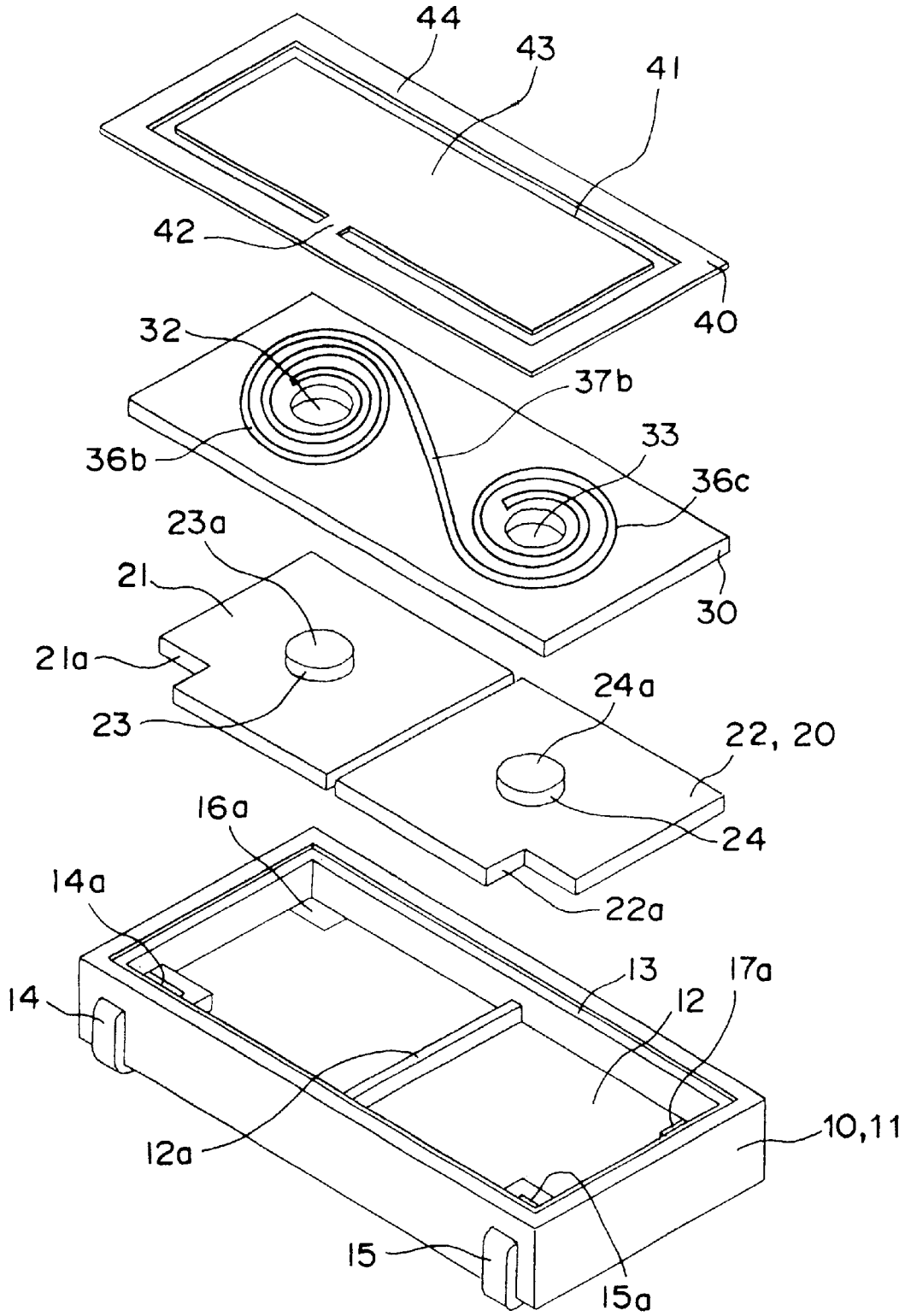
FIG. 1 is an exploded perspective view of a relay showing a first embodiment of the present invention.
Figure 2:
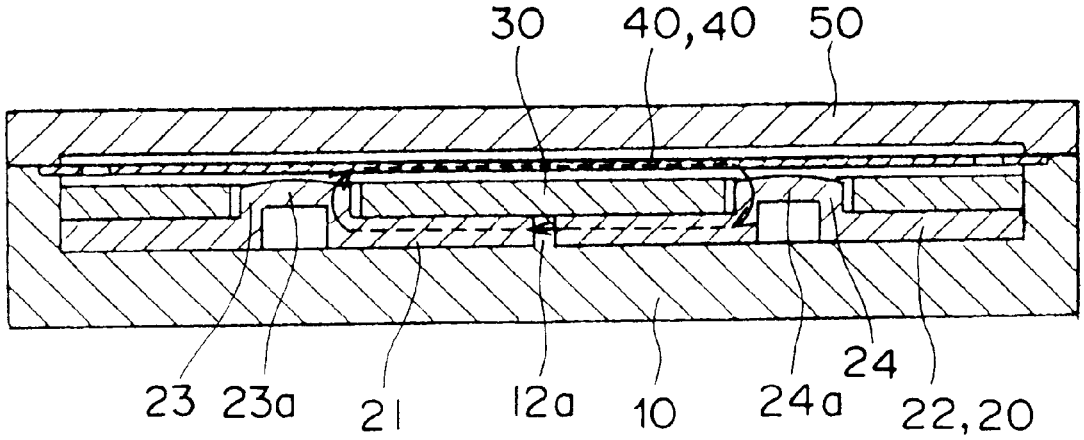
FIG. 2 is a sectional view of the relay shown in FIG. 1.

The relay according to a first embodiment, as shown in FIGS. 1 and 2, generally comprise a base 10, a fixed contact unit 20, a coil plate 30, a movable contact plate 40 and an insulative cover 50.

The base 10 is made by insert-molding coil terminals 14, 15 and contact terminals 16, 17 to a box-shaped base body 11 having a generally rectangular planar shape. At corner portions of a bottom face 12 of the base body 11, connecting end portions 16*a*, 17*a* of the contact terminals 16, 17, respectively, are exposed flush with the bottom face 12, while connecting end portions 14*a*, 15*a* of the coil terminals 14, 15 are exposed at one-step higher positions. Further, a linear protrusion 12*a* for insulation use is provided in the center of the bottom face 12 of the base body 11, while an annular step portion 13 is formed at an opening edge portion of the base body 11.

Figure 3:
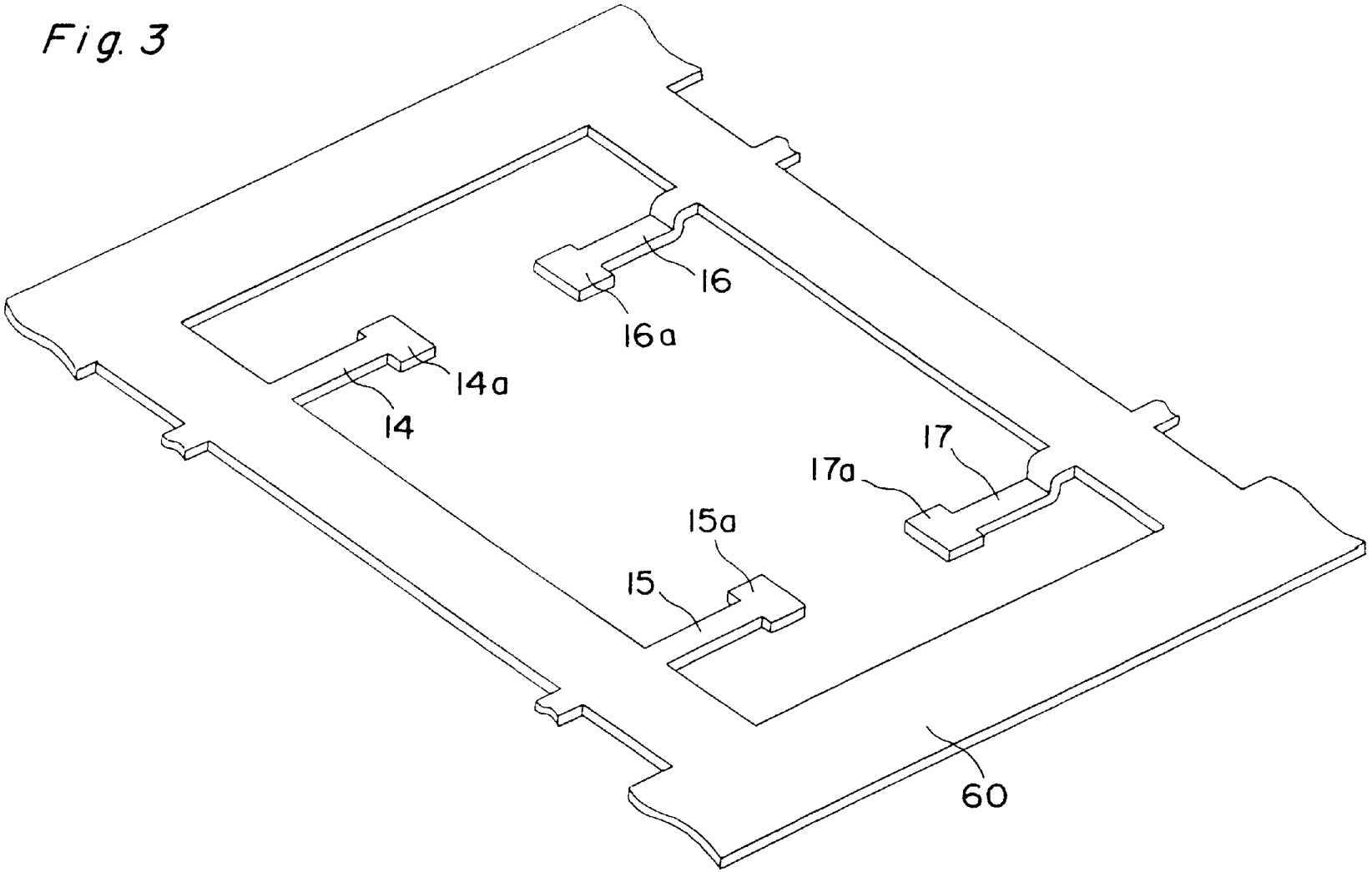
FIG. 3 is a perspective view of a lead frame to be insert-molded to a base.
Figure 4:
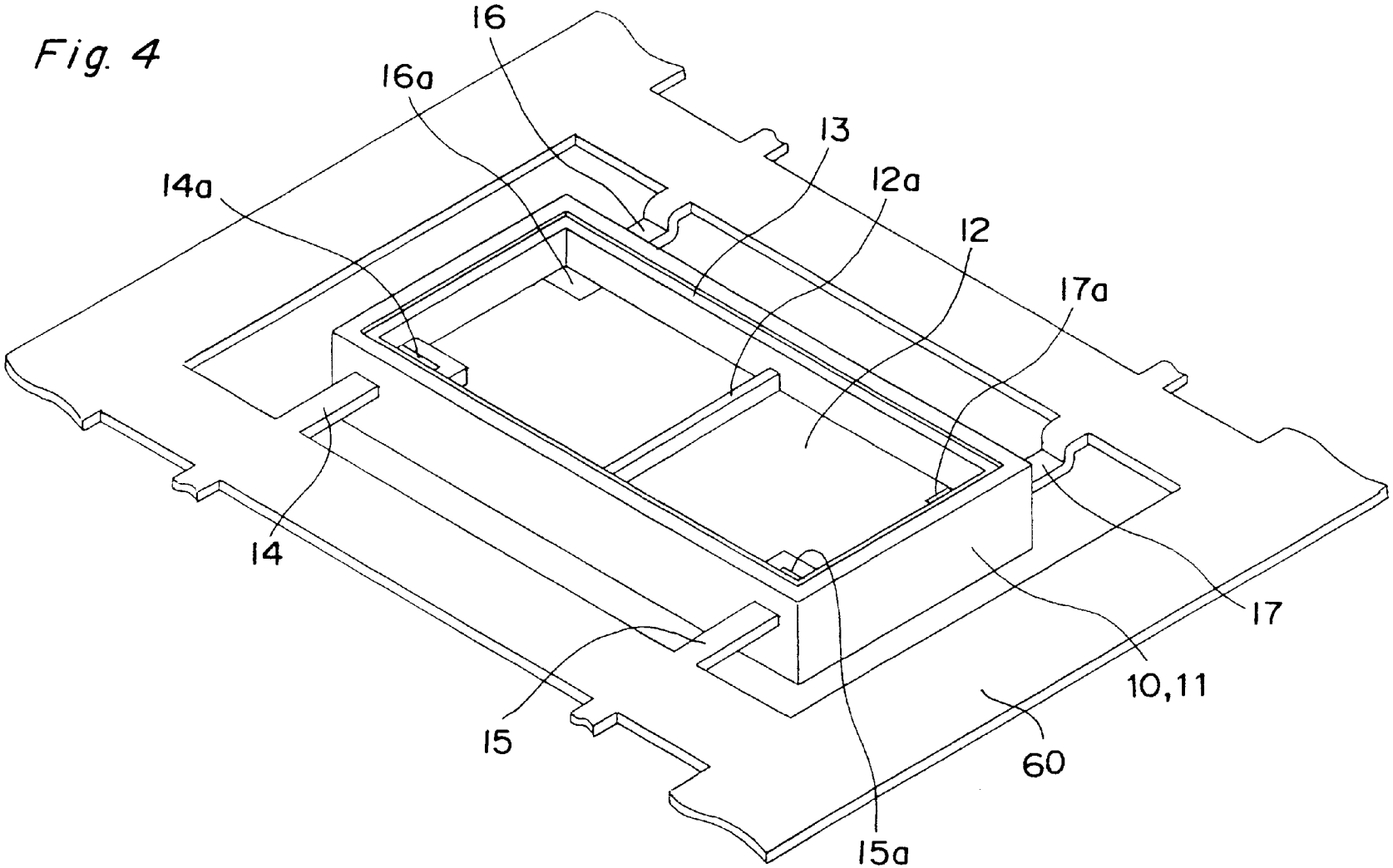
FIG. 4 is a perspective view of the base, showing a state that the lead frame has been insert-molded.
Figure 5:
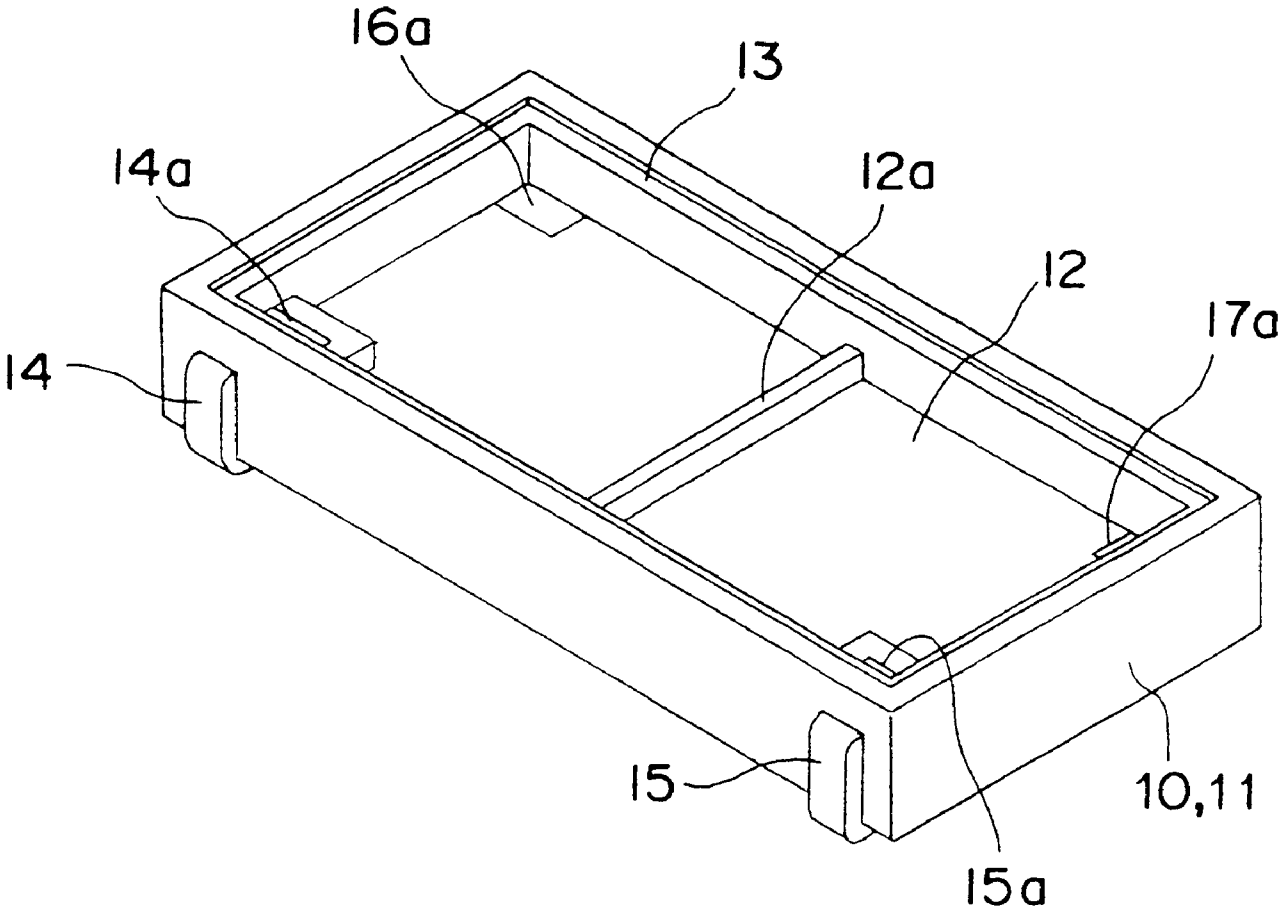
FIG. 5 is a perspective view of the base shown in FIG. 1 in a different angle.
Figure 6:
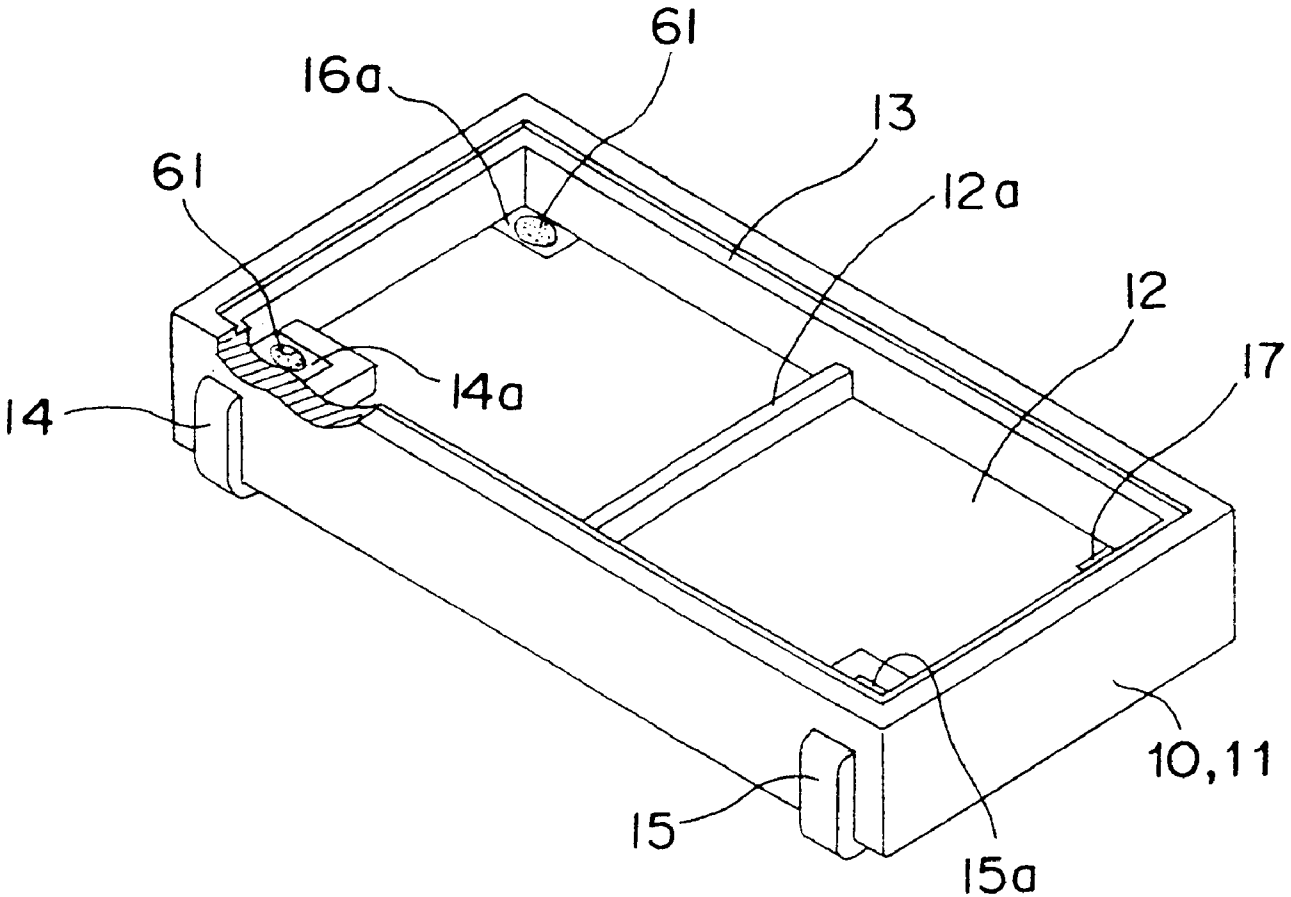
FIG. 6 is a partly broken perspective view showing a state that solder cream has been applied to the base of FIG. 5.

As to the process of insert-molding, as shown in FIGS. 3 to 5, first, press working is performed on a lead frame 60 so that the coil terminals 14, 15 and the contact terminals 16, 17 are stamped out, and besides these contact terminals 16, 17 are bent. Therefore, the connecting end portions 16*a*, 17*a* of the contact terminals 16, 17 are one-step lower than the connecting end portions 14*a*, 15*a* of the coil terminals 14, 15. Then, with the lead frame 60 pinched and held by an unshown die, the box-shaped base body 11 is molded (FIG. 4). Next, the coil terminal 14, 15 and the contact terminals 16, 17 are cut off from the lead frame 60, and their fore end portions are bent to the bottom face of the base body 11, by which the base 10 is completed (FIG. 5). Subsequently, for electrical connection, so-called solder cream 61 that melts at low temperatures is preparatorily applied to the exposed connecting end portions 14*a*, 15*a*, 16*a*, 17*a* (FIG. 6).

The fixed contact unit 20, as shown in FIGS. 1 and 2, comprises a pair of flat core blocks 21, 22 made of electrically conductive magnetic material. The flat core blocks 21, 22 have cutout portions 21*a*, 22*a* formed at their corner portions, respectively, thus each having such a planar shape that the flat core blocks 21, 22 can be dropped and fitted to one-sided halves of the bottom face 12 of the base 11, respectively. Besides, in the flat core blocks 21, 22, top end portions of iron cores 23, 24 which are protrusions formed so as to be protruded upward serve as fixed contacts 23*a*, 24*a*.

In addition, as required, a contact material such as gold or platinum having good electrical conductivity may be provided by plating, vapor deposition, pressure welding, welding, caulking or the like at portions of the fixed contacts 23*a*, 24*a* where the fixed contacts 23*a*, 24*a* contact a later-described movable contactor 43.

Figure 7A:
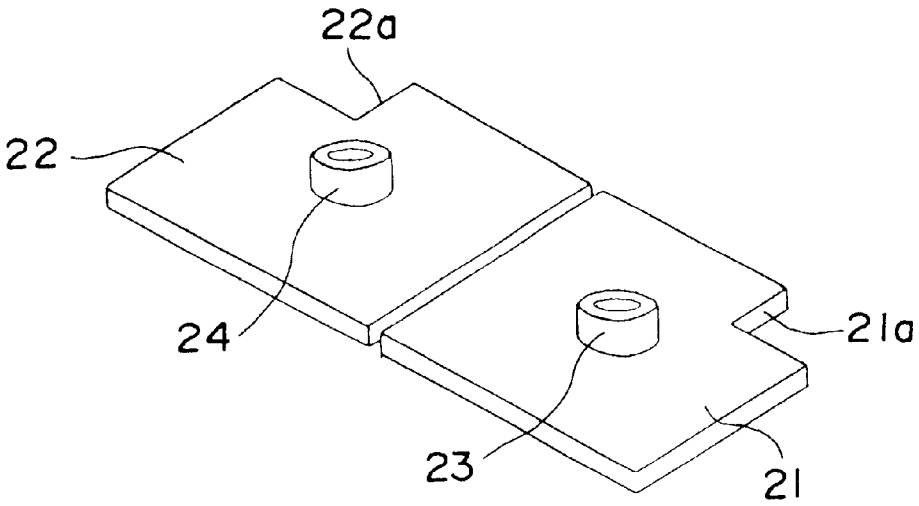
FIG. 7A is a perspective view.
Figure 7B:
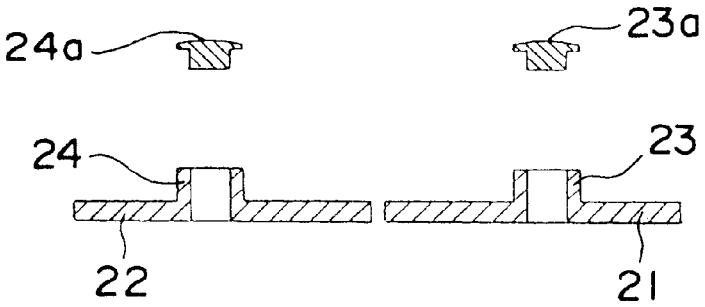
FIG. 7B is a sectional view prior to assembly and FIG. 7C is a sectional view after assembly, showing a flat core block constituting a fixed contact unit.
Figure 7C:
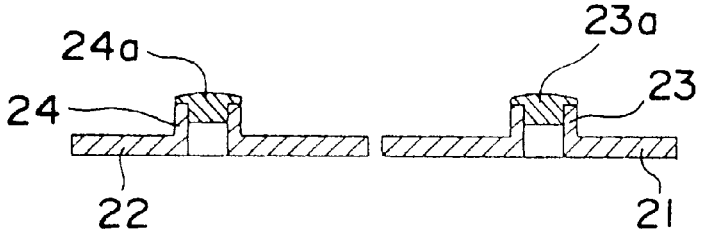

Also, the fixed contacts 23*a*, 24*a* do not necessarily need to be integral with the flat core blocks 21, 22. Alternatively, separately provided fixed contacts 23*a*, 24*a* may be fixed to the flat core blocks 21, 22 by press-fitting, caulking or brazing as shown in FIGS. 7A, 7B and 7C.

Then, the flat core blocks 21, 22 are fitted to the one-sided halves of the bottom face 12 of the base 10, respectively, by which the flat core blocks 21, 22 are juxtaposed in an insulated state on both sides of the linear protrusion 12*a* for insulation use.

Figure 8A:
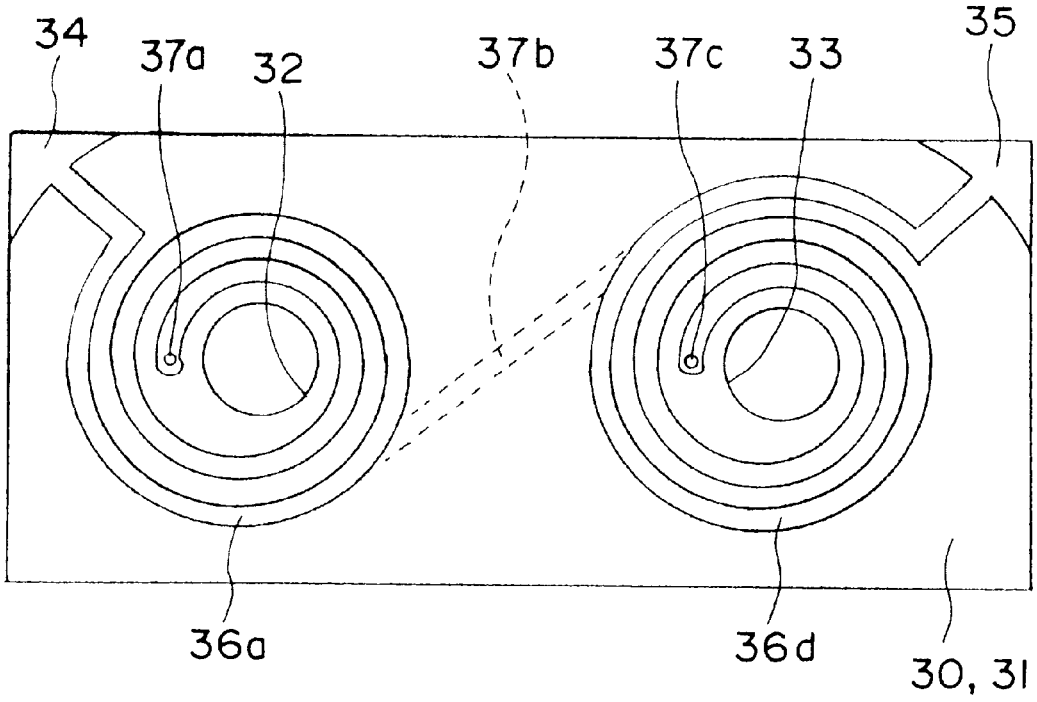
FIG. 8A is a bottom view showing the coil plate of FIG. 1
Figure 8B:
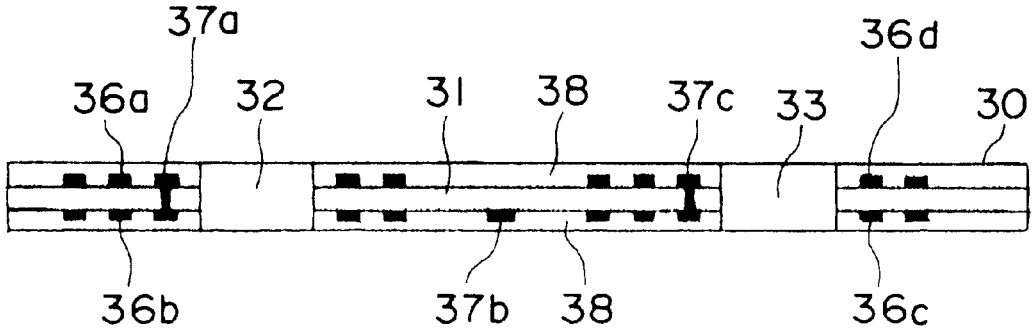
FIG. 8B is a sectional view of the same.

The coil plate 30, as shown in FIGS. 8A and 8B, comprises an insulative substrate 31 having such a planar shape that the insulative substrate 31 can be dropped and fitted to the bottom face 12 of the base body 11. A pair of holes 32, 33 are provided in the center of the insulative substrate 31, while connecting conductors 34, 35 are formed on the undersides of adjacent corner portions.

A flat coil 36*a* extending from the connecting conductor 34 is formed spirally around the hole 32. Besides, an end portion of the flat coil 36*a* is electrically connected to a spiral flat coil 36*b* formed on the front surface of the insulative substrate 31 via a hole 37*a*. Further, an end portion of the flat coil 36*b* extends to a spiral flat coil 36*c* formed on the front surface of the insulative substrate 31 via a printed lead wire 37*b*. In succession, an end portion of the flat coil 36*c* is electrically connected to a spiral flat coil 36*d* formed on the rear surface via a hole 37*c*. Further, this flat coil 36*d* is connected to the connecting conductor 35. It is noted that the flat coil 36*a* and the flat coil 36*d* are formed so as to generate magnetic fields of mutually opposite directions. This is the case also with the flat coil 36*b* and the flat coil 36*c*.

Further, the front and rear surfaces of the coil plate 30 are coated with an insulating film 38 except the portions occupied by the connecting conductors 34, 35.

In addition, the process for forming the connecting conductors 34, 35, the flat coils 36*a*–36*d* and the lead wire 37*b* is not particularly limited but may be optionally selected from among existing processes such as printing, vapor deposition, metallizing and etching.

Also, the number of turns of the flat coils can be selected as required, and is not limited to that shown in the figure.

Then, the coil plate 30 is fitted to the bottom face 12 of the base 10, and positioned so that its connecting conductors 34, 35 come into contact with the connecting end portions 14*a*, 15*a* of the coil terminals 14, 15, respectively. Further, the holes 32, 33 of the coil plate 30 are fitted to the iron cores 23, 24 of the flat core blocks 21, 22, by which the fixed contacts 23*a*, 24*a* are projected slightly from the top of the coil plate 30 (FIG. 2).

Subsequently, the base 10, into which the flat core blocks 21, 22 and the coil plate 30 have been incorporated, is put into a heating furnace and heated, so that the preparatorily applied solder cream 61 is melted down. As a result, the coil terminals 14, 15 and the coil plate 30 are electrically connected to each other, while the contact terminals 16, 17 and the flat core blocks 21, 22 are electrically connected to each other.

In addition, the above coil plate 30 has been described on a case where flat coils are formed on the front and rear surfaces of the insulative substrate 31, but this is not limitative. Otherwise, for example, flat coils may be formed only on one surface of the insulative substrate 31, or two insulative substrates each of which has flat coils formed on one surface may be laminated together to form the coil plate 30. Besides, flat coils and insulative films may be stacked alternately on the same plane into a plurality of layers.

The movable contact plate 40 is a thin plate made of an electrically conductive magnetic material having such a planar shape that the thin plate can be fitted to the annular step portion 13 of the base body 11. Then, a slit 41 having a C-like planar shape is formed by press working, etching or the like, so that a hinge portion 42 is formed while a movable contactor 43 and an annular support member 44 are partitioned from each other. Therefore, the movable contactor 43 is supported so as to be pivotable in the direction of plate thickness on a fulcrum of the hinge portion 42.

In addition, as required, a contact material such as gold or platinum having good electrical conductivity may be provided by plating, vapor deposition, pressure welding, welding, caulking, brazing or the like at at least portions of the top surface of the movable contactor 43 where the movable contactor 43 makes contact with the fixed contacts 23*a*, 24*a*, and moreover protrusions that can be inserted into the holes 32, 33 may be provided.

Then, the movable contact plate 40 is fitted to the annular step portion 13 of the base 10, by which the movable contactor 43 is contactably and separably opposed to the fixed contacts 23*a*, 24*a* of the fixed contact unit 20 with a specified contact gap retained.

In addition, the movable contact plate 40, without being limited to the aforementioned one, may be so arranged that the hinge portion 42 is made thin (FIG. 9A), making the movable contactor 43 pivotable with a small external force, so that a high-sensitivity relay can be obtained.

Figure 9A:
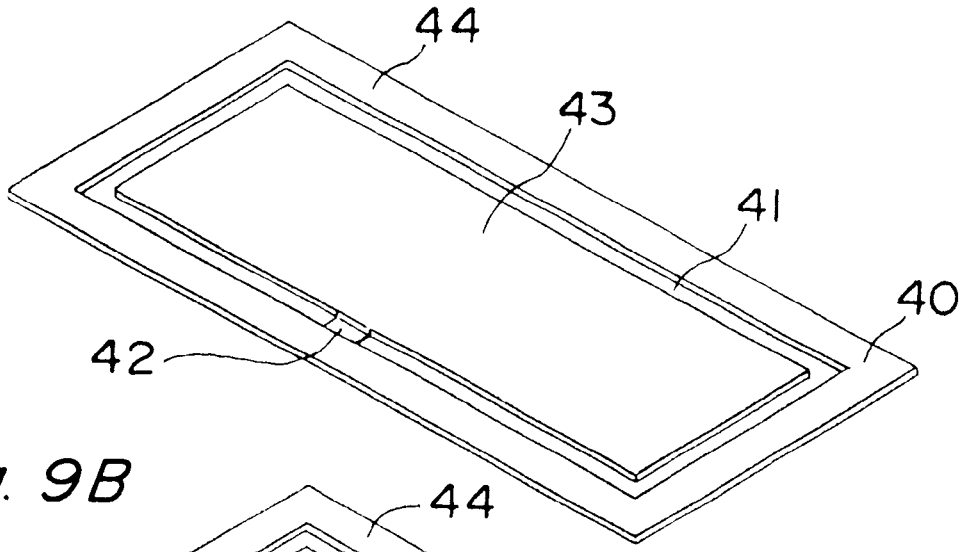
FIGS. 9A, 9B and 9C are perspective views showing application examples of the movable contact plate.
Figure 9B:
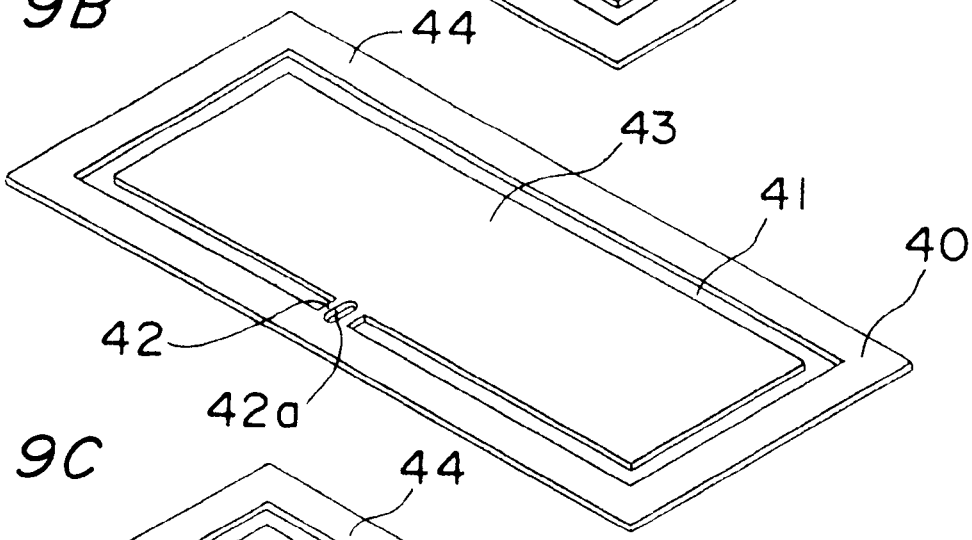
Figure 9C:
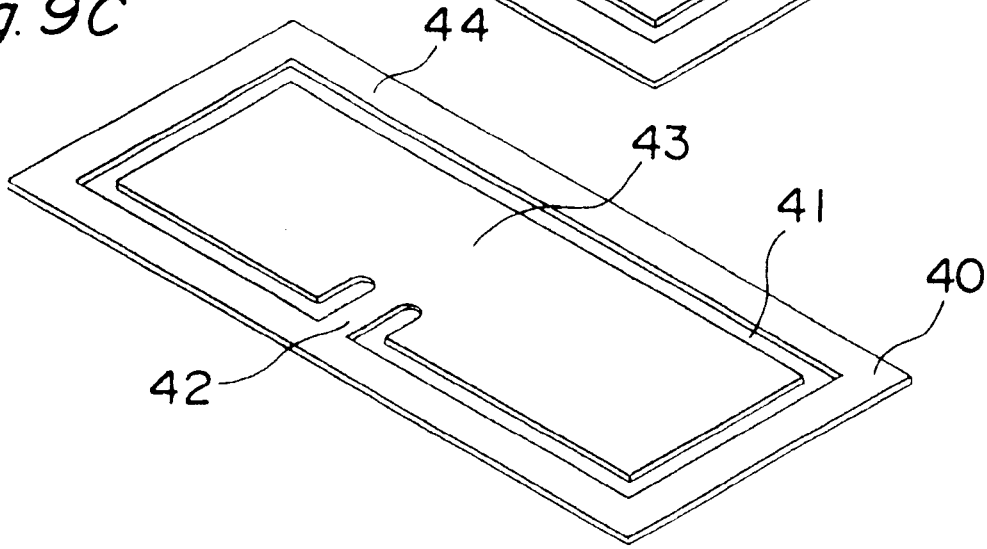

Similarly, in the movable contact plate 40, for example, an elongate hole 42*a* may be provided at the hinge portion 42 as shown in FIG. 9B, or the hinge portion 42 itself may be elongated as shown in FIG. 9C.

Figure 10A:
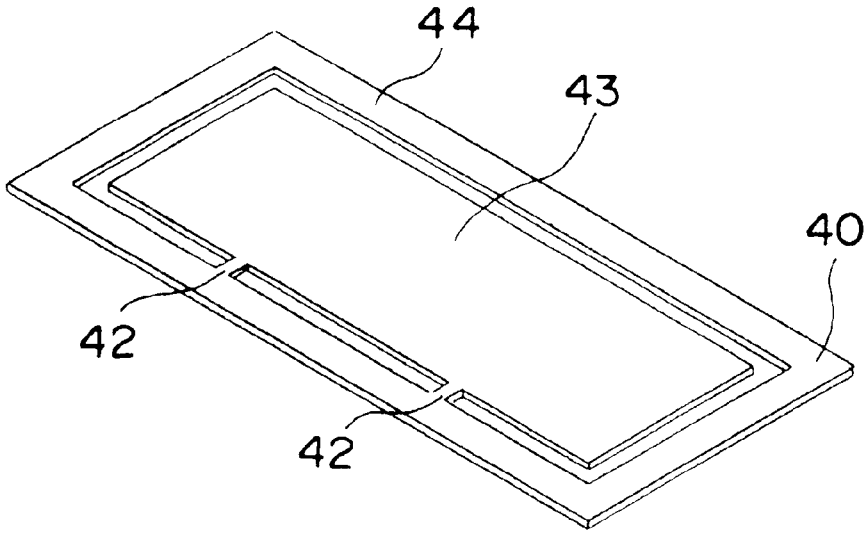
FIGS. 10A and 10B are perspective views showing application examples of the movable contact plate.

Further, the movable contactor 43 may have two juxtaposed hinge portions 42 provided as shown in FIG. 10A, so that the movable contactor 43 is pivotably supported. According to this embodiment, the movable contactor 43 never twists around the hinge portions 42 as would occur in the case of one hinge portion 42. Therefore, so-called chattering can be prevented and one-side hitting can be prevented, as an advantage.

Figure 10B:
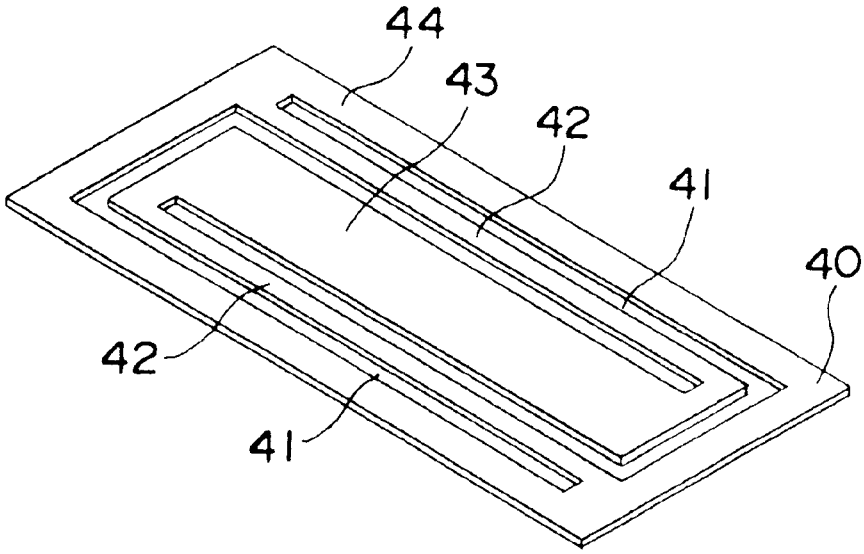

It is also possible that, as shown in FIG. 10B, generally U-shaped, discontinuous two slits 41, 41 are provided and a pair of crank-like hinge portions 42, 42 extending inward from the annular support member 44 are formed, so that the movable contactor 43 is supported by these hinge portions 42, 42. According to this embodiment, the movable contactor 43 moves parallel to the plate-thickness direction, thus free from one-side hitting on the fixed contacts 23*a*, 24*a*. Also, because the hinge portion 42 is long, the amount of deformation per unit length becomes small so that fatigue failure is unlikely to occur, as an advantage.

Furthermore, when the movable contactor 43 cannot be pivoted at a desired operating speed due to the resistance of sealed internal gas, for example, one or more holes (not shown) for air ventilation may be provided in the movable contactor 43.

The support member 44 may be thicker than the hinge portion 42 and the movable contactor 43 in order to secure the driving space for the movable contactor 43. According to this arrangement, since the movable contact plate 40 can be placed in position directly on the coil plate 30, accuracy of the assembling becomes high.

It is further possible that a set of hinge portions are arranged in line or two sets of hinge portions are arranged crosswise so that the movable contactor 43 is supported at its both ends and displaced in the direction of plate thickness. According to this embodiment, malfunctions due to external vibrations or the like can be prevented so that a high-reliability relay can be obtained, as an advantage.

The insulative cover 50, as shown in FIG. 2, is a resin molded product having such a planar shape that the insulative cover can cover the base 10, to which the fixed contact unit 20, the coil plate 30 and the movable contact plate 40 have been assembled. However, without being limited to this, the insulative cover 50 may be integrally molded to the base 10 by injection of epoxy resin or the like or by low pressure molding.

In addition, the base 10 and the insulative cover 50 may also be formed from a resin of polyethersulfone or the like, and integrally joined together by the process of hot pressure welding, ultrasonic welding, solvent bonding or the like so that a closed structure is formed.

Also, when the base body 11 and the insulative cover 50 are formed from ceramic or glass, a firmer closed structure with anode junction is enabled. With such a closed structure, corrosive gas, foreign matters and the like can be prevented from invasion from outside.

Further, inside of the closed space may be made high vacuum or highly insulative gas (e.g., sulfur hexafluoride gas) or fluid may be filled and sealed, in order that the insulation performance is improved.

Next, operation of the relay constituted as described above is explained.

First, in the case where no voltage is applied to the coil terminals 14, 15 with the flat coils 36*a*–36*d* of the coil plate 30 out of excitation, the movable contactor 43 and the fixed contacts 23*a*, 24*a* are opposed to each other with a specified contact gap retained therebetween, where the contact terminals 16, 17 are in the open state.

Then, when voltage is applied to the coil terminals 14, 15 to excite the flat coils 36*a*–36*d*, there occur magnetic fluxes of mutually opposite directions along the axes of the iron cores 23, 24 of the flat core blocks 21, 22. Therefore, magnetic flux flows through a closed magnetic circuit formed by the iron core 23, the movable contactor 43 and the iron core 24 as shown in FIG. 2. As a result, the movable contactor 43 is attracted to the iron cores 23, 24 of the flat core blocks 21, 22 against the spring force of the hinge portion 42 of the movable contact plate 40, thus coming into contact with the fixed contacts 23*a*, 24*a* and closing an electric circuit.

Accordingly, the electric circuit is formed up by the contact terminal 16, the connecting end portion 16*a*, the flat core block 21, the fixed contact 23*a*, the movable contactor 43, the fixed contact 24*a*, the flat core block 22, the connecting end portion 17*a* and the contact terminal 17.

Then, with the flat coils 36*a*–36*d* de-excited, the magnetic flux is dissipated and the movable contactor 43 is restored to the original state by the spring force of the hinge portion 42. Therefore, the movable contactor 43 is opened and separated from the fixed contacts 23*a*, 24*a* so that the electric circuit is opened.

Figure 11:
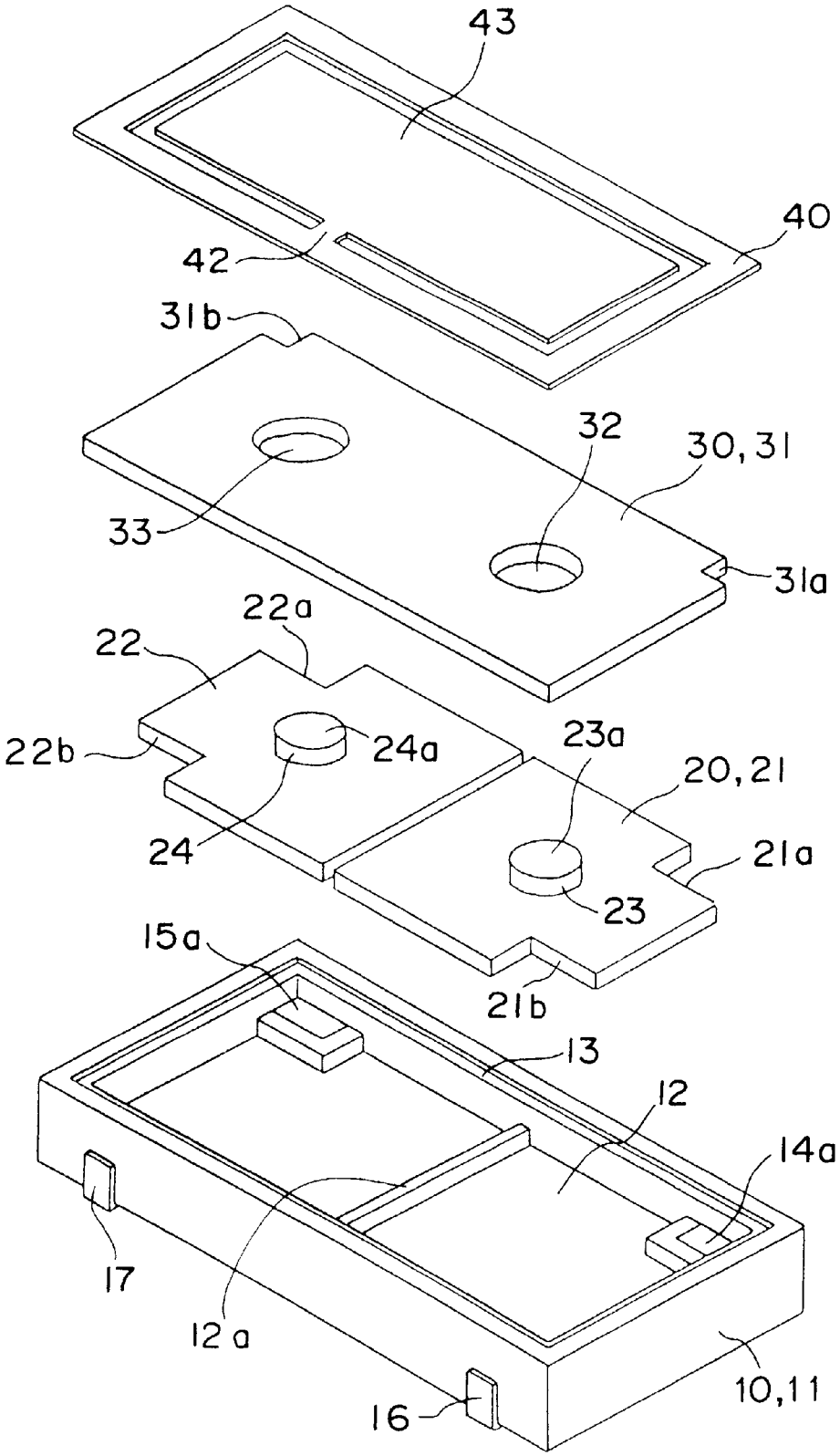
FIG. 11 is an exploded perspective view showing a relay according to a second embodiment of the present invention.
Figure 12:
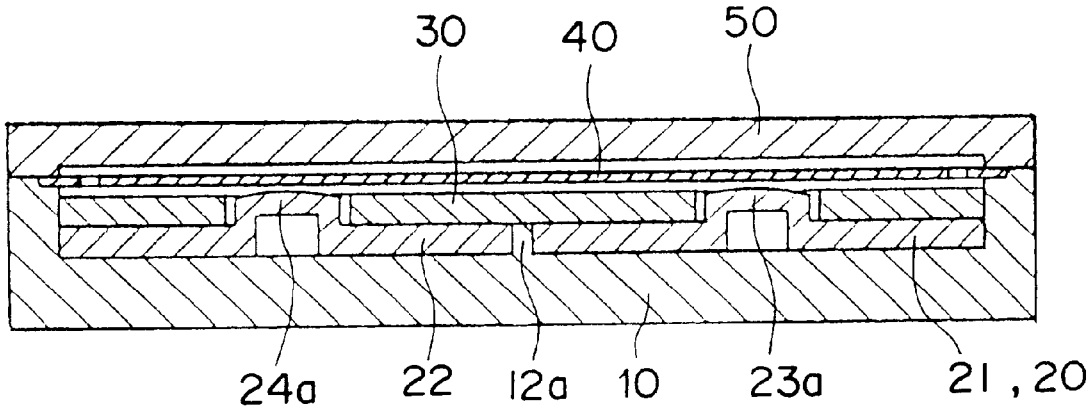
FIG. 12 is a sectional view of the relay shown in FIG. 11.
Figure 13:
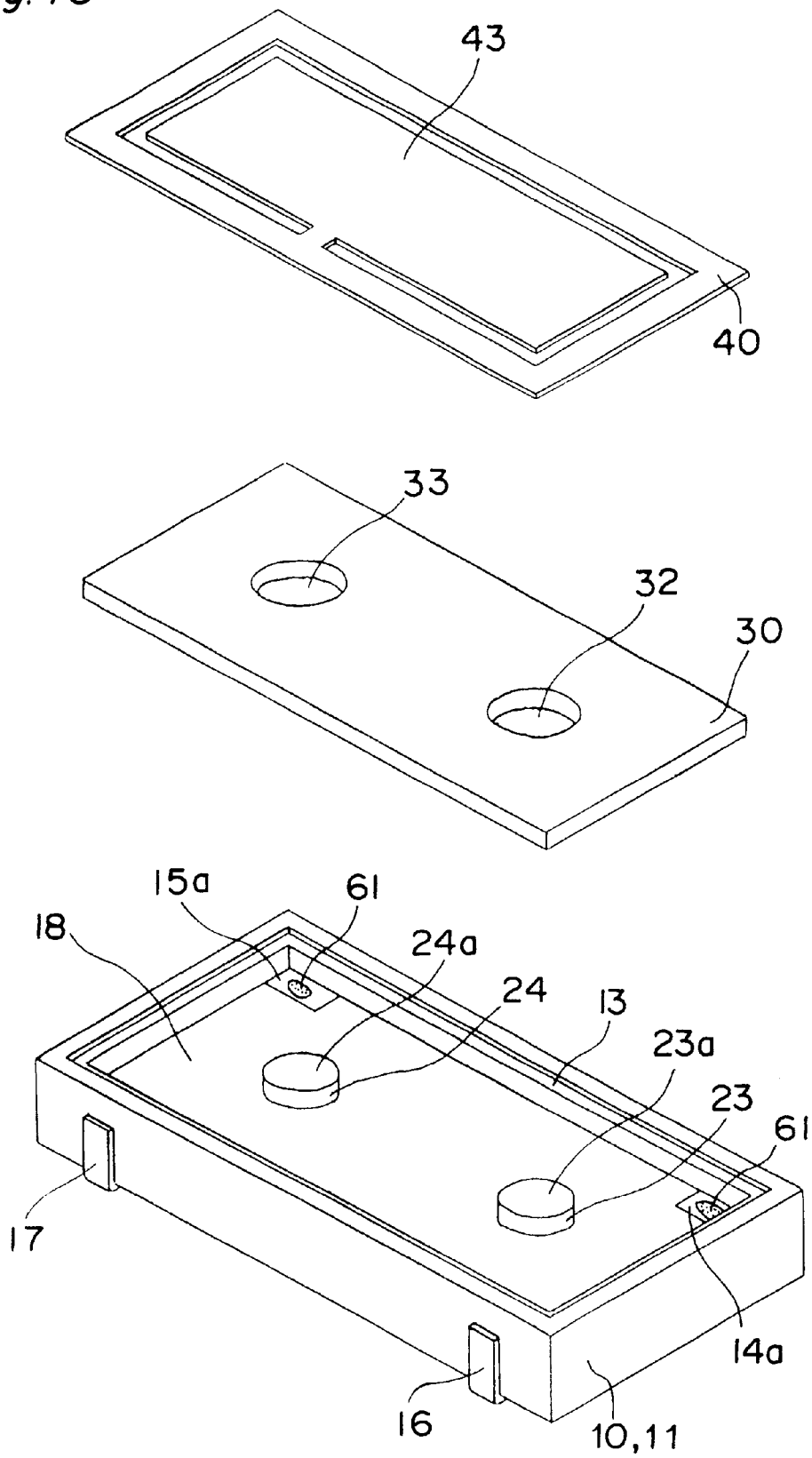
FIG. 13 is an exploded perspective view showing a relay according to a third embodiment of the present invention.
Figure 14:
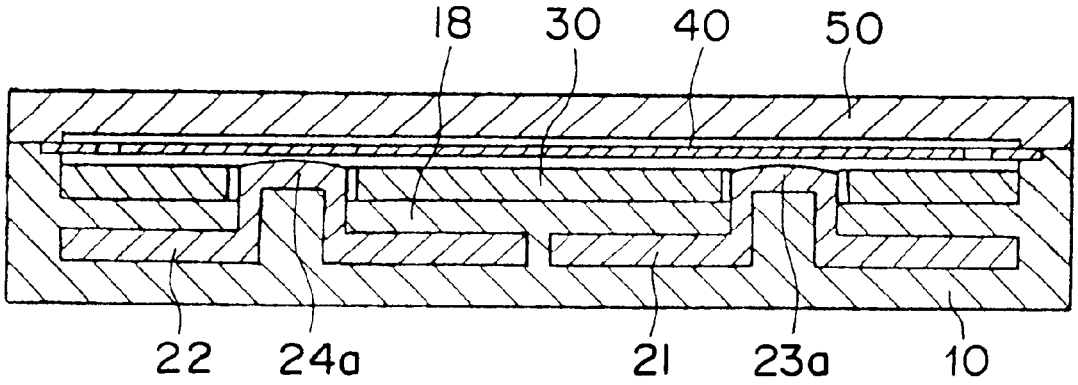
FIG. 14 is a sectional view of the relay shown in FIG. 13.
Figure 15:
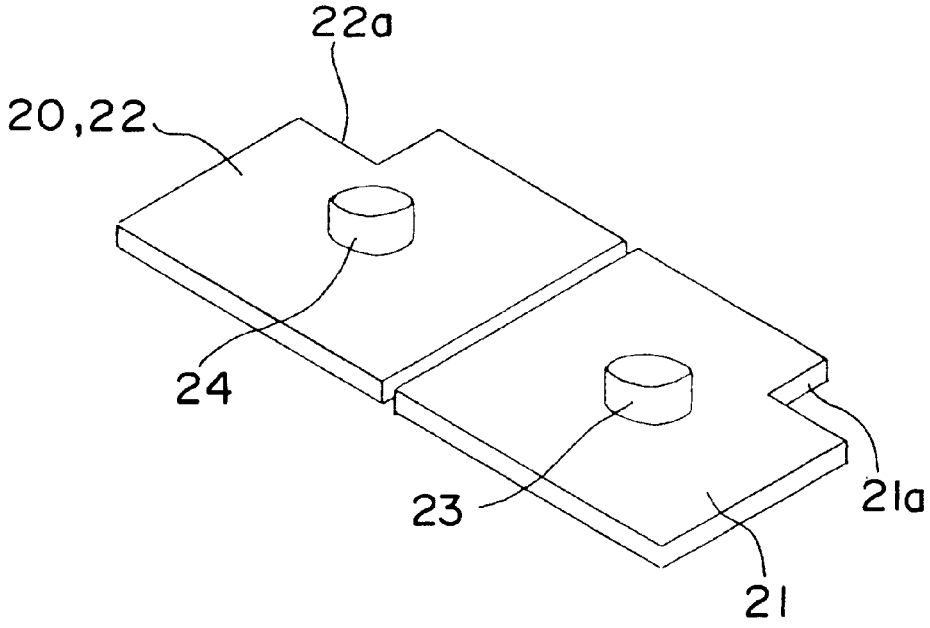
FIG. 15 is a perspective view showing flat core blocks of the base shown in FIG. 13.
Figure 16:
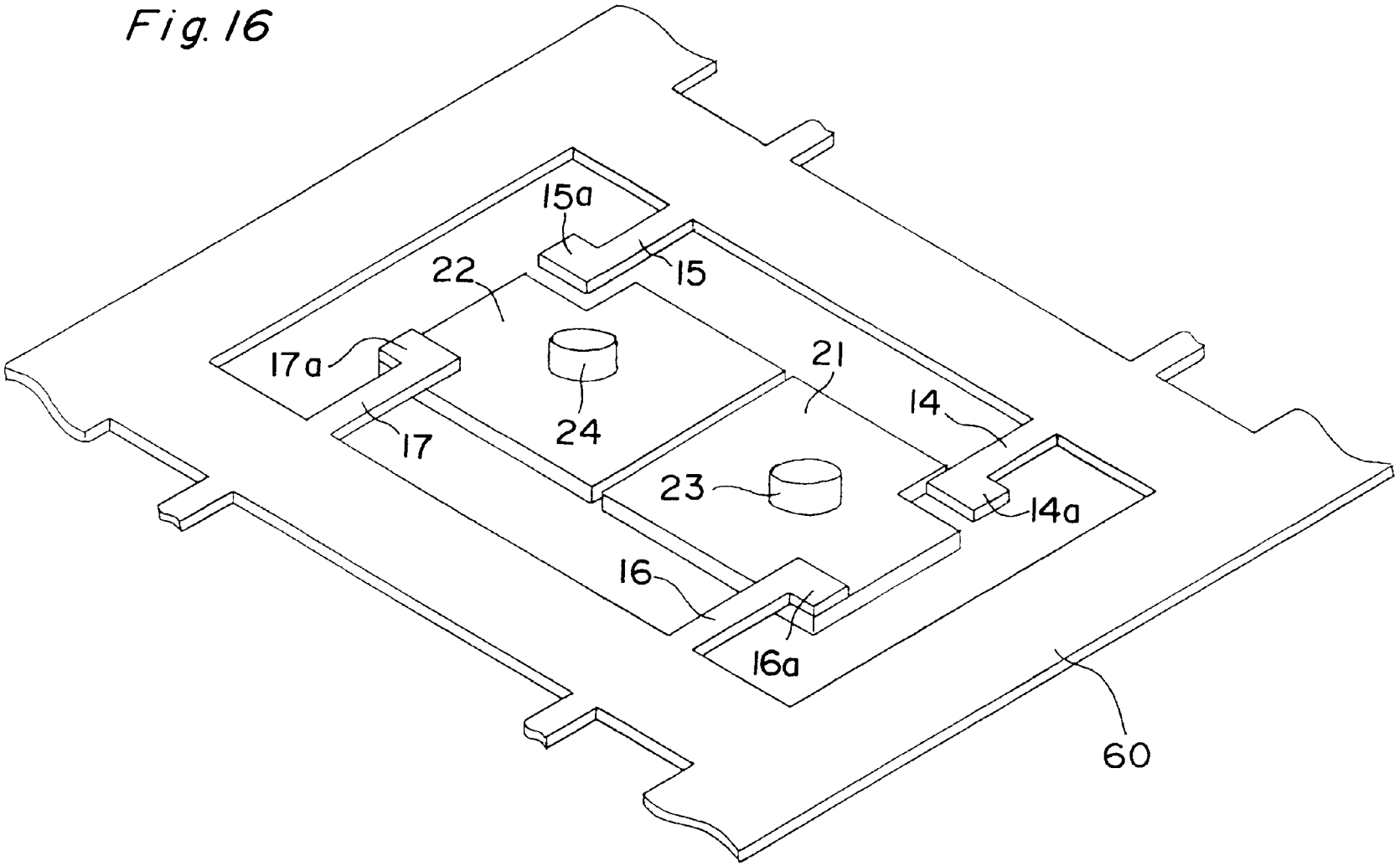
FIG. 16 is a perspective view showing a state that a pair of flat core blocks are positioned to the lead frame.

A second embodiment is generally similar to the first embodiment as shown in FIGS. 11 and 12. Differences exist in the connecting structure between the contact terminals 16, 17 and the flat core blocks 21, 22, and in the connecting structure between the coil terminals 14, 15 and the coil plate 30.

More specifically, the connecting end portions 16*a*, 17*a* of the contact terminals 16, 17 are exposed flush with the bottom face 12 of the base 10. Also, the connecting end portions 14*a*, 15*a* of the coil terminals 14, 15 are exposed from a position one-step higher than the connecting end portions 16*a*, 17*a* of the contact terminals 16, 17.

Meanwhile, cutout portions 21*a*, 21*b* and 22*a*, 22*b* for connection use are formed at adjacent corner portions in the flat core blocks 21, 22, respectively. Also, in the coil plate, connecting conductors (not shown) are formed at cutout portions 31*a*, 31*b* provided at adjacent corner portions.

Therefore, after a pair of flat core blocks 21, 22 are incorporated into the bottom face 12 of the base 10, the cutout portions 21*b*, 22*b* of the flat core blocks 21, 22 are electrically connected to the connecting end portions 16*a*, 17*a* of the contact terminals 16, 17 with solder. Then, the coil plate 30 is incorporated into the base 10, and the connecting conductors of the coil plate 30 are electrically connected to the connecting end portions 14*a*, 15*a* of the coil terminals 14, 15 with solder. The rest of this embodiment is the same as in the foregoing embodiment and description is omitted.

A third embodiment, as shown in FIGS. 13 to 18, is a case where the flat core blocks 21, 22 are preparatorily integrally molded with the base 10, whereas the flat core blocks 21, 22 are afterwards assembled to the base 10 in the foregoing embodiment.

For integral molding of the base 10 and the flat core blocks 21, 22, for example as shown in FIGS. 15 to 18, first, press working is performed on a lead frame 60 so that coil terminals 14, 15 and contact terminals 16, 17 are stamped out. When this is done, connecting end portions 16*a*, 17*a* of the contact terminals 16, 17 are positioned flush with connecting end portions 14*a*, 15*a* of the coil terminals 14, 15.

Figure 17:
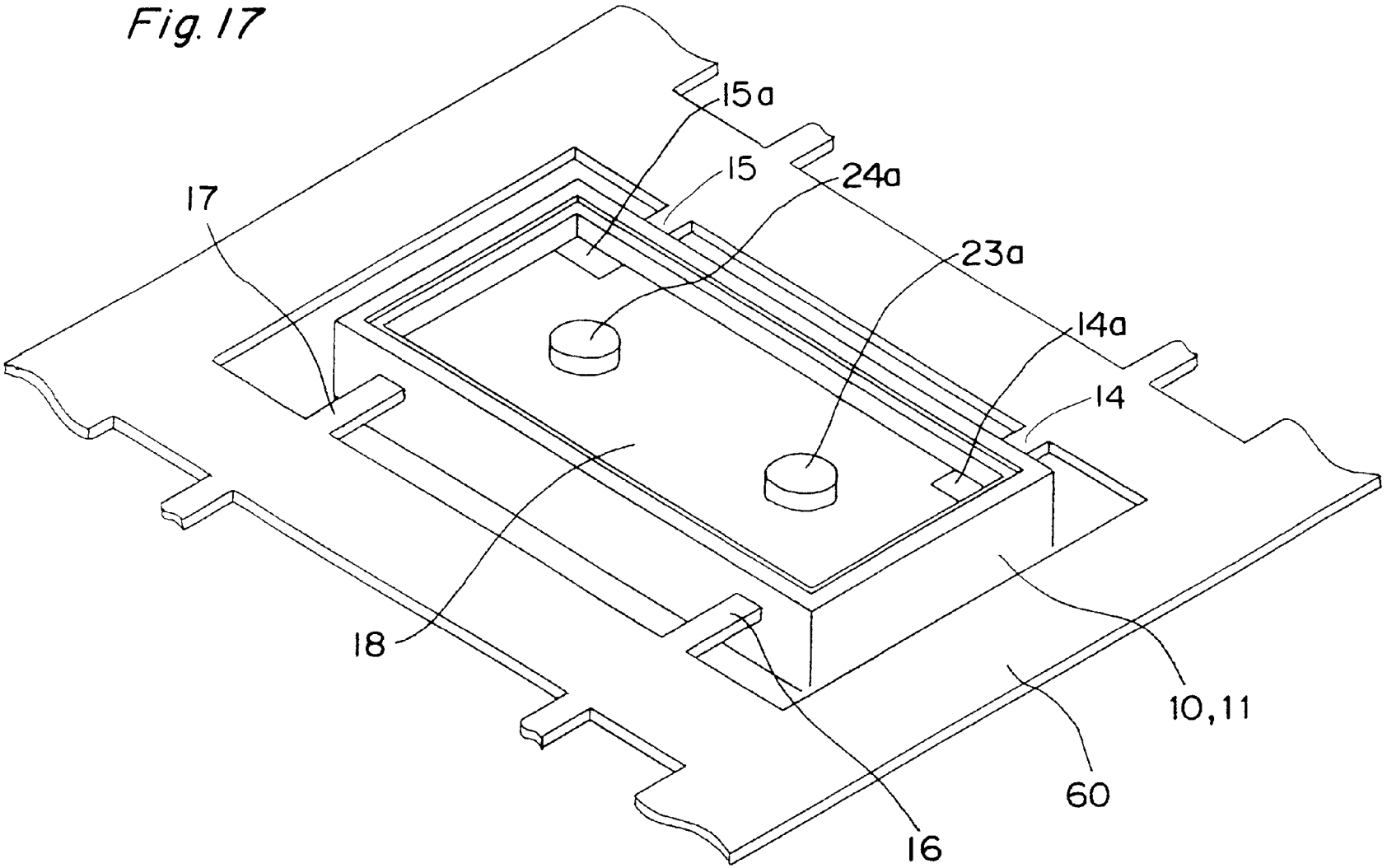
FIG. 17 is a perspective view of the base showing a state that the lead frame has been insert-molded.
Figure 18:
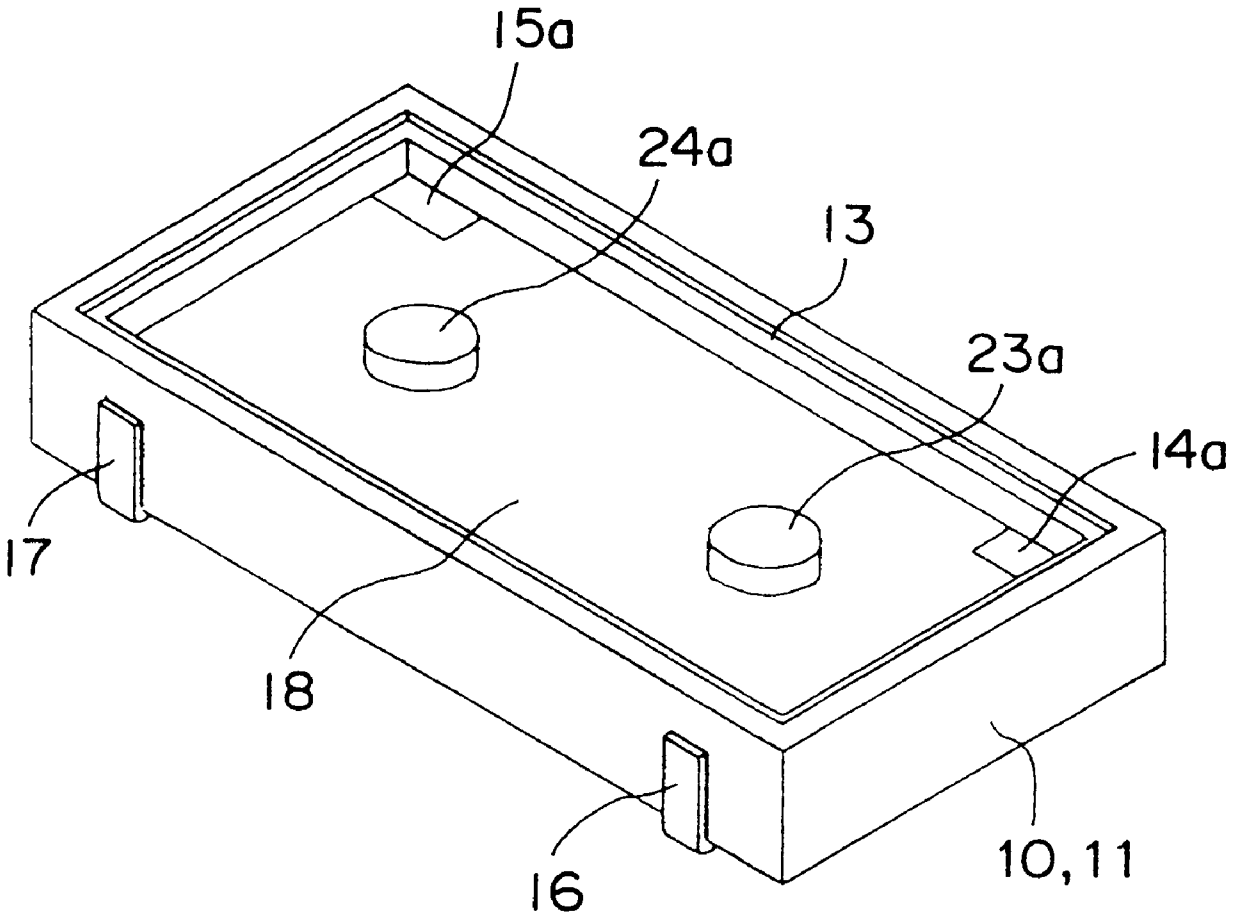
FIG. 18 is a perspective view of the base shown in FIG. 13.

Then, a pair of juxtaposed flat core blocks 21, 22 are positioned to the lead frame 60 (FIG. 16), and the flat core blocks 21, 22 are fused and integrated to the connecting end portions 16*a*, 17*a* of the contact terminals 16, 17, respectively. Then, with the lead frame 60 pinched and held by an unshown die, a box-shaped base body 11 is integrally molded (FIG. 17). Subsequently, the coil terminal 14, 15 and the contact terminals 16, 17 are cut off from the lead frame 60, and their fore end portions are bent to the bottom face of the base body 11, by which the base 10 is completed. The rest of the embodiment is nearly the same as in the foregoing embodiment and description is omitted.

The flat core blocks 21, 22 integrally molded with the base 10 are coated with a synthetic resin film 18 except portions occupied by the fixed contacts 23*a*, 24*a*. Then, solder cream (not shown) that will melt at low temperatures is applied to the exposed connecting end portions 14*a*, 15*a* in preparation for electrical connection.

According to this embodiment, the number of component parts in the assembly line is reduced, the number of assembling man-hours is reduced and the productivity is improved. Also, because the juxtaposed flat core blocks 21, 22 are coated with the synthetic resin film 18, the insulation characteristic is improved as an advantage.

Figure 19:
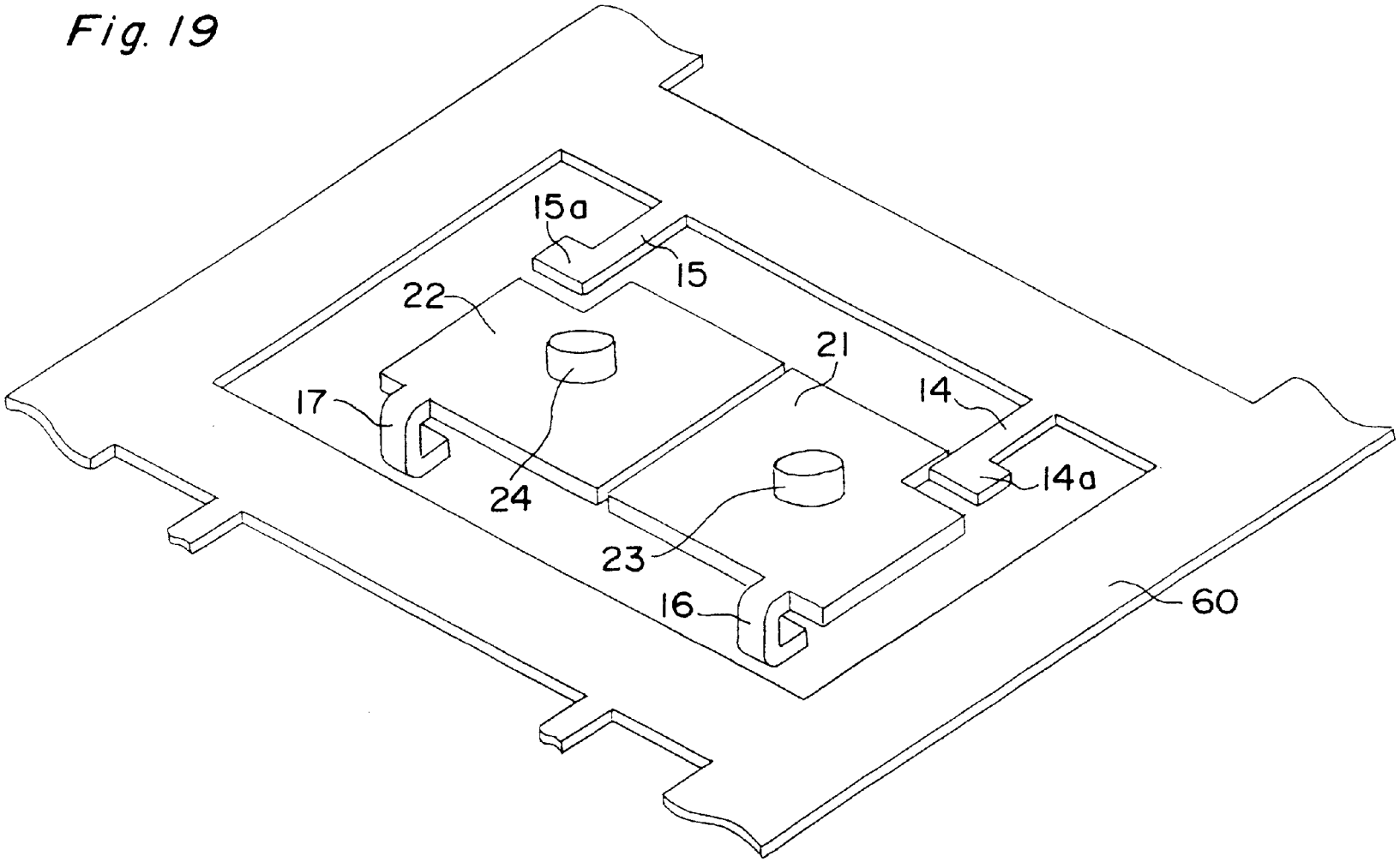
FIG. 19 is a perspective view showing a method for insert-molding a lead frame to a base of a relay according to a fourth embodiment of the present invention.
Figure 20:
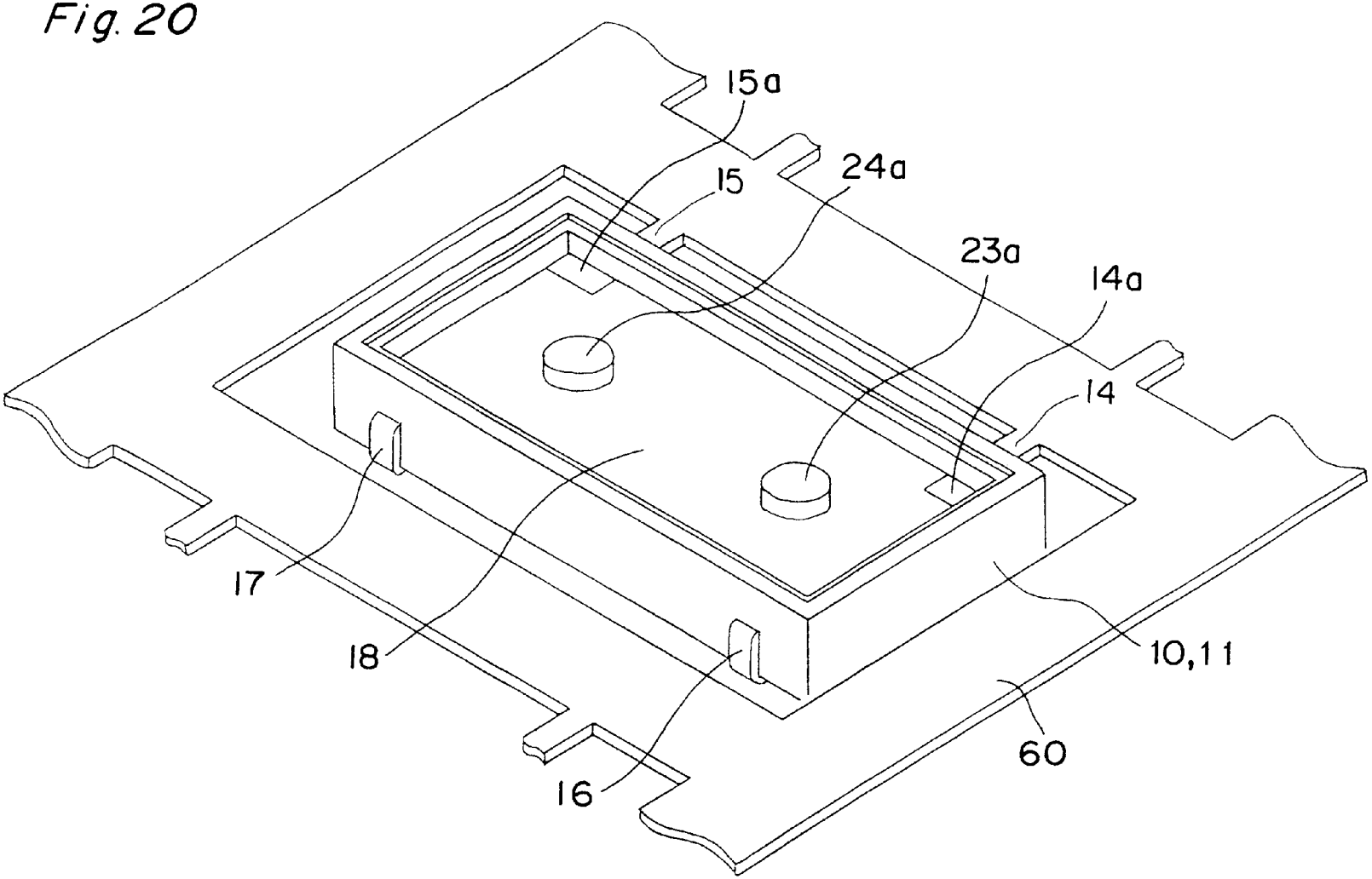
FIG. 20 is a perspective view showing a state that the base has been integrally molded with the lead frame.

A fourth embodiment, according to FIGS. 19 and 20, is a case where the contact terminals 16, 17 are extended from the flat core blocks 21, 22, respectively, and bent, whereas the third embodiment is a case where all the terminals are cut out of the lead frame 60.

More specifically, press working is performed on a lead frame 60 so that coil terminals 14, 15 are stamped out. Then, flat core blocks 21, 22 from which the bending contact terminals 16, 17 are extended are juxtaposed in an insulated state, and positioned to the lead frame 60 (FIG. 19). Subsequently, with the lead frame 60 pinched and held by an unshown die, a box-shaped base body 11 is integrally molded (FIG. 20). Further, the coil terminals 14, 15 are cut off from the lead frame 60, and their fore end portions are bent to the bottom face of the base body 11, by which the base 10 is completed. The flat core blocks 21, 22 integrally molded with the base 10 are coated with a synthetic resin film 18 except portions occupied by fixed contacts 23*a*, 24*a*. The rest of the embodiment is the same as in the foregoing embodiment and description is omitted.

Figure 21:
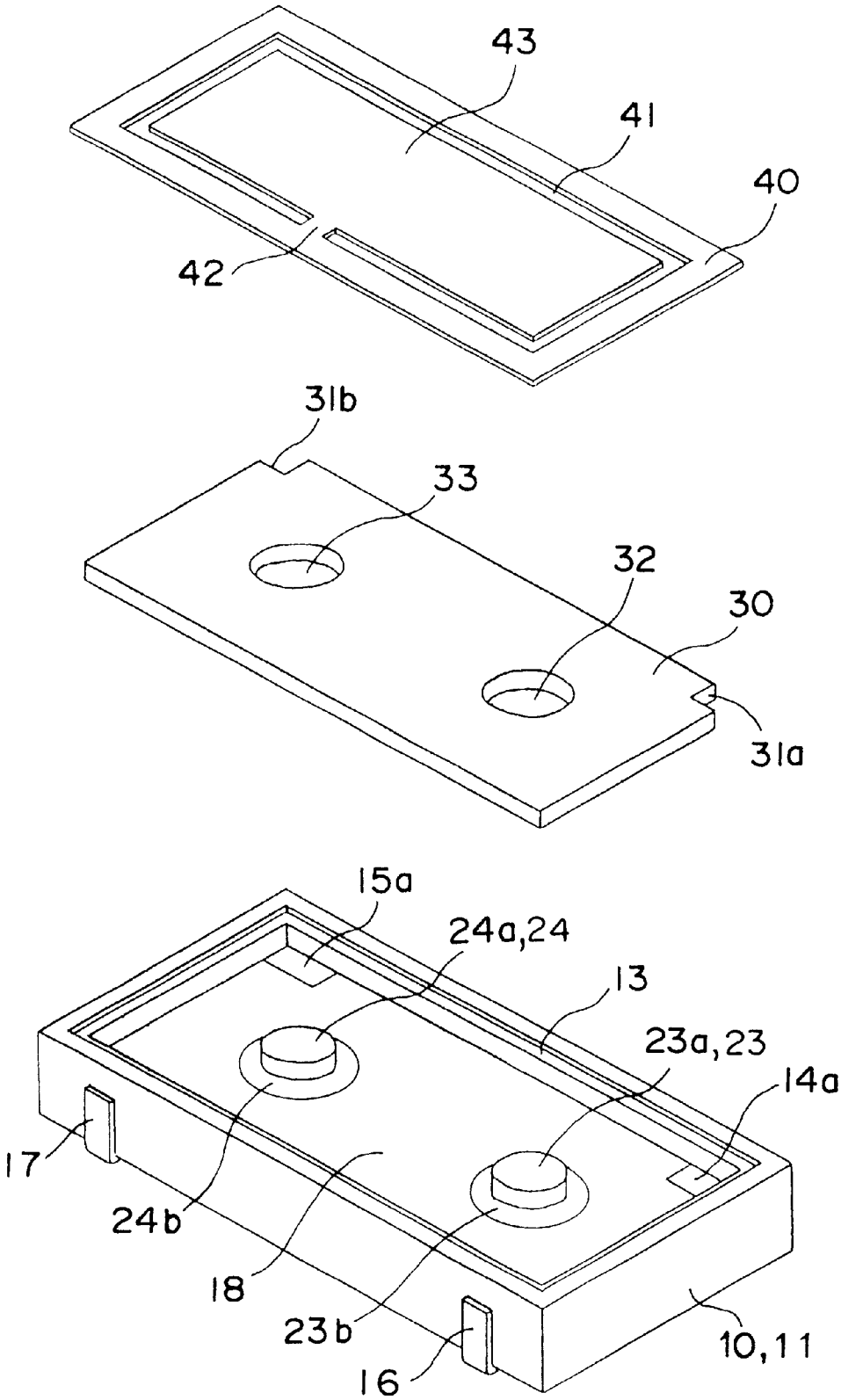
FIG. 21 is an exploded perspective view showing a relay according to a fifth embodiment.
Figure 22:
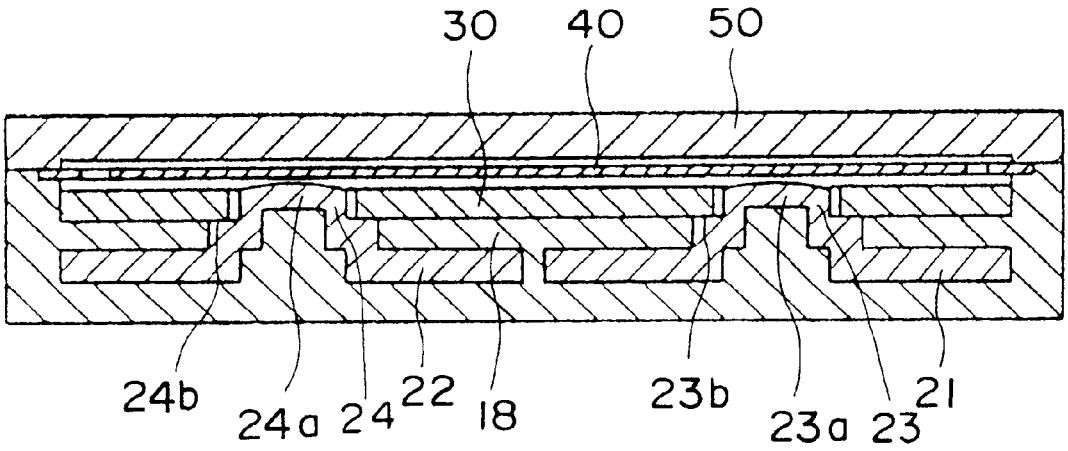
FIG. 22 is a sectional view of the relay shown in FIG. 21.

A fifth embodiment, as shown in FIGS. 21 and 22, is a case where step portions 23*b*, 24*b* are integrally molded with base portions of the iron cores 23, 24 so as to be exposed.

According to this embodiment, the flat core blocks 21, 22 can be integrally molded with the step portions 23*b*, 24*b* taken as a reference plane, thus offering an advantage that a high positioning accuracy of the flat core blocks 21, 22 relative to each other in their thicknesswise direction can be obtained.

Figure 23:
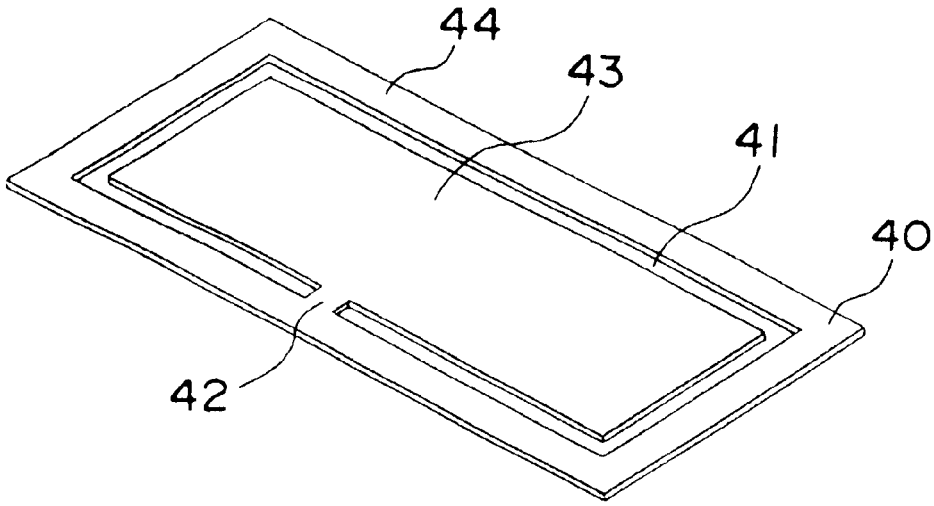
FIG. 23 is an exploded perspective view of a relay according to a sixth embodiment.
Figure 23:
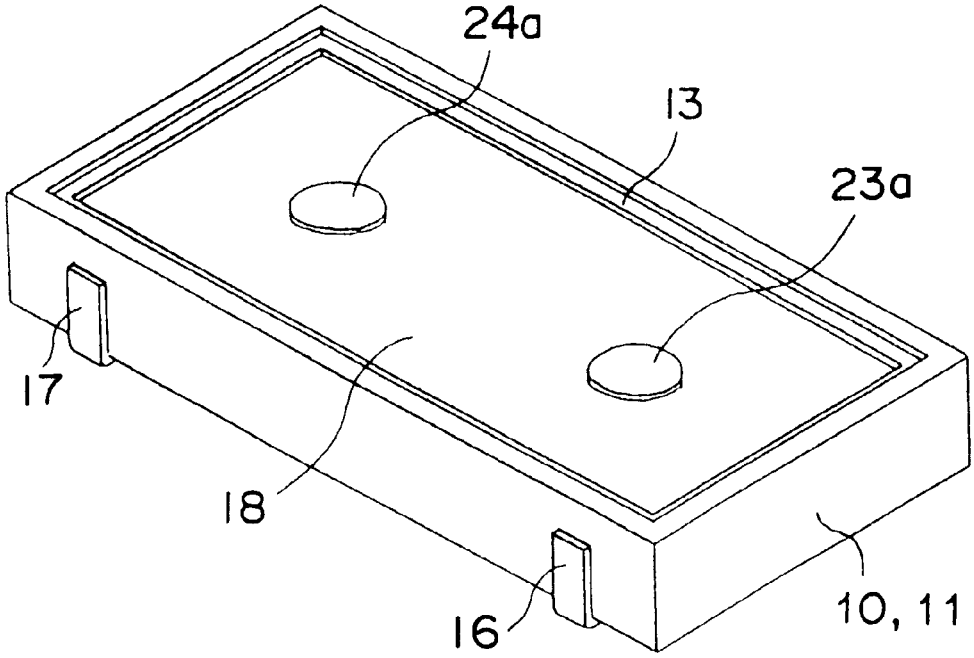
Figure 24:
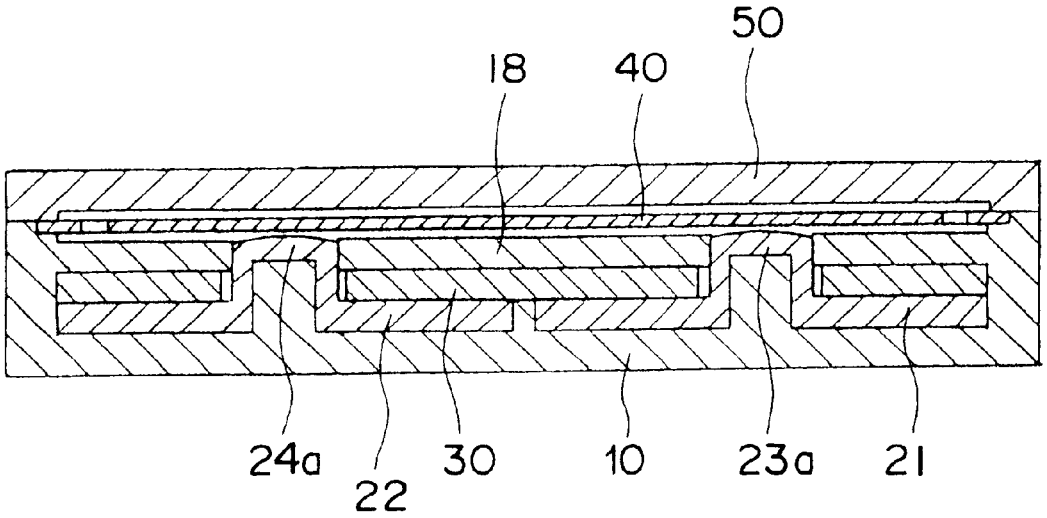
FIG. 24 is a sectional view of the relay shown in FIG. 23.

A sixth embodiment, as shown in FIGS. 23 and 24, is a case where the coil plate 30 is integrally molded with the base 10, whereas the foregoing embodiment is a case where a separately provided coil plate 30 is afterwards assembled to the base 10.

Figure 25:
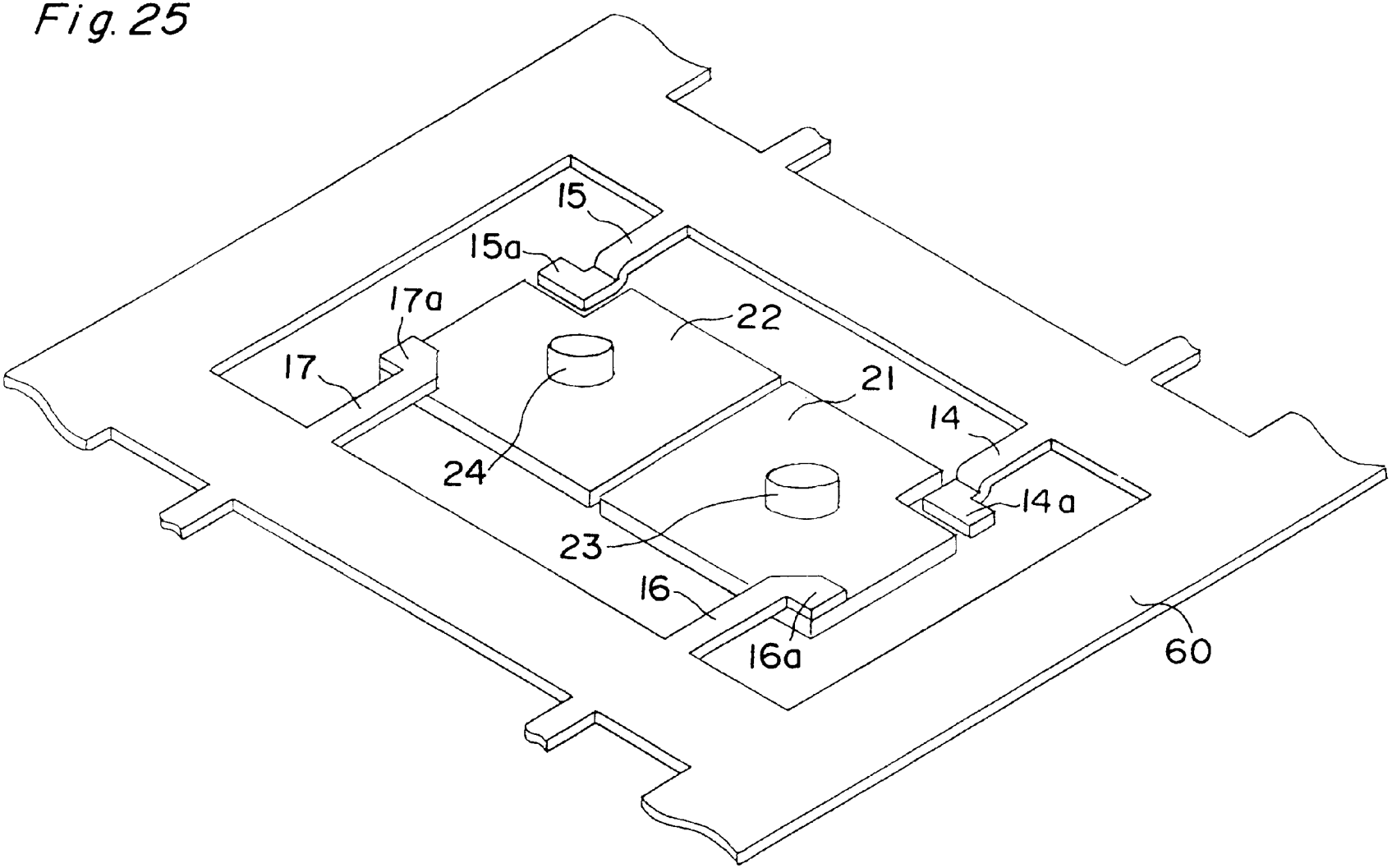
FIG. 25 is a perspective view showing a method for molding the base shown in FIG. 23.
Figure 26:
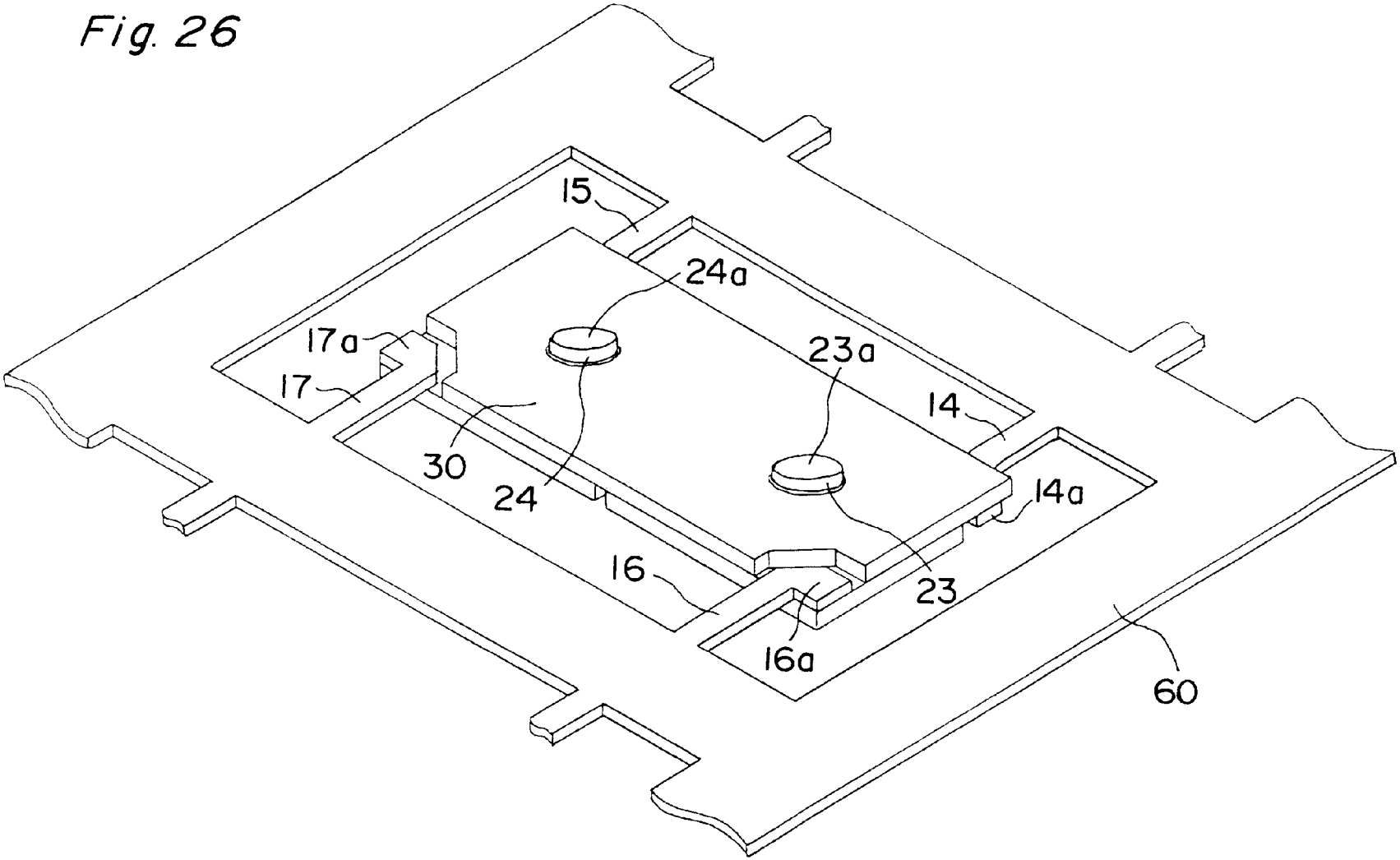
FIG. 26 is a perspective view showing a method for molding the base shown in FIG. 23.

As to the process of insert-molding, as shown in FIGS. 25 and 26, first, press working is performed on a lead frame 60 so that coil terminals 14, 15 and contact terminals 16, 17 are stamped out, and besides fore end portions of these coil terminals 14, 15 are bent. Therefore, connecting end portions 14*a*, 15*a* of the coil terminals 14, 15 are one-step lower than connecting end portions 16*a*, 17*a* of the contact terminals 16, 17.

Then, juxtaposed flat core blocks 21, 22 are positioned to the lead frame 60 (FIG. 25), and the connecting end portions 16*a*, 17*a* are fused and thereby electrically connected to the flat core blocks 21, 22. Subsequently, iron cores 23, 24 of the flat core blocks 21, 22 are fitted to holes 32, 33 of the coil plate 30 (FIG. 26), and connecting conductors (not shown) of the coil plate 30 are electrically connected to the connecting end portions 14*a*, 15*a* of the coil terminals 14, 15.

Then, with the lead frame 60 pinched and held by an unshown die, a box-shaped base body 11 is molded. Further, the coil terminals 14, 15 and the contact terminals 16, 17 are cut off from the lead frame 60, and their fore end portions are bent to the bottom face of the base body 11, by which the base 10 is completed. Subsequently, a contact plate 40 is assembled to an annular step portion 13 provided at an opening edge portion of the base 10. The other processes of this embodiment are carried out in the same manner as in the foregoing embodiment, by which the assembly work is completed.

Figure 27:
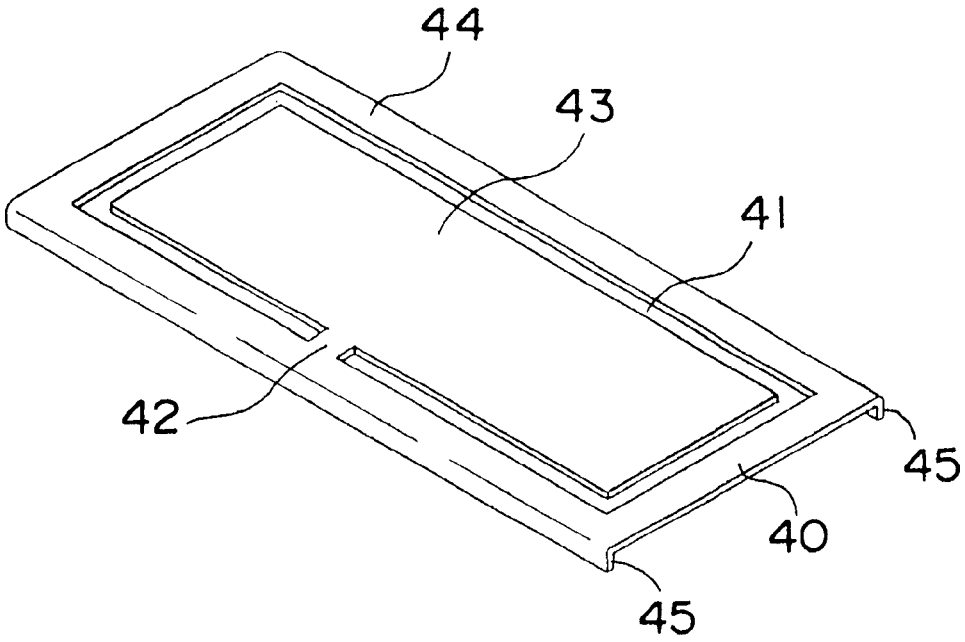
FIG. 27 is an exploded perspective view of a relay according to a seventh embodiment.
Figure 27:
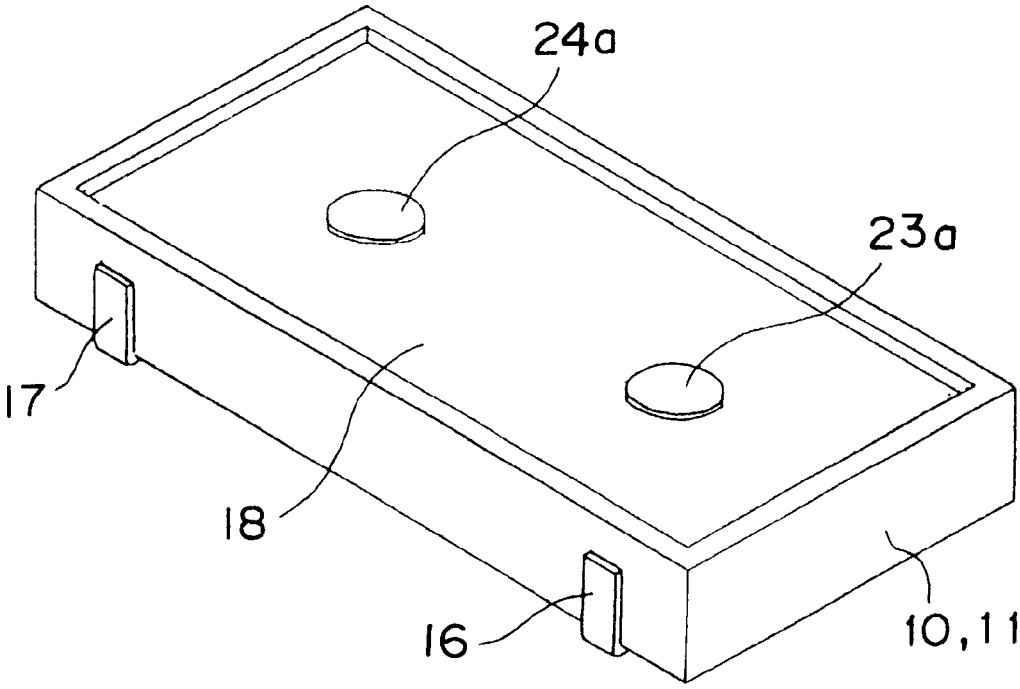

A seventh embodiment, as shown in FIG. 27, is a case where ribs 45, 45 formed by bending up both side edge portions of the movable contact plate 40 are placed and assembled directly onto the insulating film 18 of the base 10, whereas the foregoing sixth embodiment is a case where the movable contact plate 40 is fitted to the annular step portion 13 of the base 10. According to this embodiment, there is an advantage that the base 10 is easier to form.

Figure 28:
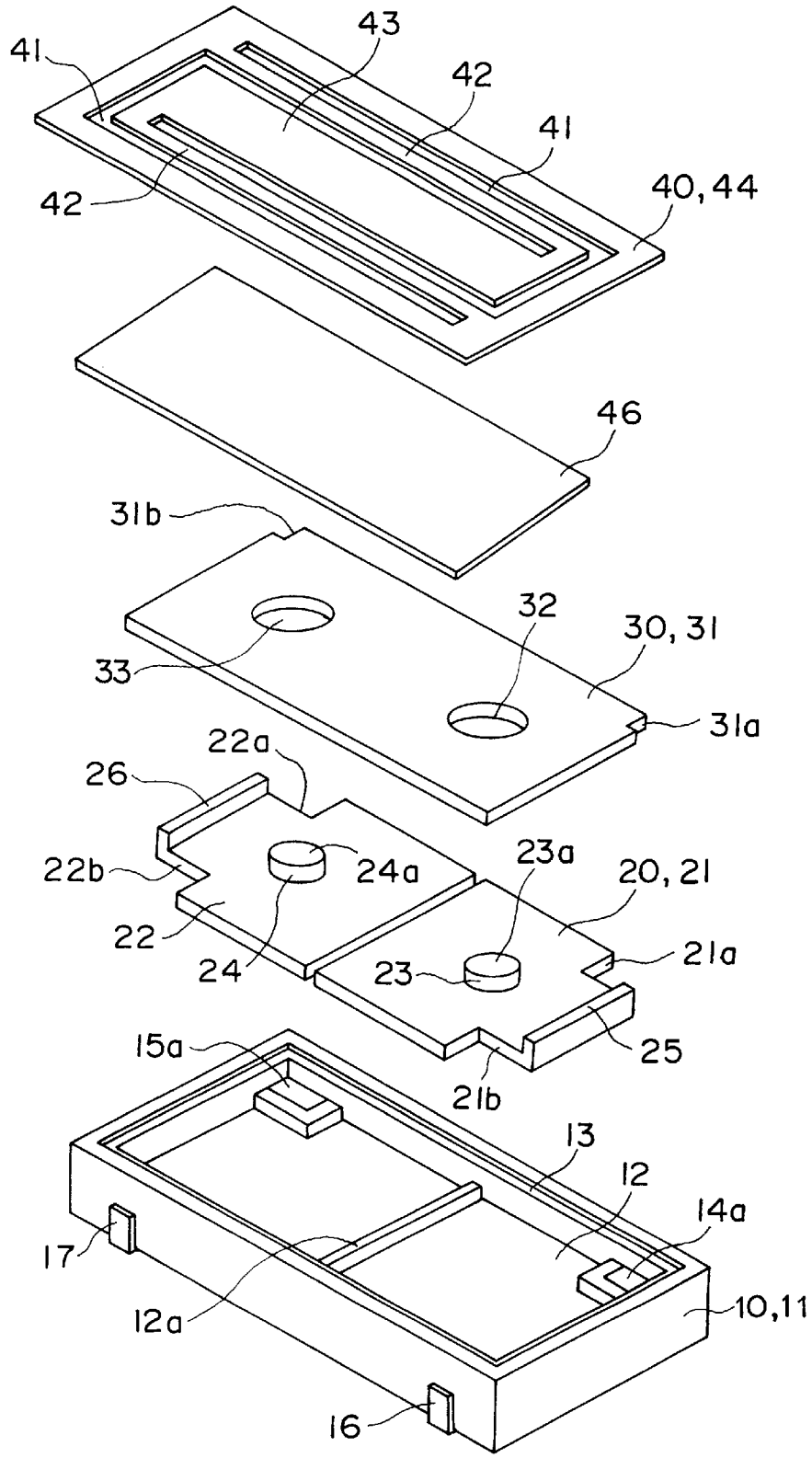
FIG. 28 is an exploded perspective view of a relay showing an eighth embodiment of the present invention.
Figure 29A:
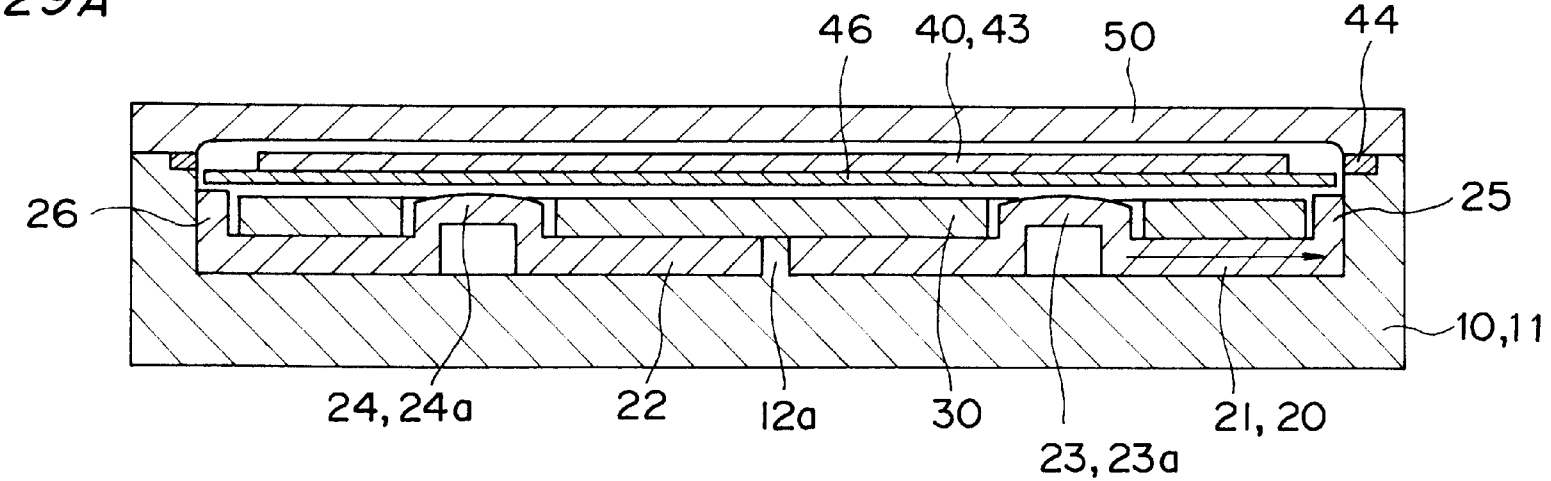
FIGS. 29A and 29B are sectional views of the relay shown in FIG. 28.
Figure 29B:
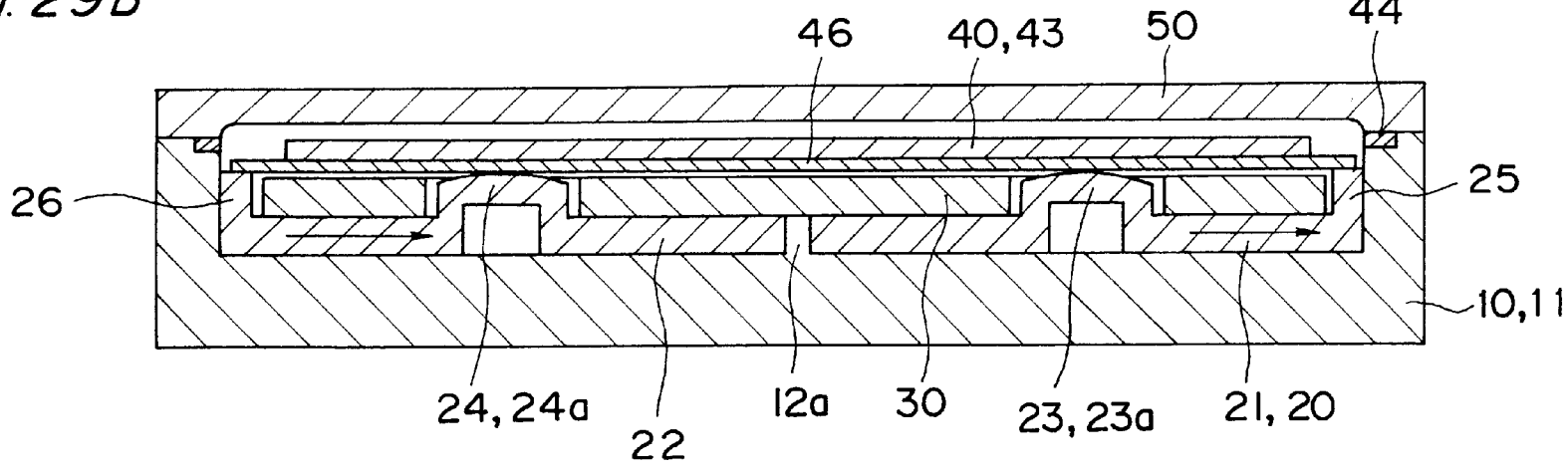

An eighth embodiment, as shown in FIGS. 28 to 29B, is similar to the second embodiment except three differences.

The three differences are that ribs 25, 26 are formed at outer edge portions of the flat core blocks 21, 22, respectively, that the movable contactor 43 of the movable contact plate 40 is supported by a pair of crank-like hinge portions 42, 42 and that a soft magnetic material 46 is integrated with the lower surface of the movable contactor 43.

More specifically, the ribs 25, 26 of the flat core blocks 21, 22 bondingly attract both-end edge portions of the soft magnetic material 46. As a result, less leakage of the magnetic flux occurs at the gap between the flat core blocks 21, 22 so that the magnetic efficiency can be enhanced. Otherwise, without assembling the soft magnetic material 46 to the movable contact plate 40, the ribs 25, 26 may be enabled to directly attract the movable contact plate 40.

Further, the movable contactor 43 of the movable contact plate 40 is supported by a pair of crank-like hinge portions 42, 42. Therefore, the movable contactor 43 will never tilt, becoming unlikely to make one-side hitting on the fixed contacts 23*a*, 24*a*, so that the contact reliability is improved.

Furthermore, the soft magnetic material 46 is intended to prevent magnetic saturation and to secure a desired attractive force. The soft magnetic material 46 may be amorphous, or otherwise, pure iron, permalloy, magnetic stainless, Permendur or the like having electrical conductivity, where the material may have an electrical conductive layer formed by plating or the like. Then, the soft magnetic material 46 preferably has an area at least equal to the movable contactor 43, but may be slightly smaller than the area of the whole movable contact plate 40. In addition, the movable contact plate 40 may be made of, for example, a copper-based spring material or the like.

Then, the movable contact plate 40 and the soft magnetic material 46 can be joined and integrated by existing process such as resistance welding, laser welding, brazing, ultrasonic crimping via a plated layer and the like. In addition, the soft magnetic material 46 is preferably joined and integrated to a surface opposite to the fixed contacts 23*a*, 24*a*.

Next, operation of the relay constituted as described above is explained.

First, in the case where no voltage is applied to the coil plate 30 with no excitation, the soft magnetic material 46 integrated with the movable contactor 43 and the fixed contacts 23*a*, 24*a* are opposed to each other with a specified contact gap retained therebetween (FIG. 29A), where the contact terminals 16, 17 are in the open state.

Then, when voltage is applied to the coil plate 30 so that the coil plate 30 is excited, there occur magnetic fluxes of mutually opposite directions along the axes of the iron cores 23, 24. Therefore, as shown in FIG. 29B, magnetic flux flows through a magnetic circuit formed by the iron core 23, the soft magnetic material 46 and the iron core 24. As a result, the soft magnetic material 46 is attracted to the iron cores 23, 24 of the flat core blocks 21, 22 against the spring force of the crank-like hinge portions 42, 42 of the movable contact plate 40, thus coming into contact with the fixed contacts 23*a*, 24*a* and closing an electric circuit. At the same time, both end portions of the soft magnetic material 46 are attracted to the ribs 25, 26 of the flat core blocks 21, 22, closing a magnetic circuit.

In addition, the electric circuit is formed up by the contact terminal 16, the flat core block 21, the fixed contact 23*a*, the soft magnetic material 46, the fixed contact 24*a*, the flat core block 22 and the contact terminal 17.

Then, the voltage application to the coil plate 30 is halted with the excitation released, the magnetic flux is dissipated and the soft magnetic material 46 is restored to the original state by the spring force of the hinge portions 42, 42. Therefore, the soft magnetic material 46 is opened and separated from the fixed contacts 23*a*, 24*a* so that the electric circuit and the magnetic circuit are opened.

According to the eighth embodiment, because the ribs 25, 26 are formed in the flat core blocks 21, 22, less leakage of the magnetic flux occurs at the gap between the flat core blocks 21, 22 so that the magnetic efficiency is improved.

Further, because the soft magnetic material 46 is integrally joined to the lower surface of the movable contactor 43, magnetic saturation becomes unlikely to occur, making it easier to secure the attractive force.

Furthermore, because the flat core blocks 21, 22 can be coated over a wide area via the soft magnetic material 46, even less leakage of the magnetic flux occurs so that the magnetic efficiency is further improved.

Then, because the slits 41, 41 do not need to be formed narrow in order to cut out a larger movable contactor 43 from the movable contact plate 40 that is limited in area, the movable contact plate 40 becomes easier to fabricate.

Besides, the spring material suitable for the hinge portions 42 of the movable contact plate 40 and the material suitable for the soft magnetic material 46 can be selected independently of each other, allowing a higher degree of freedom of selection. Thus, the design becomes easier to accomplish.

Further, because the movable contact plate 40 can be made wider in area, a desired magnetic circuit becomes easier to form. Therefore, connection with yokes having various configurations becomes easier to make, allowing an even higher degree of freedom of design.

In addition, the above embodiment has been described on a case where the movable contactor 43 is put into and out of contact with the fixed contacts 23*a,* 24*a* projecting from the holes 32, 33 of the coil plate 30, but this is not necessarily limitative. For example, the movable contactor 43 may be machined by protruding process and cut-and-raising process, or another member movable contact may be provided, so that the movable contact of the movable contactor 43 can be put into and out of contact with the fixed contacts 23*a,* 24*a* that are not protruded from the holes 32, 33.

Figure 30A:
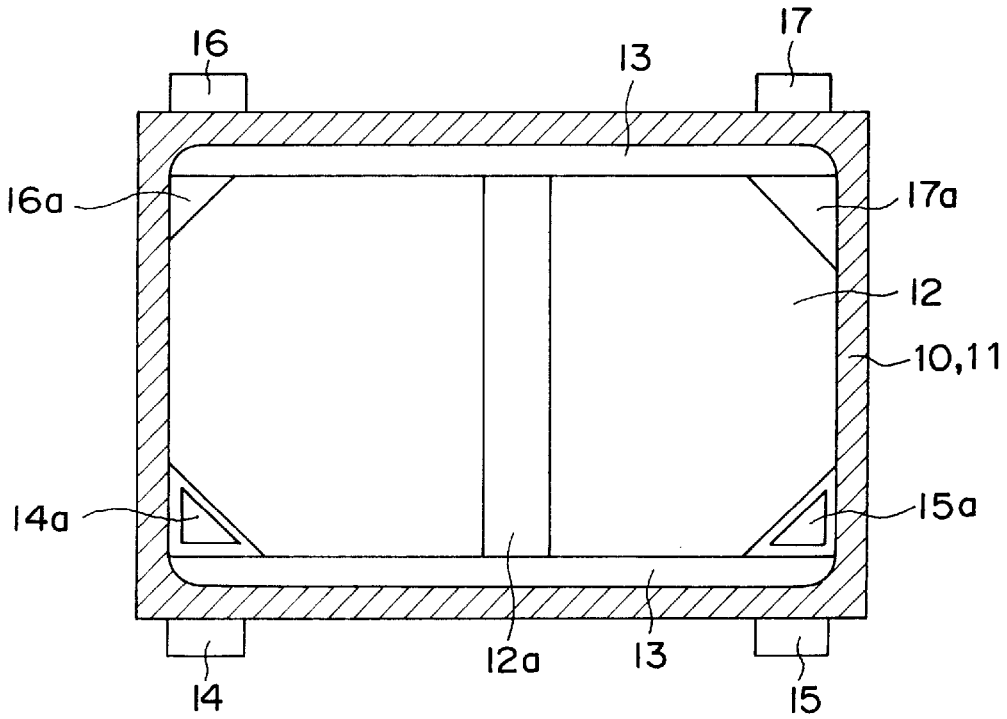
FIGS. 30A and 30B are plan views showing a state of intermediate assembly process of a relay showing a ninth embodiment of the present invention.
Figure 30B:
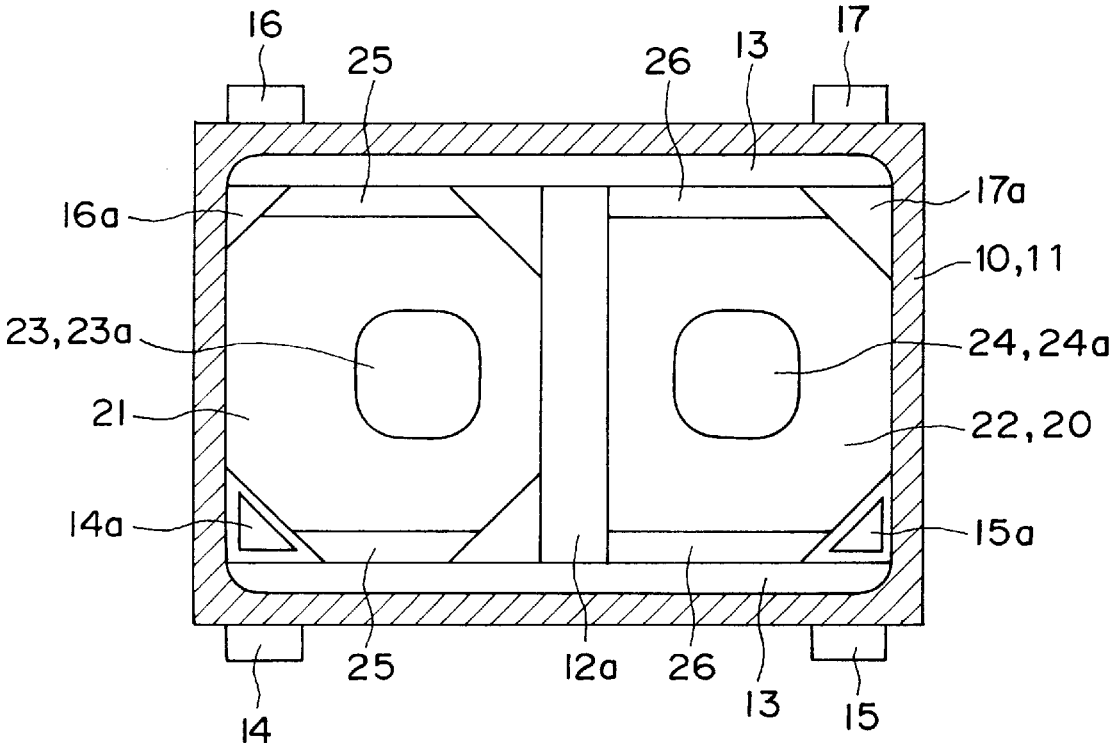

A ninth embodiment, as shown in FIGS. 30A to 32, is generally similar to the eighth embodiment, the difference being that a pair of ribs 25, 25 and 26, 26 are formed in opposite edge portions of the flat core blocks 21, 22, respectively (FIG. 30B).

More specifically, the flat core blocks 21, 22 are dropped and fitted to one-sided halves of the bottom face 12 partitioned by the insulative linear protrusion 12*a* of the box-shaped base 10, respectively, and then electrically connected to the connecting end portions 16*a,* 17*a* of the fixed contact terminals 16, 17, respectively.

Figure 31A:
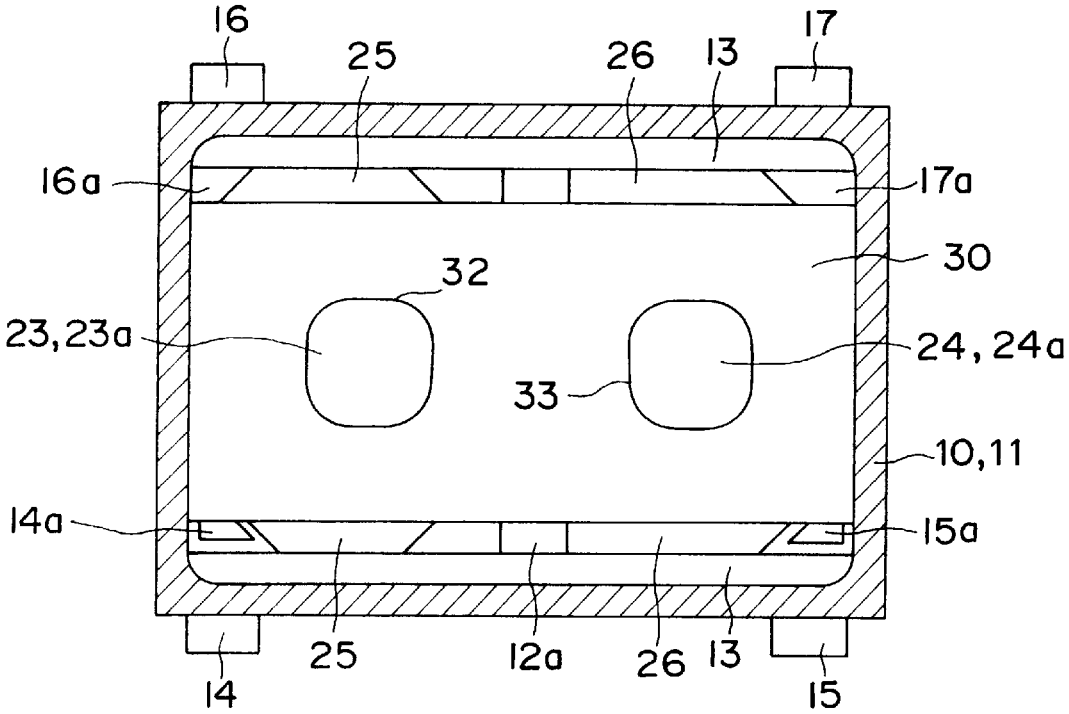
FIGS. 31A and 31B are plan views showing a state of intermediate assembly process of the relay showing the ninth embodiment.

Subsequently, the holes 32, 33 of the coil plate 30 are fitted and positioned to the iron cores 23, 24 of the flat core blocks 21, 22, by which the fixed contacts 23*a,* 24*a* are protruded (FIG. 31A).

Figure 31B:
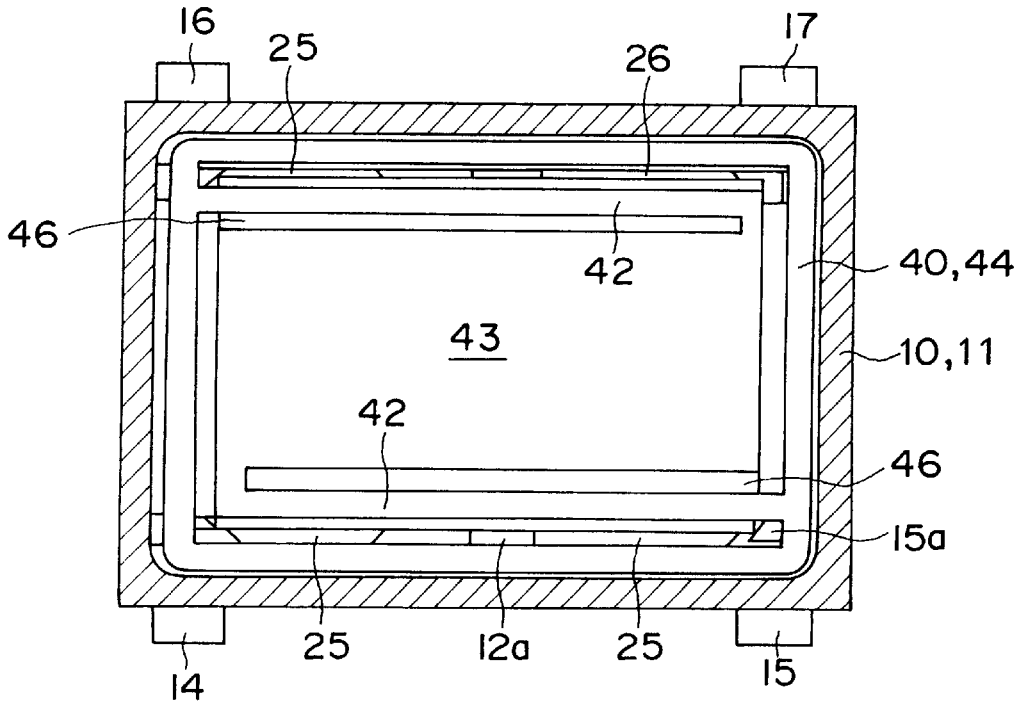
Figure 32:
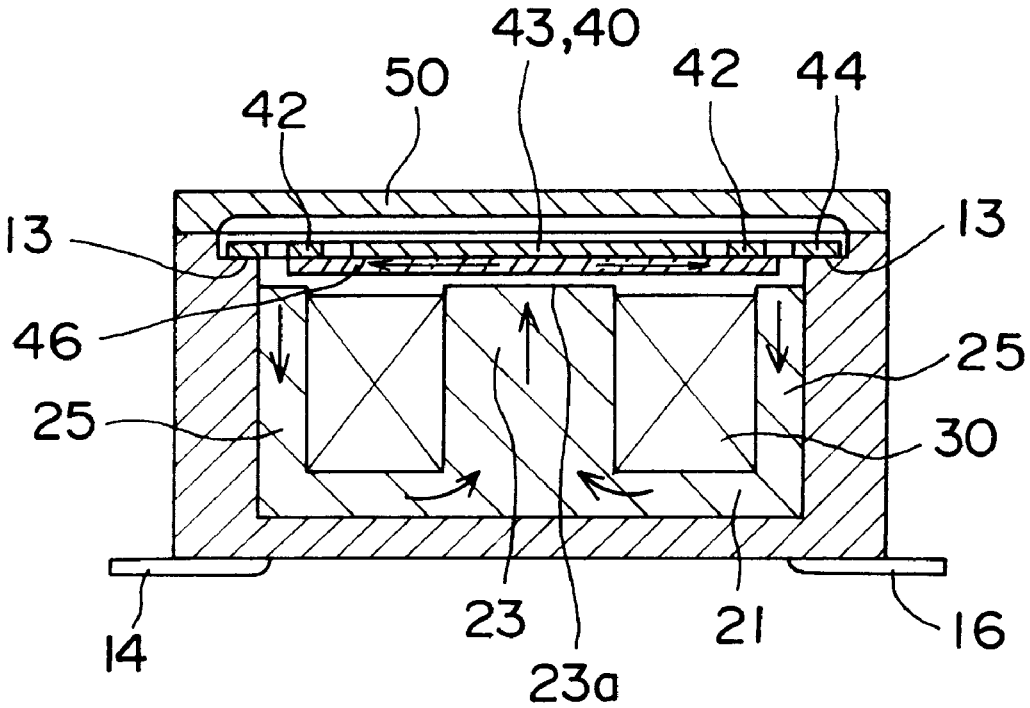
FIG. 32 is a sectional view a state of completed assembly of the relay showing the ninth embodiment of the present invention.

Meanwhile, the soft magnetic material 46 is integrated to the lower surface of the movable contactor 43 of the movable contact plate 40. Then, this movable contact plate 40 is positioned and assembled to parallel step portions 13, 13 formed at opening edge portions of the box-shaped base 10. As a result, center portion of the soft magnetic material 46 is contactably and separably opposed to the fixed contacts 23*a,* 24*a,* while both-side edge portions of the soft magnetic material 46 are contactably and separably opposed to the ribs 25, 26 of the flat core blocks 21, 22, respectively (FIG. 31B).

Furthermore, the cover 50 is integrated to the top-surface edge portion of the box-shaped base 10, by which the assembly work is completed.

In the relay having the above constitution, exciting and de-exciting the coil plate 30 causes the soft magnetic material 46 to move up and down in the thicknesswise direction. Therefore, center portion of the soft magnetic material 46 contacts and separates from the fixed contacts 23*a,* 24*a,* while edge portions of the soft magnetic material 46 contact and separate from a pair of ribs 25, 26 of the flat core blocks 21, 22, respectively. The rest of the embodiment is the same as the foregoing eighth embodiment and description is omitted.

According to the ninth embodiment, because the ribs 25, 26 of the flat core blocks 21, 22 with which the soft magnetic material 46 comes into and out of contact are provided each in a pair, less leakage of the magnetic flux occurs than in the eighth embodiment so that the magnetic efficiency is even more improved.

Also, connecting end portions 14*a,* 15*a* and 16*a,* 17*a* of the coil terminals 14, 15 and the fixed contact terminals 16, 17 are formed into a generally triangular planar shape. Therefore, the molding die becomes easier to produce than in the case of a rectangular planar shape, thus offering an advantage that the cost can be reduced.

Figure 33:
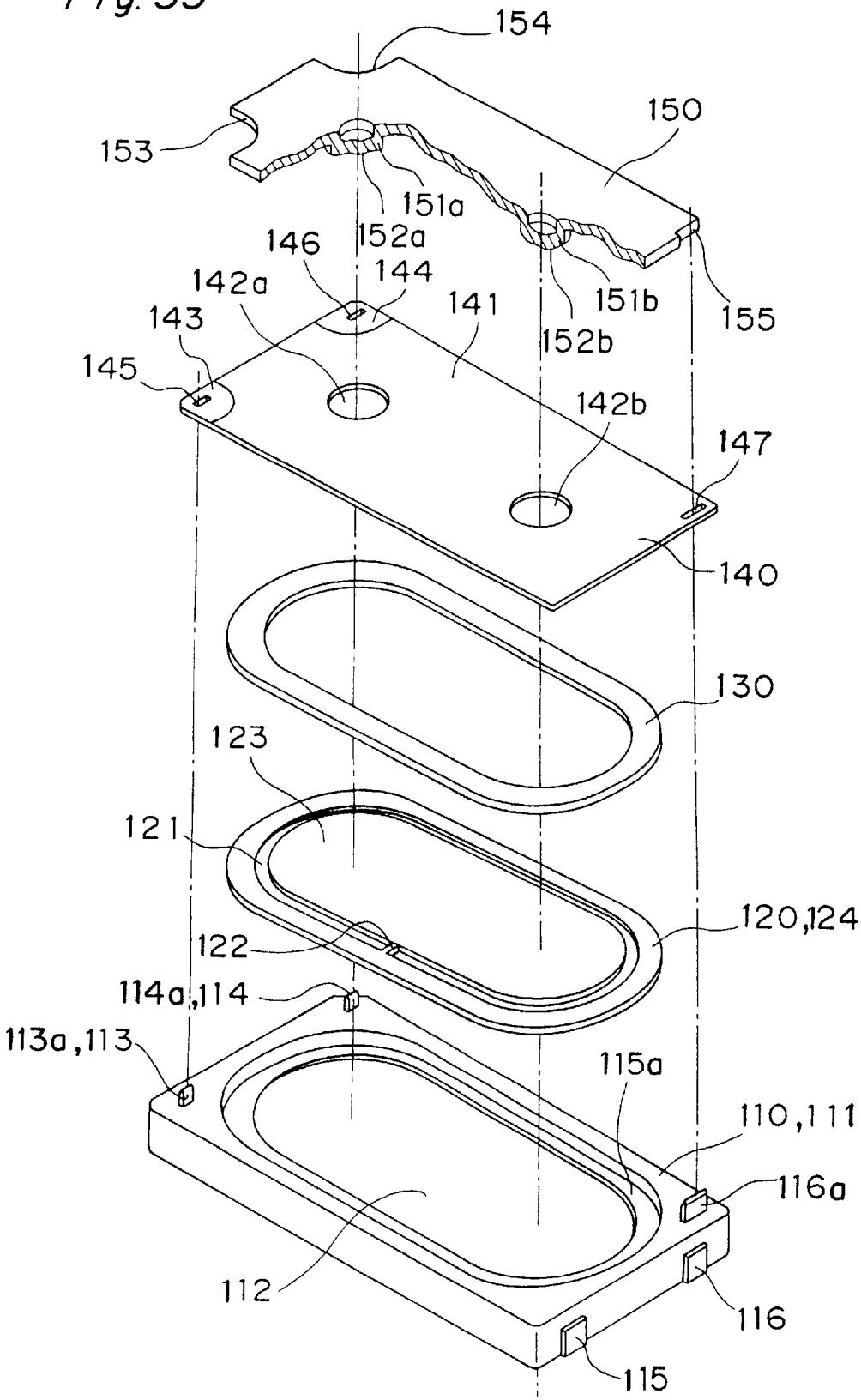
FIG. 33 is an exploded perspective view of a relay according to a tenth embodiment of the present invention.
Figure 34:
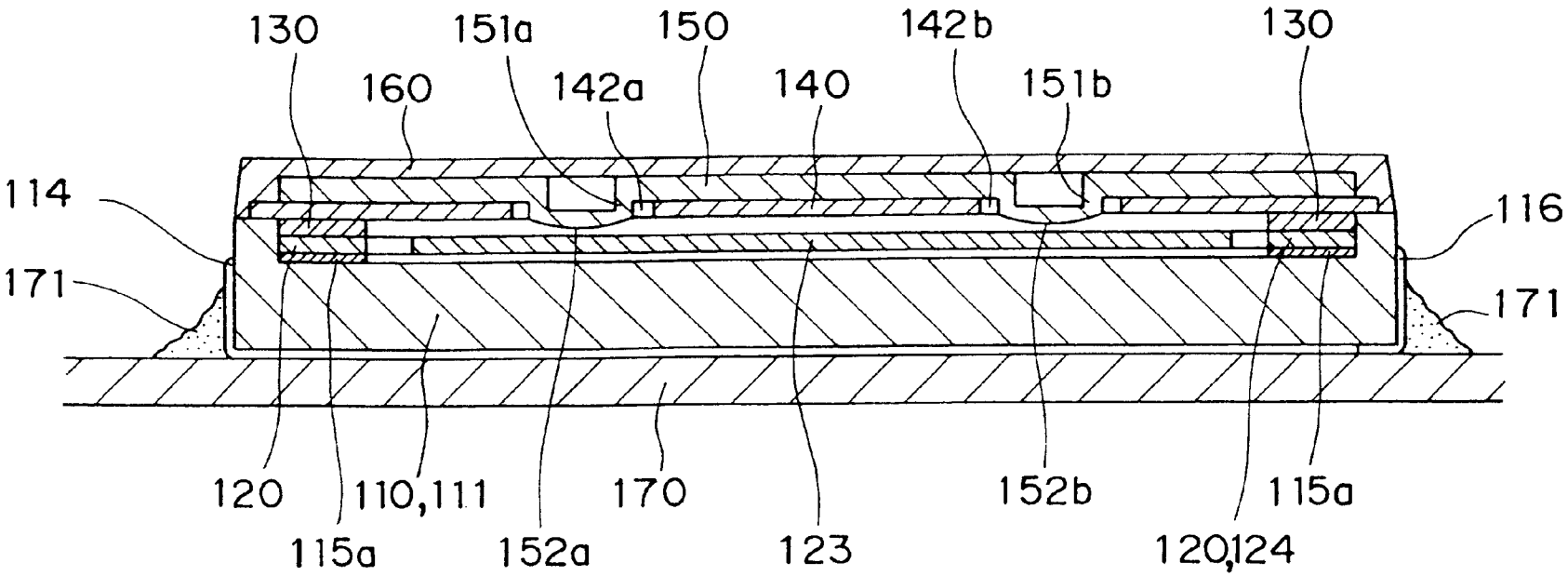
FIG. 34 is a sectional view showing a mounted state of the relay according to the tenth embodiment.

Next, a relay according to a tenth embodiment, as shown in FIGS. 33 and 34, generally comprises a base 110, a movable contact plate 120, a spacer 130, a coil plate 140, a flat core block 150 and an insulative cover 160.

The base 110 is formed by insert-molding a pair of coil terminals 113, 114, a movable contact terminal 115 and a fixed contact terminal 116 to a box-shaped base body 111 of a generally rectangular planar shape. Then, connecting end portions 113*a,* 114*a,* 116*a* for those members are protruded from top-surface edge portions of the base body 111. Further, an annular connecting end portion 115*a* is exposed from bottom corner portion of a recessed portion 112 provided in the top surface of the base body 111.

Figure 35A:
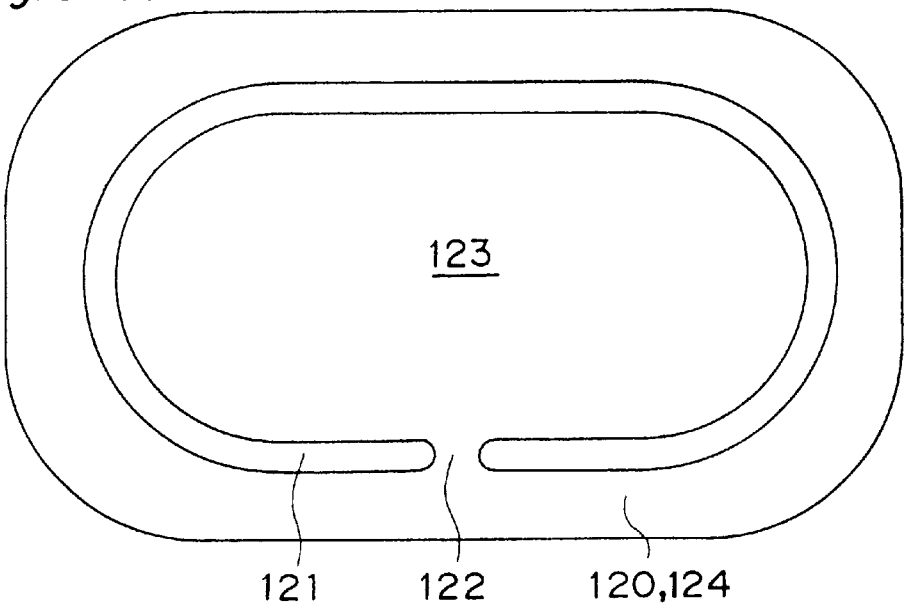
FIG. 35A is a plan view of a movable contact plate.
Figure 35B:
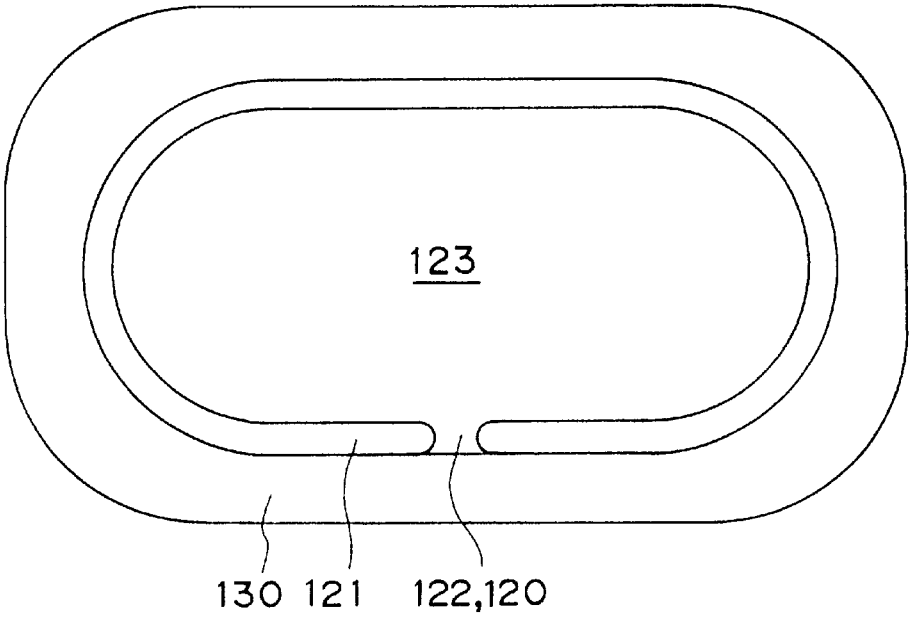
FIG. 35B is a plan view showing a state that a spacer is assembled to the movable contact plate.
Figure 35C:
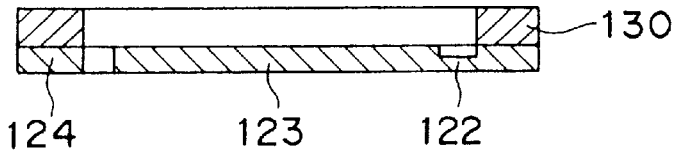
FIG. 35C is a sectional view showing a state that a spacer is assembled to the movable contact plate.

The movable contact plate 120, as shown in FIGS. 35A, 35B and 35C, is a thin plate made of an electrically conductive magnetic material having such a planar shape as to be fittable to the recessed portion 112 of the base body 111. Then, a slit 121 of a C-like planar shape is provided by press working, etching or the like, by which a hinge portion 122 is formed and besides a movable contactor 123 and an annular support member 124 are partitioned from each other. In particular, the hinge portion 122 is made thin and the movable contactor 123 can be pivoted with small external force, thus offering an advantage that a relay of high sensitivity can be obtained.

In addition, as required, a contact material such as gold or platinum having good electrical conductivity may be provided by plating, vapor deposition, pressure welding, welding, caulking, brazing or the like at at least portions of the top surface of the movable contactor 123 where the movable contactor 123 contacts later-described fixed contacts 152*a,* 152*b.*

Then, the movable contact plate 120 is fitted to the recessed portion 112 of the base 110, and the annular support member 124 is electrically connected to the connecting end portion 115*a* of the movable contact terminal 115 by a process of pressure welding, welding, brazing or the like, by which the movable contactor 123 is supported so as to be pivotable in the direction of plate thickness on a fulcrum of the hinge portion 122.

Figure 36A:
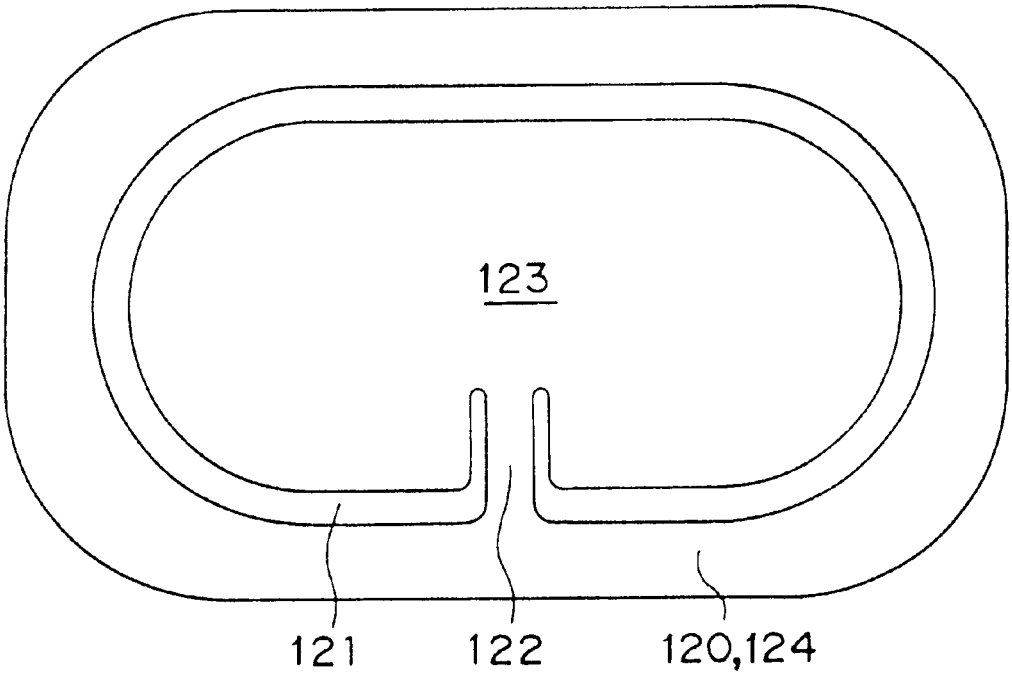
FIGS. 36A and 36B are plan views showing other application examples of the movable contact plate.
Figure 36B:
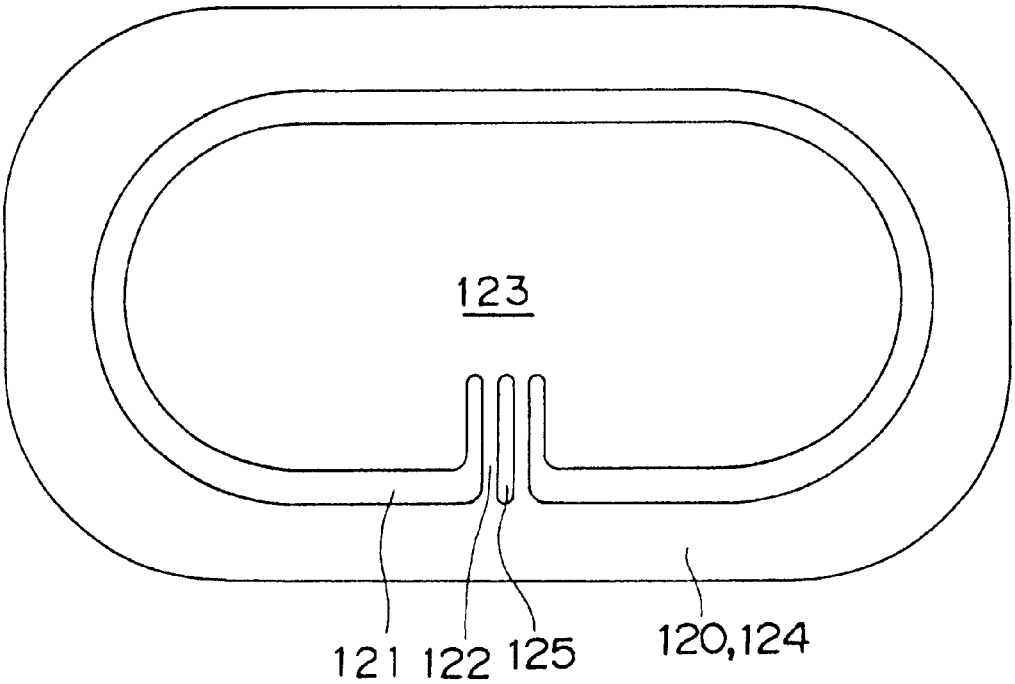

In addition, the movable contact plate 120, without being limited to the aforementioned configuration, may be so arranged that the hinge portion 122 is elongated, for example, as shown in FIG. 36A. Also, an elongate hole 125 may be provided at the elongated hinge portion 122, as shown in FIG. 36B. Forming such a hinge portion 122 allows the movable contactor 123 to be pivoted in the plate-thickness direction with smaller external force, thus offering an advantage that a relay of even higher sensitivity can be obtained.

Figure 37A:
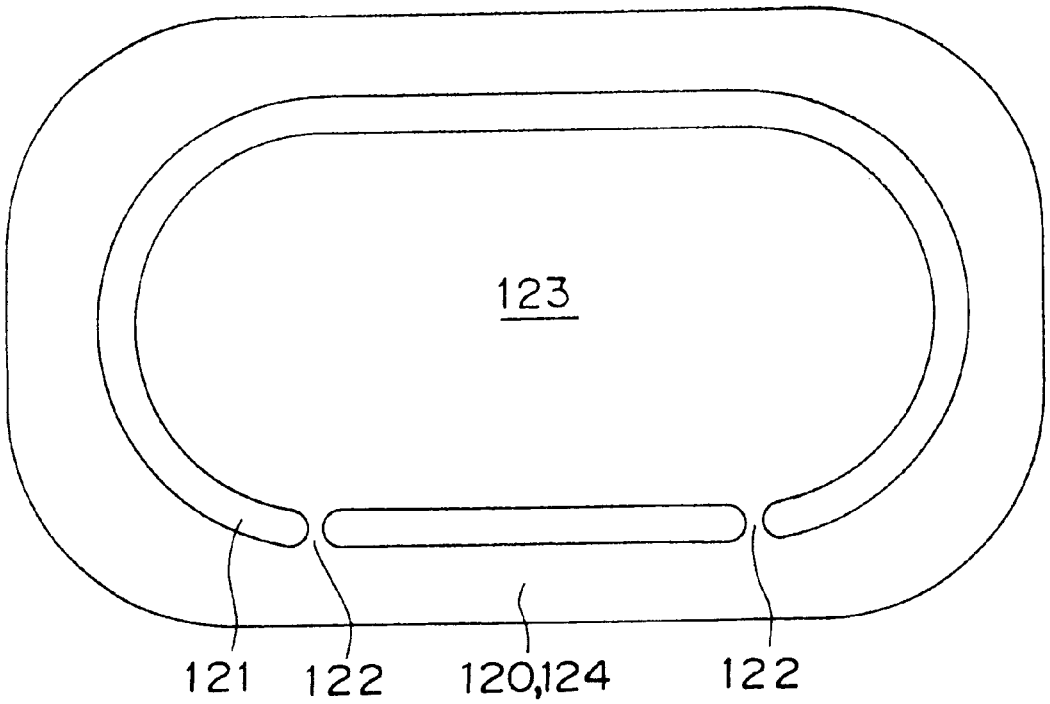
FIGS. 37A and 37B are plan views showing other application examples of the movable contact plate.

Also, the movable contact plate 120 may be so arranged that a pair of hinge portions 122 are juxtaposed to support the movable contactor 123, for example, as shown in FIG. 37A. According to this application example, the movable contactor 123 will never twist around the hinge portions 122, as would occur in the case where only one hinge portion 122 is provided, so that so-called chattering can be prevented and that the occurrence of one-side hitting is eliminated.

Figure 37B:
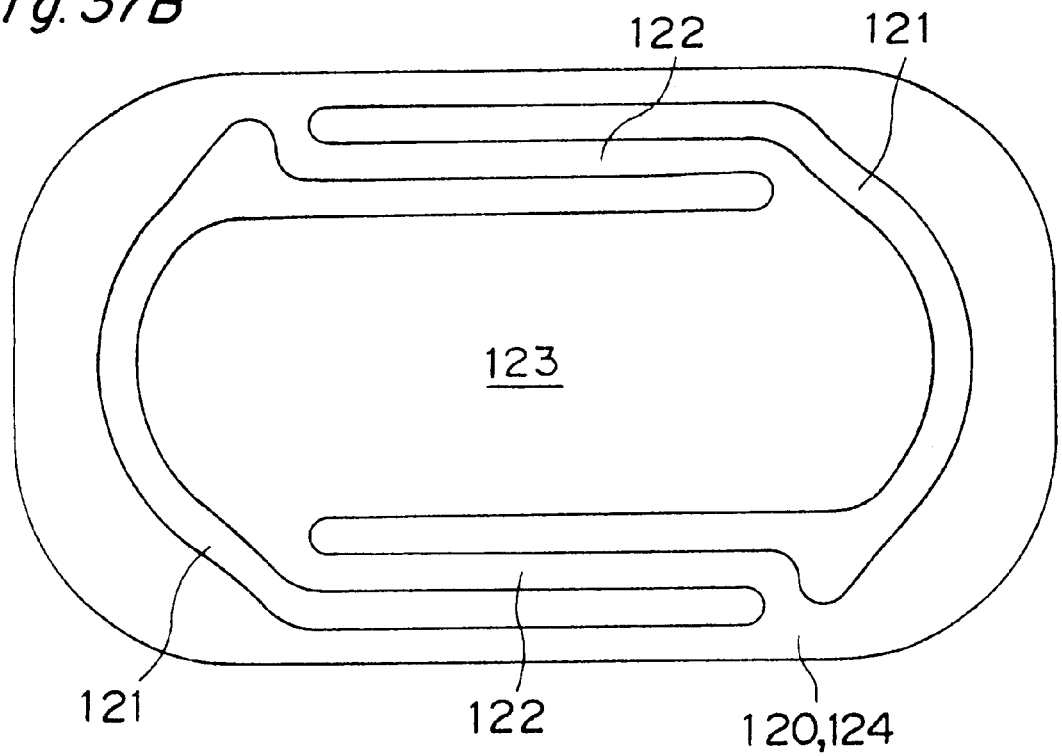

Further, it is also possible that, as shown in FIG. 37B, discontinuous two slits 121, 121 are provided and a pair of crank-like hinge portions 122, 122 extending inward from the annular support member 124 are formed so that the movable contactor 123 is supported by these hinge portions 122, 122. According to this application example, the movable contactor 123 moves parallel to the plate-thickness direction, and therefore does not make one-side hitting on the fixed contacts 152*a*, 152*b*. Also, because the hinge portion 122 is long, the amount of deformation per unit length becomes small so that fatigue failure is unlikely to occur, as an advantage.

Furthermore, when the movable contactor 123 cannot be pivoted at a desired speed due to the resistance of sealed internal gas, for example, one or more holes (not shown) for air ventilation may be provided in the movable contactor 123.

The spacer 130, which is intended to secure the pivoting space for the movable contactor 123, is a thin plate made of an annular insulating material having such a peripheral shape as to be fittable to the recessed portion 112 of the base body 111.

Then, the spacer 130 is fitted to the recessed portion 112 of the base 110 and stacked on the movable contact plate 120, so that the top surface of the spacer 130 and the top surface of the base body 111 become generally flush with each other (FIG. 34). Besides, inner-peripheral edge portion of the spacer 130 and inner-peripheral edge portion of the support member 124 are coincident with each other (FIG. 35C).

It is noted that the spacer 130 is not necessarily required to be annular shaped and may be a discontinuous one having a C-like planar shape.

Also, in the above embodiment, the movable contact plate 120 and the spacer 130 have been provided as separate members. However, without being necessarily limited to this, it is also possible that a spacer 130 made of synthetic resin is integrally molded to the top surface of the movable contact plate 120. Such formation by integral molding offers an advantage that the number of component parts and the number of assembly man-hours are reduced so that accuracy of the assembly and the productivity are improved.

Furthermore, the spacer 130 does not necessarily need to be provided. When the spacer 130 is not provided, a two-step bottomed recessed portion (not shown) may be provided in the base 111 so as to secure the pivoting space for the movable contactor 123, in which case the hinge portions are bent downward so that the movable contactor 123 is positioned to near the bottom face of the recessed portion.

Figure 38A:
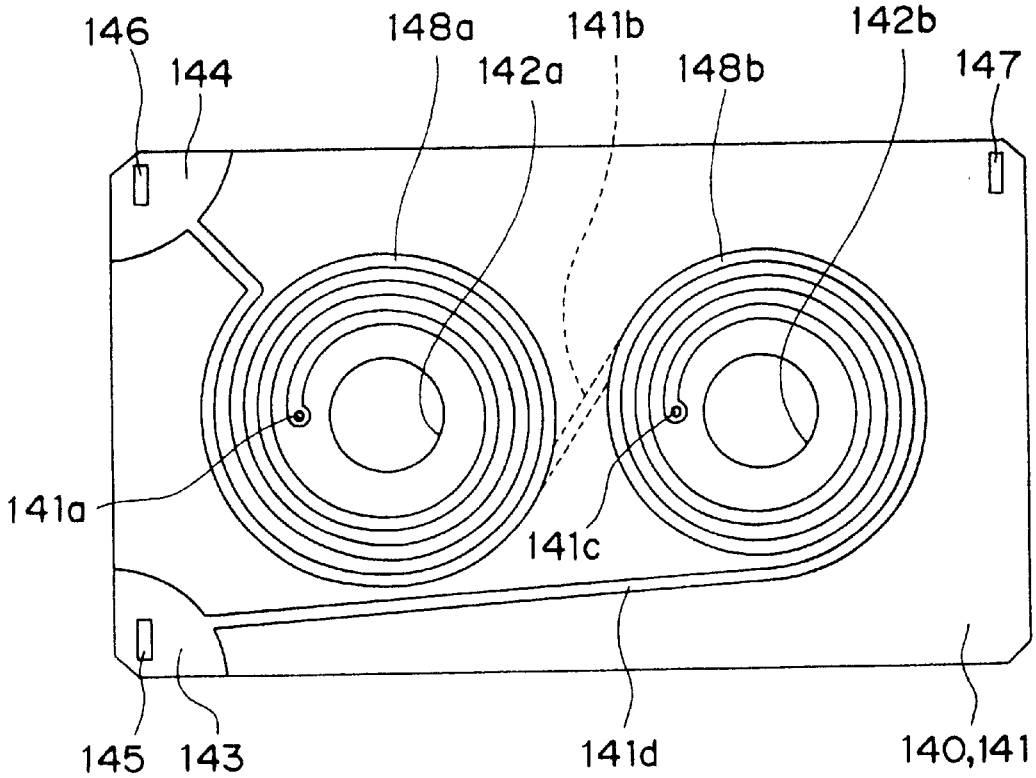
FIGS. 38A and 38B are a plan view and a sectional view, respectively, showing a coil plate.
Figure 38B:
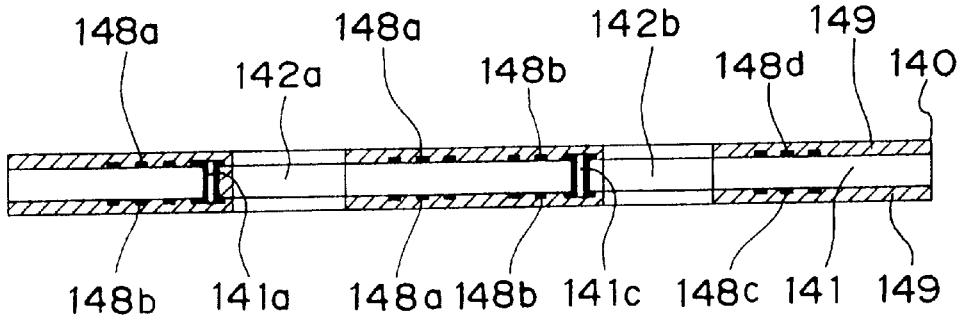

The coil plate 140, as shown in FIGS. 38A and 38B, comprises an insulative substrate 141 having such a planar shape as to be able to cover nearly all over the top surface of the base body 111. Then, in the coil plate 140, holes 142*a*, 142*b* are provided in its center, while connecting conductors 143, 144 are formed at upper and lower surfaces of adjacent corner portions. Besides, terminal holes 145, 146, 147 are provided at positions corresponding to the coil terminals 113, 114 and fixed contact terminal 116 of the base 110, respectively.

Then, a flat coil 148*a* extending from the connecting conductor 144 is formed spiral around the hole 142*a*. An end portion of the flat coil 148*a* is electrically connected to a spiral flat coil 148*b* formed on the rear surface of the insulative substrate 141 via a hole 141*a*. Moreover, an end portion of the flat coil 148*b* extends to a spiral flat coil 148*c* formed on the rear surface of the substrate 141 via a printed lead wire 141*b*. Besides, the flat coil 148*c* is electrically connected to a spiral flat coil 148*d* formed on the front surface via a hole 141*c*. Further, the flat coil 148*b* on the front surface is connected to the connecting conductor 143 via a printed lead wire 141*d*. Front and rear surfaces of the coil plate 140 are coated with an insulating film 149. In addition, the process for forming the flat coils 148*a*–148*d* is not limitative but may be optionally selected from among existing processes such as printing, vapor deposition, metallizing and etching.

Then, the coil plate 140 is assembled by its terminal holes 145, 146, 147 being fitted to the connecting end portions 113*a*, 114*a* of the coil terminals 113, 114 and the connecting end portion 116*a* of the fixed contact terminal 116, respectively. After that, the connecting end portions 113*a*, 114*a* of the coil terminals 113, 114 are electrically connected to the connecting conductors 143, 144 by pressure welding, welding, brazing or the like, respectively.

In addition, the above coil plate 140 has been described on a case where the flat coils 148*a*–148*d* are formed on the front and rear surfaces of the insulative substrate 141. However, without being necessarily limited to this, flat coils may be formed only on a one-side surface. Also, with a view to improving the insulation performance, two insulative substrates each having flat coils formed on a one-side surface may be laminated together. Besides, a plurality of layers may be given by stacking flat coils and insulating films alternately.

The flat core block 150 comprises an electrically conductive magnetic plate having such a planar shape as to be able to cover nearly all over the coil plate 140. Then, fore end portions of iron cores 151*a*, 151*b*, which are a pair of protruding portions formed so as to be protruded downward, are exploited as fixed contacts 152*a*, 152*b*. Besides, cutout portions 153, 154 for securing the insulative property, and a cutout portion 155 for electrical connection with the connecting end portion 116*a* of the fixed contact terminal 116 of the base 110 are provided in succession at adjacent corner portions.

In addition, as required, a contact material such as gold or platinum having good electrical conductivity may be provided by plating, vapor deposition, pressure welding, welding, caulking or the like at at least portions of the fixed contacts 152*a*, 152*b* where the fixed contacts 152*a*, 152*b* contact the movable contactor 123.

Also, the fixed contacts 152*a*, 152*b* are not necessarily required to be integrated with the flat core block 150, and separately provided fixed contacts 152*a*, 152*b* may be fixed to the flat core block 150 by press-fitting, caulking or brazing. For example, holes having a diameter equal to the diameter of the separately provided fixed contacts 152*a*, 152*b* are preparatorily provided in the flat core block 150, and in the final assembly process, the flat core block 150 may be press fitted and fixed into a specified position under measurement of the contact gap.

Then, the iron cores 151*a*, 151*b* of the flat core block 150 are fitted to the holes 142*a*, 142*b* of the coil plate 140, respectively, and fixed in close contact. Further, the connecting end portion 116*a* of the foxed contact terminal 116 is electrically connected to the cutout portion 155 of the flat core block 150 by pressure welding, welding, brazing, caulking or the like. As a result, the fixed contacts 152*a*, 152*b* are protruded downward slightly from the lower surface of the coil plate 140, and contactably and separably opposed to the movable contactor 123 with a specified contact gap retained (FIG. 34).

In addition, a resin film of polyethersulfone or the like is formed on the lower surface of the flat core block 150 except the fixed contacts 152*a*, 152*b* of the iron cores 151*a*, 151*b*. Meanwhile, the base 110 and the coil plate 140 are formed from a similar resin, or a similar resin film is formed on their joint surface. Then, the base 110 and the coil plate 140 are integrally joined together by the process of hot pressure welding, ultrasonic welding, solvent bonding or the like, by which a closed structure can be realized easily.

Also, if the base body 111 and the coil plate 140 are formed from ceramic or glass, a firmer closed structure with anode junction can be realized. With such a closed structure, corrosive gas, foreign matters and the like can be prevented from invasion from outside.

Further, inside of the closed space may be made high vacuum or highly insulative gas (e.g., sulfur hexafluoride gas) or fluid may be filled and sealed, in order that the insulation performance is improved.

The insulative cover 160, as shown in FIG. 34, may be a resin molded product having such a planar shape as to cover the coil plate 140 and the flat core block 150 assembled to the base 110, or otherwise, may be formed by injection of epoxy resin or the like or by low pressure molding.

Then, the relay constituted as described above is surface mounted to a printed board 170 via solder 171 as shown in FIG. 34.

The above embodiment has been described on a case where the flat core block 150 and the spacer 130 are implemented by component parts provided separately from the coil plate 140. However, without being necessarily limited to this, the spacer 130 may be formed integrally with the lower surface of the coil plate 140 by outsert-molding or the like. Further, conversely, at least one flat coil may be formed integrally with the lower surface of the flat core block 140 by plating or vapor deposition.

Next, operation of the relay constituted as described above is explained.

First, in the case where no voltage is applied to the coil terminals 113, 114 so that the flat coils 148*a*, 148*b* of the coil plate 140 are unexcited, the movable contactor 123 and the fixed contacts 152*a*, 152*b* are opposed to each other with a specified contact gap, where the movable contact terminal 115 and the fixed contact terminal 116 are in the open state.

Then, when voltage is applied to the coil terminals 113, 114 so that the flat coils 148*a*–148*d* are excited, there occur magnetic fluxes of mutually opposite directions along the axes of the iron cores 151*a*, 151*b*. Therefore, a magnetic flux flows through a closed magnetic circuit formed by the iron core 151*a*, the movable contactor 123, the iron core 151*b* and the flat core block 150. As a result, the movable contactor 123 is attracted to the iron cores 151*a*, 151*b* of the flat core block 150 against the spring force of the hinge portion 122 of the movable contact plate 120, thus coming into contact with the fixed contacts 152*a*, 152*b* and closing an electric circuit and a magnetic circuit.

Then, when the flat coils 148*a*–148*d* are de-excited, the magnetic flux is dissipated and the movable contactor 123 is restored to the original state by the spring force of the hinge portion 122. Thus, the movable contactor 123 is opened and separated from the fixed contacts 152*a*, 152*b* so that the electric circuit and the magnetic circuit are opened.

Figure 39:
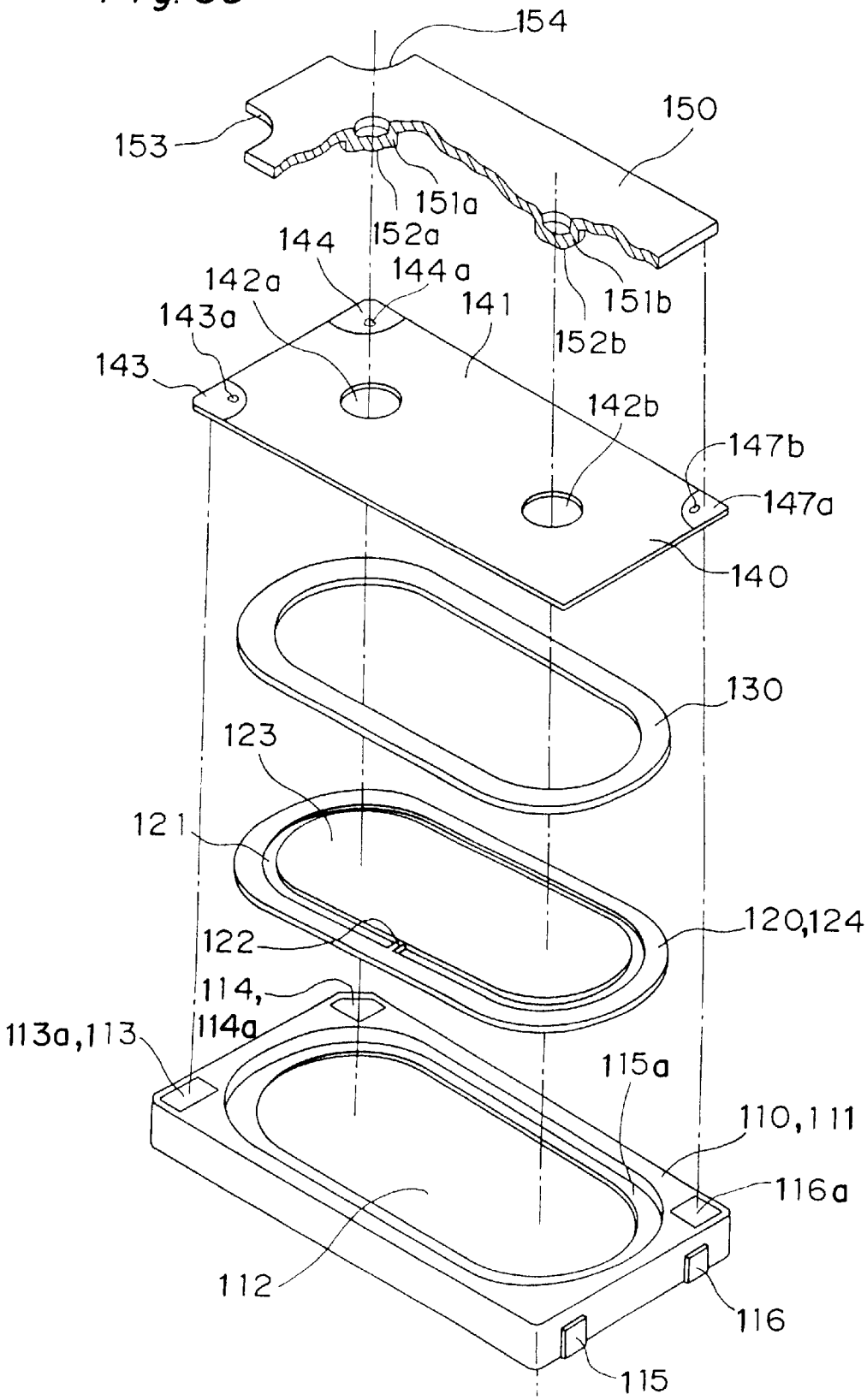
FIG. 39 is an exploded perspective view of a relay according to an eleventh embodiment of the present invention.

An eleventh embodiment is a case where the connecting end portions 113*a*, 114*a* and 116*a* of the coil terminals 113, 114 and fixed contact terminal 116 are buried so as to be flush with top-surface edge portions of the base body 111 as shown in FIG. 39.

Besides, for electrical connection, connecting conductors 143, 144 and a relaying conductor 147*a* are provided on front and rear surfaces of adjacent corner portions of the coil plate 140. Further, in order that these members are made to conduct up and down, holes 143*a*, 144*a*, 147*b* are provided, respectively. Also, in the flat core block 150, cutout portions 153, 154 are provided at adjacent corner portions in order to secure the insulating property.

Therefore, the coil plate 140 is placed on the base 110, to which the movable contact plate 120 and the spacer 130 are assembled. Then, the connecting conductors 143, 144 and relaying conductor 147*a* of the coil plate 140 are electrically connected to the connecting end portions 113*a*, 114*a* and 116*a* of the buried coil terminals 113, 114 and fixed contact terminal 116, respectively. Furthermore, as in the tenth embodiment, the flat core block 150 fixed in close contact to the coil plate 140 is electrically connected to the fixed contact terminal 116 via the relaying conductor 147*a*. The rest of the embodiment is nearly the same as the foregoing tenth embodiment, and description is omitted.

According to this embodiment, even if the base body 111 is implemented by a ceramic package, there is no need of protruding the coil terminals 113, 114 or the like, thus offering an advantage that the manufacturing cost can be reduced.

Figure 40:
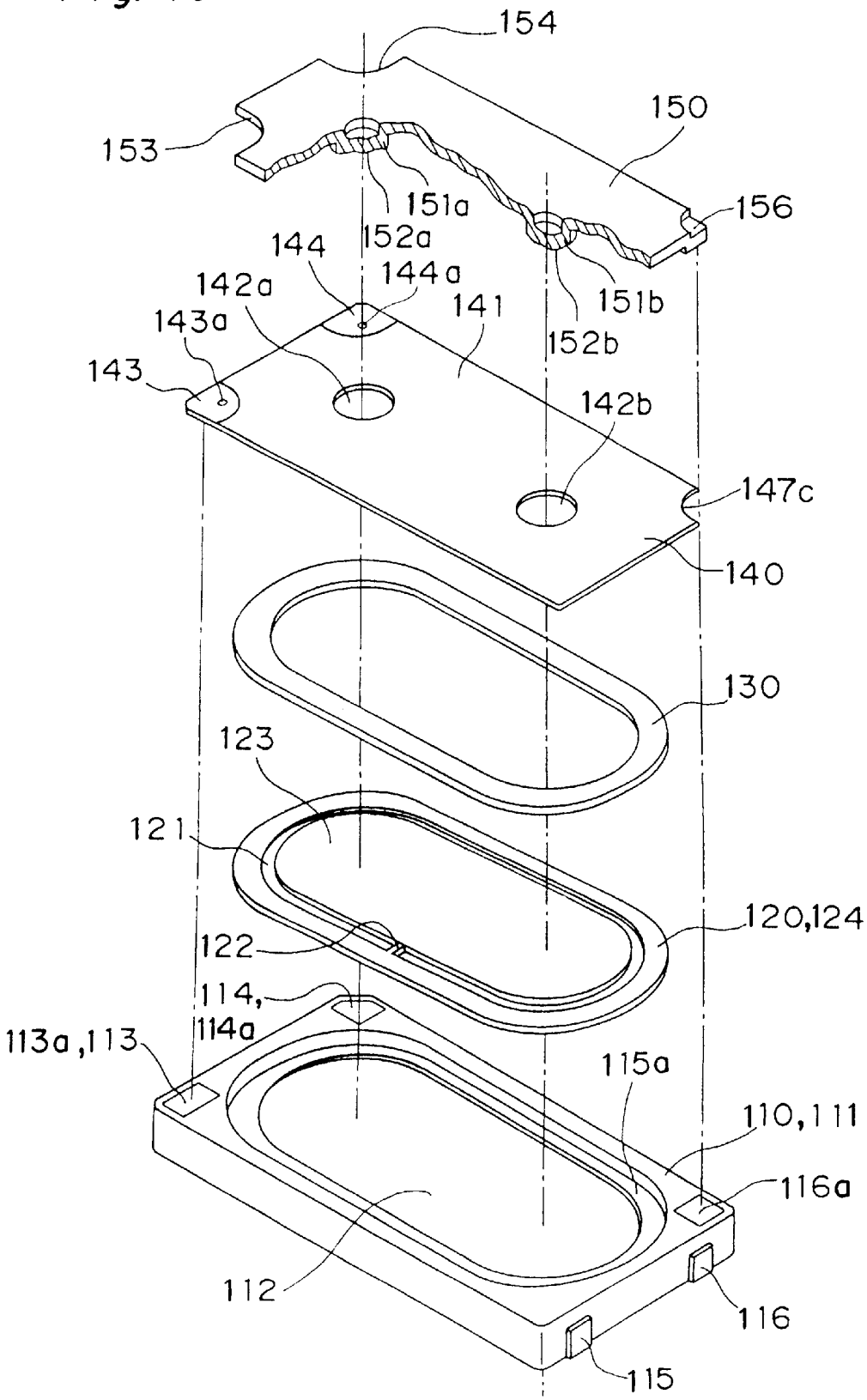
FIG. 40 is an exploded perspective view of a relay according to a twelfth embodiment of the present invention.

In a twelfth embodiment, as shown in FIG. 40, corner portions of the flat core block 150 are subjected to protruding process so that a connecting step portion 156 is protruded downward. Meanwhile, a cutout portion 147*c* is formed by cutting out a corner portion of the coil plate 140 located between this connecting step portion 156 and the fixed contact terminal 116. Then, the connecting step portion 156 of the flat core block 150 is integrally joined directly to the connecting end portion 116*a* of the fixed contact terminal 116 of the base 110, being thereby electrically connected thereto. The rest of the embodiment is the same as the foregoing tenth embodiment and description is omitted.

According to this embodiment, because the need of the relaying conductor of the coil plate 140 is eliminated, the machining process is simplified while the assembly accuracy and the contact reliability are improved, as advantages.

Figure 41:
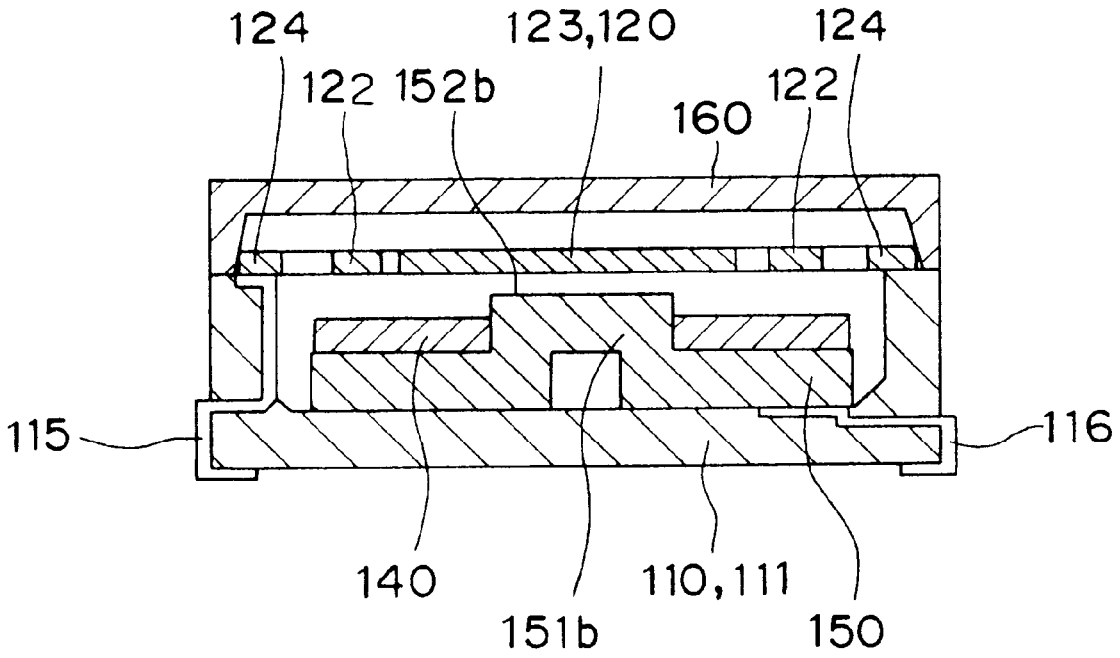
FIG. 41 is a side sectional view showing a relay according to a thirteenth embodiment of the present invention.
Figure 42A:
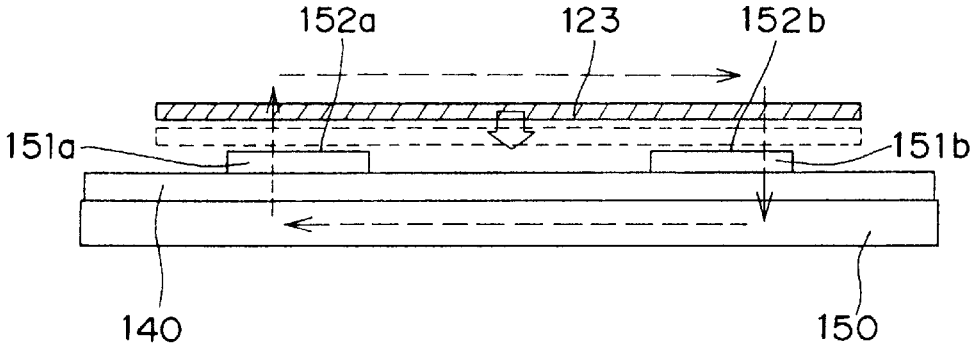
FIG. 42A is a schematic front view showing the relay according to the thirteenth embodiment of the present invention.
Figure 42B:
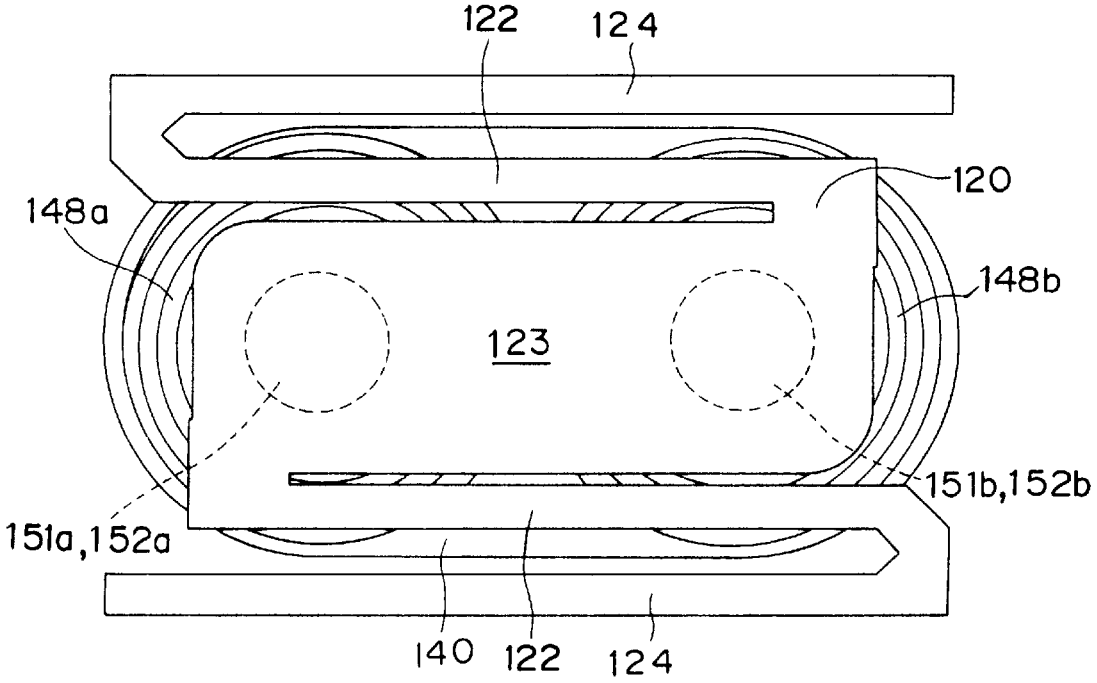
FIG. 42B is a schematic plan view of the same.

In a thirteenth embodiment, as shown in FIGS. 41 to 42B, the movable contact terminal 115 and the fixed contact terminal 116 are insert-molded to the box-shaped base body 111, by which the base 110 is formed. Then, a fixed contact plate 150 is positioned to the bottom face of this base 110 and electrically connected to the fixed contact terminal 116. Further, the coil plate 140 is assembled, and subsequently peripheral edge portion of the movable contact plate 120 is positioned to top-surface edge portion of the base body 111.

The movable contact plate 120 is made of a high-magnetic-permeability amorphous and, as shown in FIG. 42B, a movable contactor 123 is supported, reciprocatable in the plate-thickness direction, at crank-like hinge portions 122, 122 extending from a pair of linear support members 124, 124 arranged in parallel. Then, the movable contact plate 120 is sealed by a shallow-bottomed box-shaped insulative cover 160 assembled to the top-surface edge portion of the base body 111.

Therefore, in the unexcited state, the movable contactor 123 hung down at the hinge portions 122, 122 is opened and separated from the fixed contacts 152*a*, 152*b*.

Then, when voltage is applied to excite the flat coils 148*a*, 148*b* of the coil plate 140, there occur magnetic fluxes in directions of arrows shown by broken lines in FIG. 42A. Therefore, the iron cores 151*a*, 151*b* attract the movable contactor 123 so that the movable contactor 123 lowers in the plate-thickness direction against the spring force of the hinge portions 122, 122, coming into contact with the fixed contacts 152*a*, 152*b* and closing the electric circuit.

Further, when the voltage application to the flat coils 148*a,* 148*b* is halted with the excitation released, the movable contactor 123 is restored to the original state by the spring force of the hinge portions 122, 122. The rest of the embodiment is the same as the foregoing embodiment, and description is omitted.

According to this embodiment, the movable contactor 123 reciprocates parallel to the plate-thickness direction, thus being prevented from occurrence of one-side hitting. Also, because the amount of displacement per unit length of the hinge portions 122, 122 is small, there is an advantage that fatigue failure is unlikely to occur.

In addition, the above embodiment has been described on a case where the movable contactor 123 is put into and out of contact with the fixed contacts 152*a,* 152*b* protruding from the holes 142*a,* 142*b* of the coil plate 140, but this is not necessarily limitative. For example, the movable contactor 123 may be machined by protruding process and cut-and-raising process, or another member movable contact may be provided so that the movable contact of the movable contactor 123 can be put into and out of contact with the fixed contacts 152*a,* 152*b* that are not protruded from the holes 142*a,* 142*b*.

Also, in the above embodiment, because there is no need of providing any auxiliary yoke between the movable contact plate 120 and the coil plate 140, a highly efficient magnetic circuit can be formed, offering an advantage that contact-to-contact insulation can be obtained easily.

Figure 43:
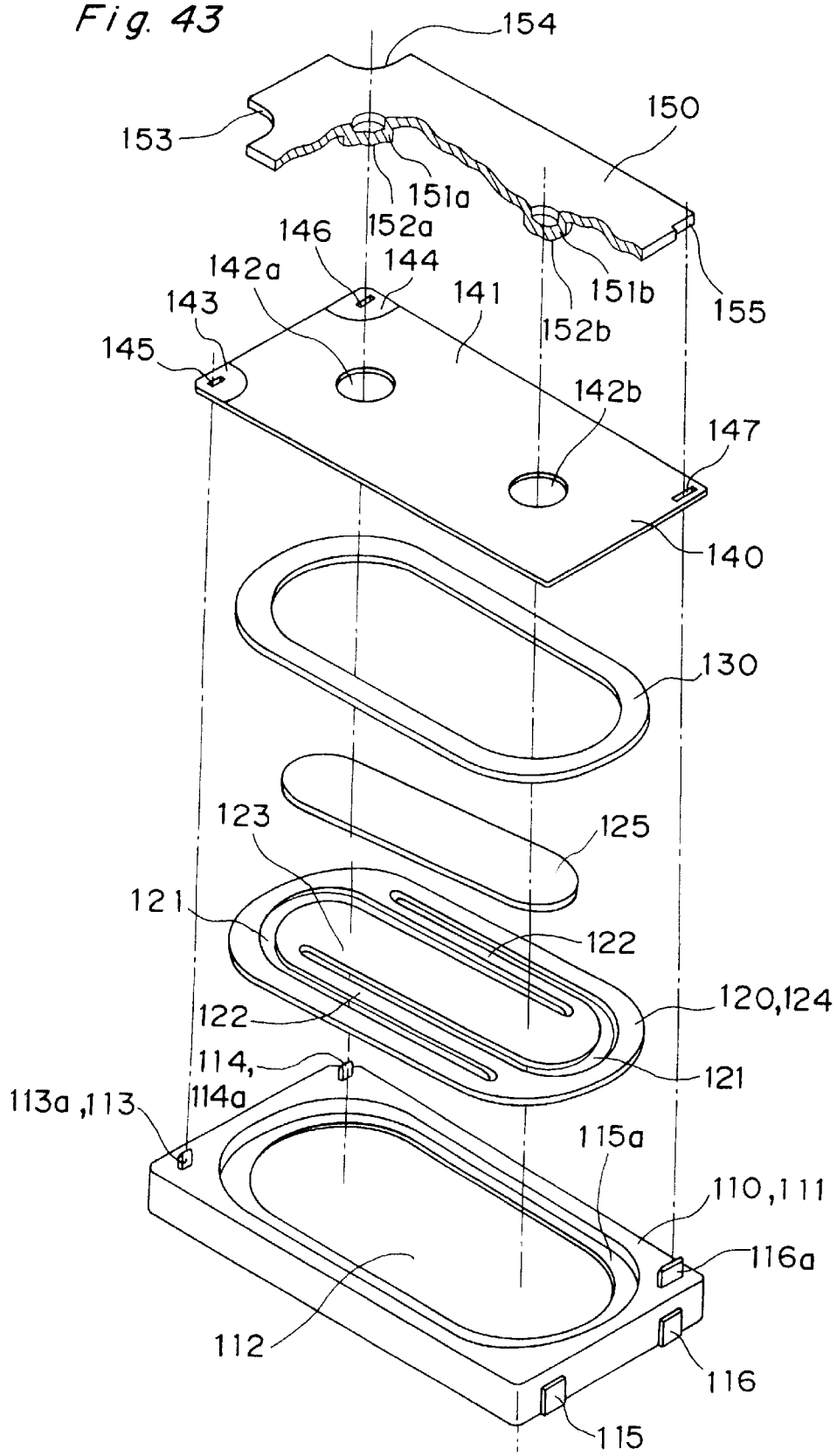
FIG. 43 is an exploded perspective view showing a relay according to a fourteenth embodiment of the present invention.

A fourteenth embodiment, as shown in FIG. 43, is nearly the same as the foregoing tenth embodiment, the difference being that a soft magnetic material 125 is integrally joined to the upper surface of the movable contactor 123 supported by the crank-like hinge portions 122, 122.

The soft magnetic material 125 is the same as in the foregoing eighth embodiment, and description is omitted.

Figure 44:
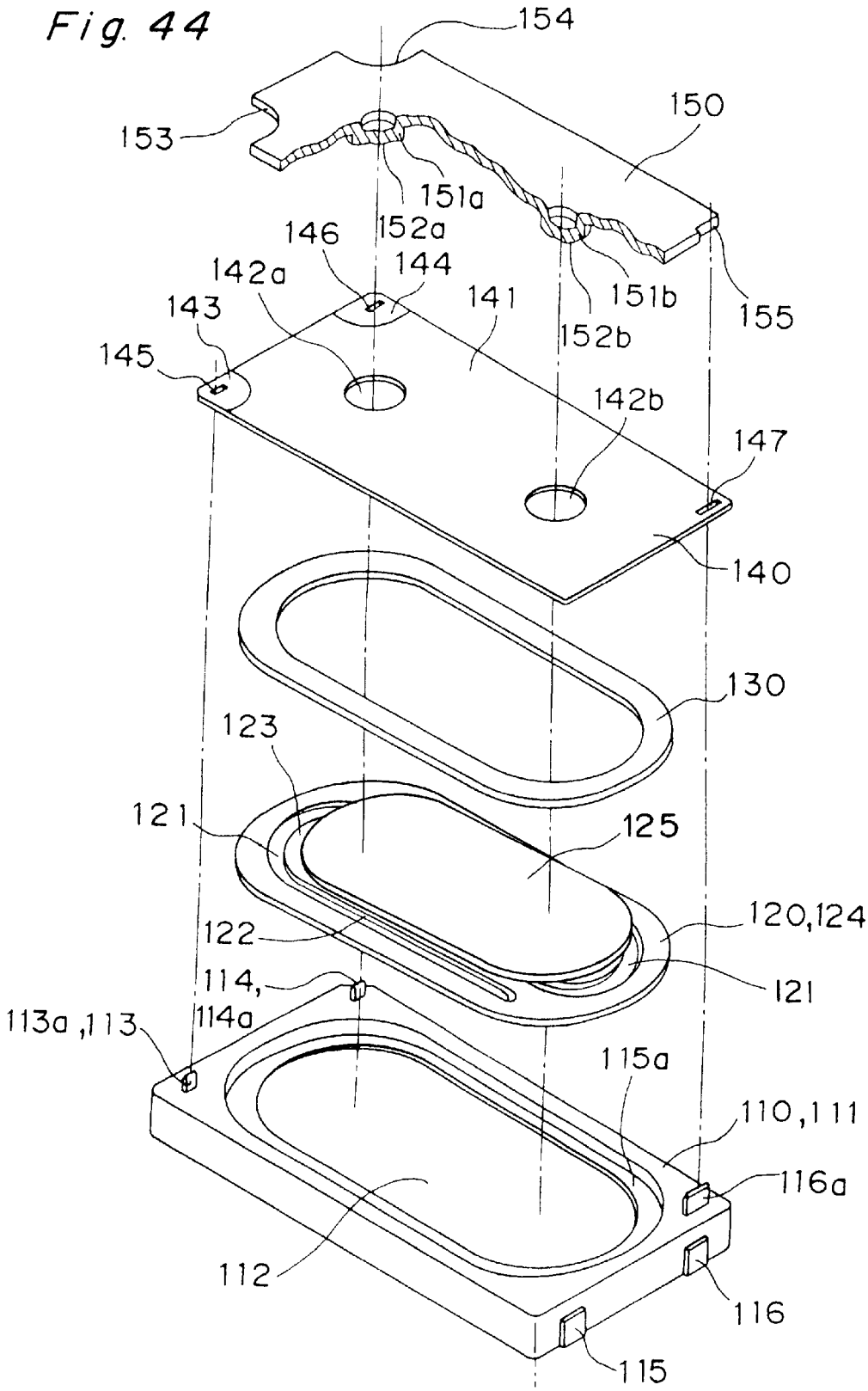
FIG. 44 is an exploded perspective view showing a relay according to a fifteenth embodiment of the present invention.

A fifteenth embodiment, as shown in FIG. 44, is nearly the same as the foregoing fourteenth embodiment, the difference being that the soft magnetic material 125 is larger in area than the soft magnetic material 125 of the fourteenth embodiment. However, this soft magnetic material 125 has only to be smaller in outside dimensions than the inside edge portion of the spacer 130.

Figure 45A:
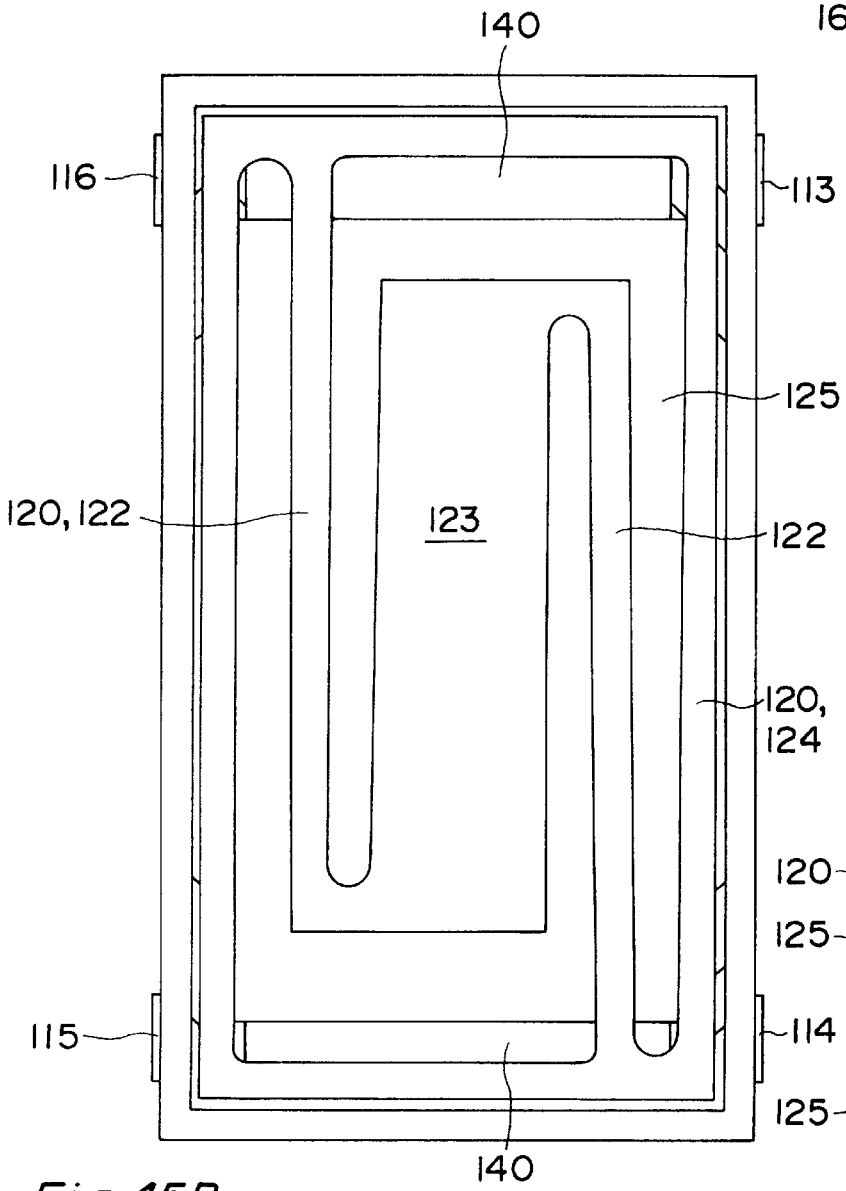
FIG. 45A is a plan view.
Figure 45C:
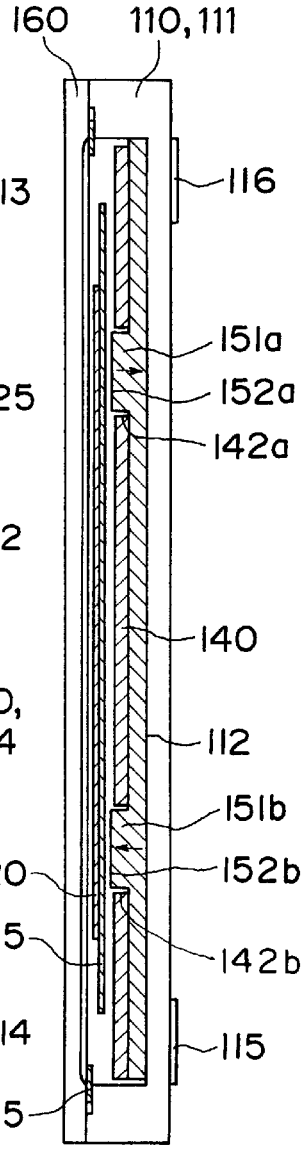
FIG. 45B is a front sectional view and FIG. 45C is a side sectional view, showing a relay according to a sixteenth embodiment of the present invention.
Figure 45B:
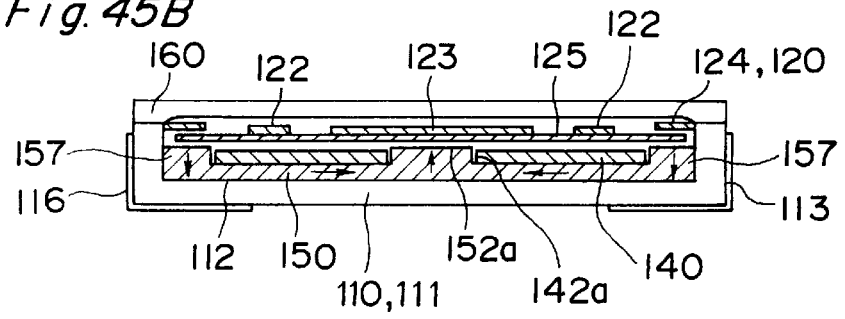
Figure 46:
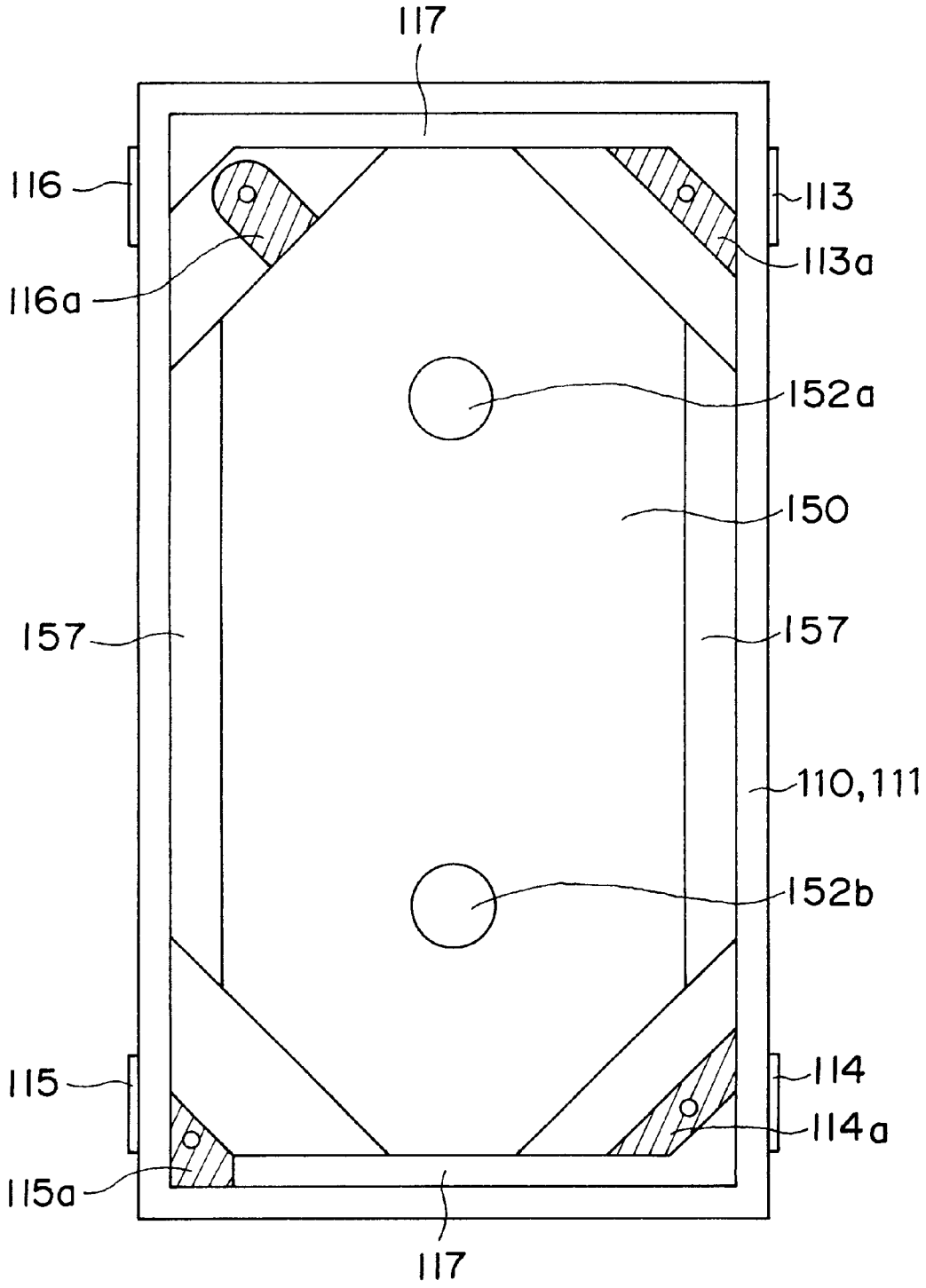
FIG. 46 is a plan view showing the base of the sixteenth embodiment.

A sixteenth embodiment, as shown in FIGS. 45A to 46, is so arranged that a flat core block 150 with corner portions cut away is dropped and fitted to the recessed portion 112 of the shallow-bottomed box-shaped base 110, and then electrically connected to the connecting end portion 116*a* of the fixed contact terminal 116 (FIG. 46). The flat core block 150 has ribs 157, 157 formed at both-side edge portions opposed to each other. Then, the holes 142*a,* 142*b* of the coil plate 140 are fitted to the iron cores 151*a,* 151*b* of this flat core block 150, and electrically connected to the connecting end portions 113*a,* 114*a* of the coil terminals 113, 114, respectively. Subsequently, the movable contact plate 120 having the soft magnetic material 125 integrally joined to the lower surface is positioned to a pair of parallel step portions 117, 117 provided at opening edge portions of the box-shaped base 110, and afterwards the positioned movable contact plate 120 is electrically connected to the connecting end portion 115*a* of the movable contact terminal 115. Finally, the cover 160 is assembled to the top surface of the box-shaped base 10 and sealed.

Therefore, when voltage is applied to the coil plate 140, magnetic fluxes that have occurred to the iron cores 151*a,* 151*b* of the flat core block 150 attract up the soft magnetic material, 125. As a result, center portion of the soft magnetic material 125 is attracted to the fixed contacts 152*a,* 152*b* against the spring force of the hinge portions 122, 122 of the movable contact plate 120. Moreover, both-side edge portions of the soft magnetic material 125 are attracted to the ribs 157, 157 of the flat core block 150, thus closing a magnetic circuit.

Therefore, an electric circuit is closed by the connecting end portion 116*a* of the fixed contact terminal 116, the flat core block 150, the soft magnetic material 125, the movable contact plate 120 and the connecting end portion 115*a* of the movable contact terminal 115. Further, a magnetic circuit is closed by the iron core 151*b* of the flat core block 150, the soft magnetic material 125 and the iron core 151*a*.

Next, when the voltage application is halted, the soft magnetic material 125 is restored to the original position by the spring force of the hinge portions 122, so that the magnetic circuit and the electric circuit are opened.

INDUSTRIAL APPLICABILITY

The relay according to the present invention is applicable to other relays without being limited to the above-described embodiments.

What is claimed is:

1. A relay comprising:

a coil plate having at least one layer of spiral flat coil formed around each of a pair of holes and electrically connected to each other; and fixed contacts and movable contacts which are opposed to each other contactably and separably via the respective holes in the coil plate, wherein the fixed contacts are provided on one side of each of a pair of flat core blocks juxtaposed and insulated from one another, while the movable contacts are provided on one movable contactor which is supported so as to be drivable along a direction of plate thickness via at least one hinge portion extending from a support member for a movable contact plate.

2. The relay according to claim 1, wherein the fixed contacts are placed at fore end portions of iron cores of protrusions, which are protrusively provided on one side of the flat core blocks and also insertable into the holes in the coil plate.

3. The relay according to claim 1, wherein the movable contacts are placed at fore end portions of protrusions, which are protrusively provided on the movable contactor and also insertable into the holes in the coil plate.

4. The relay according to claim 1 wherein the flat core block is electrically connected to a connecting end portion of a contact terminal exposed from a bottom face of a box-shaped base.

5. The relay according to claim 1 wherein in the movable contact plate, a slit of a roughly C-like planar shape is provided in a thin plate made of an electrically conductive magnetic material, whereby a hinge portion is formed and whereby the annular support member and the movable contactor are partitioned from each other.

6. The relay according to claim 1, wherein the movable contact plate is fitted to an annular step portion formed at an opening edge portion of the box-shaped base.

7. The relay according to claim 1, wherein the flat core block is fixed in close contact to an insulating film provided on a lower surface of the coil plate, while the support member for the movable contact plate is fixed in close contact to an insulating film provided on an upper surface of the coil plate.

8. The relay according to claim 1, wherein a pair of flat core blocks electrically connected to connecting end portions of a pair of contact terminals cut out from a lead frame are integrally molded with the base.

9. The relay according to claim 1, wherein both a pair of flat core blocks electrically connected to connecting end portions of a pair of contact terminals cut out from a lead frame, and a coil plate electrically connected to connecting end portions of a pair of coil terminals cut out from the lead frame are integrally molded with the base.

10. The relay according to claim 1, wherein a thin-plate soft magnetic material is integrally joined to the movable contactor of the movable contact plate.

11. The relay according to claim 1, wherein the thin-plate soft magnetic material has a planar shape generally identical to a planar shape of the movable contact plate except for the peripheral edge portion.

12. The relay according to claim 1, wherein a rib for forming a magnetic circuit is protrusively provided on at least one edge portion of the flat core block.

13. The relay according to claim 12, wherein an end portion of the rib for forming a magnetic circuit is contactably opposed to a peripheral edge portion of the thin-plate soft magnetic material.

14. A relay comprising:

a coil plate having at least one layer of spiral flat coil formed around each of a pair of holes and electrically connected to each other; and fixed contacts and movable contacts which are opposed to each other contactably and separably via the respective holes in the coil plate, wherein the fixed contacts are provided on one side of one flat core block, while the movable contacts are provided on one movable contactor which is supported so as to be drivable along a direction of plate thickness via at least one hinge portion extending from a support member for a movable contact plate.

15. The relay according to claim 14, wherein in the movable contact plate, a slit of a roughly C-like planar shape is provided in a thin plate made of an electrically conductive magnetic material, whereby the at least one hinge portion is formed and whereby the annular support member and the movable contactor are partitioned from each other.

16. The relay according to claim 14 or 15, wherein a spacer is held between the support member for the movable contact plate and the coil plate.

17. The relay according to claim 14, wherein the support member for the movable contact plate is thicker than the movable contactor and the hinge portion.

18. The relay according to claim 14, wherein the hinge portion is made thin.

19. The relay according to claim 14, wherein a hole is provided in the hinge portion.

20. The relay according to claim 15, wherein both end portions of the slit extend within the movable contactor so as to form an elongated hinge portion.

21. The relay according to claim 14, wherein the flat core block having an iron core is fixed in close contact to an insulating film provided on an upper surface of the coil plate, while the support member for the movable contact plate is fixed in close contact to an insulating film provided on a lower surface of the coil plate.

22. The relay according to claim 14, wherein the flat core block having an iron core is fixed in close contact to an insulating film provided on an upper surface of the coil plate, while the support member for the movable contact plate is fixed in close contact via a spacer to an insulating film provided on a lower surface of the coil plate.

23. The relay according to claim 14, wherein a lower-surface edge portion of the coil plate is integrally joined to a top-surface edge portion of the box-shaped base, and the movable contact plate is accommodated in a sealed space formed by sealing the holes of the coil plate with the flat core block having an iron core.

24. The relay according to claim 14, wherein an insulating film is provided on a portion of the lower surface of the flat core block that serves as a joint surface to the coil plate, and wherein the coil plate and the box-shaped base are formed from the same material as the insulating film.

25. The relay according to claim 14, wherein a thin-plate soft magnetic material is integrally joined to the movable contactor of the movable contact plate.

26. The relay according to claim 25, wherein the thin-plate soft magnetic material has a planar shape generally identical to a planar shape of the movable contact plate except for the peripheral edge portion.

27. The relay according to claim 14, wherein a rib for forming a magnetic circuit is protrusively provided on at least one edge portion of the flat core block.

28. The relay according to claim 27, wherein an end portion of the rib for forming a magnetic circuit is contactably opposed to a peripheral edge portion of the thin-plate soft magnetic material.

29. The relay according to claim 14, comprising:

a box-shaped base in which a movable contact terminal is exposed from a bottom-face corner portion of the base and in which upper end portions of the coil terminal and the fixed contact terminal are exposed from a top-surface edge portion of the base;

a movable contact plate accommodated in the box-shaped base and electrically connected to the movable contact terminal;

a coil plate fixed in close contact to the top-surface edge portion of the box-shaped base and having a flat coil electrically connected to an upper end portion of the coil terminal; and a flat core block which is fixed in close contact to an upper surface of the coil plate and in which iron cores protrusively provided on a lower surface of the flat core block are protruded from the holes of the coil plate and moreover which is electrically connected to the upper end portion of the fixed contact terminal.

30. The relay according to claim 29, wherein the upper end portions of the coil terminal and the fixed contact terminal protruding from the top-surface edge portion of the box-shaped base are fitted to and thereby electrically connected to their corresponding terminal holes or cutout portions provided in the coil plate and the flat core block, respectively.

31. The relay according to claim 29, wherein out of the upper end portions of the coil terminal and the fixed contact terminal exposed flush from the top-surface edge portion of the box-shaped base, the upper end portion of the coil terminal has coil plates stacked thereon and electrically connected, while the upper end portion of the fixed contact terminal is electrically connected to the flat core block via a relaying conductor provided to the coil plates.

32. The relay according to claim 29, wherein out of the upper end portions of the coil terminal and the fixed contact terminal exposed flush from the top-surface edge portion of the box-shaped base, the upper end portion of the coil terminal has coil plates stacked thereon and electrically connected, while a connecting step portion provided downwardly protruding from an edge portion of the flat core block is joined directly to the upper end portion of the fixed contact terminal and electrically connected.

* * * * *

UNITED STATES PATENT AND TRADEMARK OFFICE

CERTIFICATE OF CORRECTION

PATENT NO. : 6,169,469 B1
DATED : January 2, 2001
INVENTOR(S) : Shuichi Misumi et al.

It is certified that error appears in the above-identified patent and that said Letters Patent is hereby corrected as shown below:

Title page,
Item [87], PCT Pub. Date, should be -- November 6, 1997 --

Signed and Sealed this

Ninth Day of November, 2004

JON W. DUDAS
*Director of the United States Patent and Trademark Office*